US006072451A

United States Patent [19]

Mano et al.

[11] Patent Number: 6,072,451

[45] Date of Patent: Jun. 6, 2000

[54] LIQUID-CRYSTAL HALFTONE DISPLAY SYSTEM

[75] Inventors: Hiroyuki Mano, Chigasaki; Toshio Tanaka; Tsutomu Furuhashi, both of Yokohama; Masaaki Kitajima, Hitachiota; Toshio Futami; Masaki Mega, both of Mobara; Shigeyuki Nishitani, Ebina; Naruhiko Kasai, Fujisawa; Kohji Takahashi, Mobara, all of Japan

[73] Assignee: Hitachi, Ltd., Tokyo, Japan

[21] Appl. No.: 07/953,807

[22] Filed: Sep. 30, 1992

[30] Foreign Application Priority Data

Oct. 1, 1991 [JP] Japan ..... 3-253455
Aug. 19, 1992 [JP] Japan ..... 4-220436

[51] Int. Cl.[7] ..... G09G 3/36

[52] U.S. Cl. ..... 345/89; 345/96; 345/98; 345/100; 345/149

[58] Field of Search ..... 340/784, 793, 340/701, 703; 345/87, 89, 94, 95, 96, 98, 100, 147, 148, 149

[56] References Cited

U.S. PATENT DOCUMENTS

| | | | |
|---|---|---|---|
| 4,427,978 | 1/1984 | Williams | 340/784 |
| 4,427,979 | 1/1984 | Clerc et al. | 340/805 |
| 4,688,031 | 8/1987 | Haggerty | 340/793 |
| 4,779,083 | 10/1988 | Ishii et al. | 340/793 |
| 4,808,991 | 2/1989 | Tachiuchi et al. | 340/793 |
| 4,827,255 | 5/1989 | Ishii | 340/793 |
| 4,864,290 | 9/1989 | Waters | 340/793 |
| 5,041,823 | 8/1991 | Johnson et al. | 340/793 |
| 5,053,764 | 10/1991 | Barbier et al. | 340/793 |
| 5,122,783 | 6/1992 | Bassetti, Jr. | 340/793 |
| 5,185,602 | 2/1993 | Bassetti, Jr. et al. | 340/793 |
| 5,189,407 | 2/1993 | Mano et al. | 340/793 |
| 5,412,395 | 5/1995 | Maeda et al. . | |
| 5,488,387 | 1/1996 | Maeda et al. . | |

FOREIGN PATENT DOCUMENTS

| | | |
|---|---|---|
| 61-025194 | 4/1986 | Japan . |
| 62-195628 | 8/1987 | Japan . |
| 0217893 | 8/1990 | Japan . |
| 3-2722 | 1/1991 | Japan . |
| 3-20780 | 1/1991 | Japan . |

*Primary Examiner*—Steven J. Saras
*Attorney, Agent, or Firm*—Antonelli,Terry, Stout & Kraus, LLP

[57] ABSTRACT

A liquid-crystal display system includes a data driver, a scan driver, a liquid-crystal panel, a line memory (204 in FIG. 2) in which input display data (101) for representing any of display-ON, display-OFF and halftone every pixel are stored for, at least, one line, and a halftone pattern generator (200) by which liquid-crystal display data (106) to be applied to the data driver are generated using the contents of the line memory and the input display data. The halftone pattern generator generates ON data in response to the input display data representing the display-ON of the pixel; it generates OFF data in response to the input display data representing the display-OFF of the pixel; and it generates the ON data and the OFF data alternately in successive frames as half-tone data in response to the input display data representing the halftone display of the pixel, and it also compares the input display data of a pertinent line and those of a preceding line every line so as to invert a phase of changing-over the ON data and the OFF data in accordance with a result of the comparison. Since the number of ON pixels (or pixels for either of first and second data) for the halftone display is substantially equalized every frame, flickering can be reduced irrespective of display patterns.

17 Claims, 68 Drawing Sheets

| LATCH HEAD SIGNAL 1004 | FRAME SIGNAL 1006 | HALFTONE DATA 1013 |
|---|---|---|
| 1 (1ST LINE) | — | FRAME SIGNAL 1006 |
| 0 | 1 | HALFTONE SIGNAL 1002 |
| | 0 | INVERTED DATA 1017 OF HALFTONE DATA OF LAST FRAME |

FIG. 26

| TONE | LC DISPLAY DATA |
|---|---|
| TONE #0 | 000 |
| TONE #1 | 001 000 |
| TONE #2 | 001 |
| TONE #3 | 010 001 |
| TONE #4 | 010 |
| TONE #5 | 011 010 |
| TONE #6 | 011 |
| TONE #7 | 100 011 |
| TONE #8 | 100 |
| TONE #9 | 101 100 |
| TONE #10 | 101 |
| TONE #11 | 110 101 |
| TONE #12 | 110 |
| TONE #13 | 111 101 |
| TONE #14 | 111 110 |
| TONE #15 | 111 |

FIG. 29

SPECIFICATIONS OF LC PANEL

| ITEM | | SPECIFICATIONS |
|---|---|---|
| NUMBER OF PIXELS | | 640×480 dots |
| PIXEL PITCH | | 0.33mm×0.33mm |
| RESPONSE | RISE | 50 msec. |
| | FALL | 40 msec. |
| TRANSMISSION FACTOR | | 5% |
| NUMBER OF TONES(NUMBER OF COLORS) | | 8 TONES(512 COLORS) |
| FRAME FREQUENCY | | 70 Hz |

FLICKER LIMIT FORMULA $$|\log Ba - \log Bb| < 1.4 - 0.43 \log B$$

FIG. 33

FLICKERLESS 16-TONE SETTING TABLE

| TONE | DISPLAY MODE | APPLIED VOLTAGE | BRIGHTNESS |
|---|---|---|---|
| 0 | VOLTAGE | $V_0$ | 0.61 |
| 1 | FRC | $V_0$ $V_1$ | 1.16 |
| 2 | VOLTAGE | $V_1$ | 2.23 |
| 3 | FRC | $V_1$ $V_2$ | 3.83 |
| 4 | VOLTAGE | $V_2$ | 6.27 |
| 5 | FRC | $V_2$ $V_3$ | 9.45 |
| 6 | VOLTAGE | $V_3$ | 13.8 |
| 7 | FRC | $V_3$ $V_4$ | 19.2 |
| 8 | VOLTAGE | $V_4$ | 25.8 |
| 9 | FRC | $V_4$ $V_5$ | 34.5 |
| 10 | VOLTAGE | $V_5$ | 44.9 |
| 11 | FRC | $V_5$ $V_6$ | 58.1 |
| 12 | VOLTAGE | $V_6$ | 72.0 |
| 13 | FRC | $V_5$ $V_7$ | 79.3 |
| 14 | FRC | $V_6$ $V_7$ | 90.7 |
| 15 | VOLTAGE | $V_7$ | 97.6 |

APPLIED VOLTAGE:

$V_0 = 6.50$ [V]

$V_1 = 4.96$ [V]

$V_2 = 4.30$ [V]

$V_3 = 3.85$ [V]

$V_4 = 3.46$ [V]

$V_5 = 3.07$ [V]

$V_6 = 2.67$ [V]

$V_7 = 1.77$ [V]

FIG. 37

DECIDED SULTS OF FLICKER

| TONAL COMBINATION (PATTERN-BACKGROUND) | 1/2 IN LATERAL DIRECTION | | 1/4 IN LATERAL DIRECTION | | | 1/8 IN LATERAL DIRECTION | | | 1/16 IN LATERAL DIRECTION | | |
|---|---|---|---|---|---|---|---|---|---|---|---|
| | ZIGZAG | DOTTED LINE | ZIGZAG | DOTTED LINE | OBLIQUE LINE | ZIGZAG | DOTTED LINE | OBLIQUE LINE | ZIGZAG | DOTTED LINE | OBLIQUE LINE |
| 14−1<br>1−14 | 1<br>1 | 1<br>1 | 3<br>4 | 2<br>4 | 1<br>1 | 5<br>5 | 2<br>5 | 2<br>4 | 5<br>5 | 5<br>5 | 4<br>5 |
| 13−14<br>14−13 | 1<br>1 | 2<br>2 | 4<br>4 | 4<br>4 | 2<br>3 | 5<br>5 | 5<br>5 | 4<br>3 | 5<br>5 | 5<br>5 | 5<br>5 |
| 9−7<br>7−9 | 1<br>1 | 2<br>2 | 5<br>5 | 4<br>5 | 2<br>4 | 5<br>5 | 5<br>5 | 4<br>5 | 5<br>5 | 5<br>5 | 5<br>5 |
| 3−1<br>1−3 | 1<br>1 | 2<br>2 | 4<br>5 | 4<br>5 | 2<br>4 | 4<br>5 | 4<br>5 | 4<br>5 | 5<br>5 | 5<br>5 | 5<br>5 |
| 11−5<br>5−11 | 1<br>1 | 2<br>2 | 3<br>5 | 3<br>5 | 1<br>2 | 5<br>5 | 4<br>5 | 2<br>2 | 5<br>5 | 5<br>5 | 5<br>5 |
| 13−3<br>3−13 | 1<br>1 | 1<br>1 | 1<br>2 | 1<br>2 | 1<br>1 | 5<br>5 | 2<br>2 | 1<br>1 | 5<br>5 | 5<br>5 | 4<br>5 |
| DECISION | × | × | × | × | × | ○ | × | × | ○ | ○ | ○ |

5 : FLICKERLESS

⋮

1 : FLICKERING

FIG. 38
ZIGZAG DISPLAY OF 1/8
IN LATERAL DIRECTION
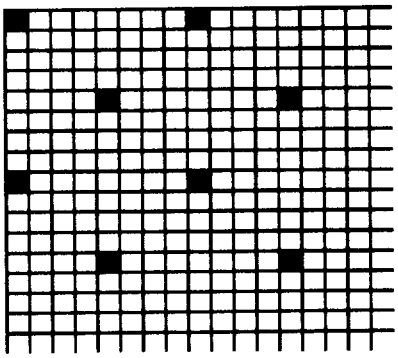
DOTTED LINE DISPLAY OF 1/16 DOT
IN LATERAL DIRECTION
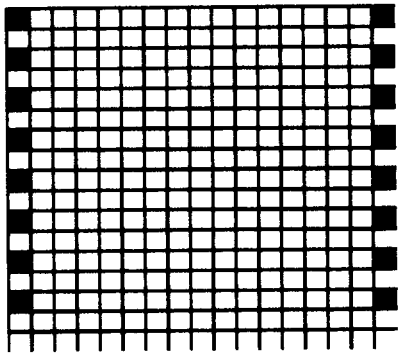
ZIGZAG DISPLAY OF 1/16
IN LATERAL DIRECTION
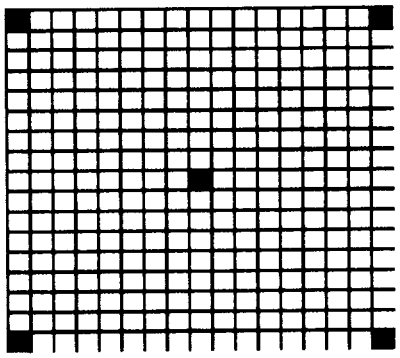
OBLIQUE LINE DISPLAY OF 1/16 DOT
IN LATERAL DIRECTION
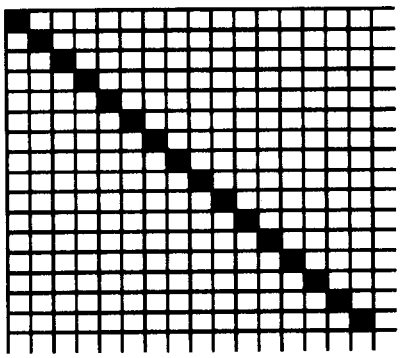

FIG. 44

WEIGHTING FOR RED COLOR

| RED COLOR DATA 4000 | LC DISPLAY DATA 4305 | |
|---|---|---|
| | OUTPUT OF FIRST DECODER 4300 | OUTPUT OF SECOND DECODER 4302 |
| 15 | 7 | 7 |
| 14 | 6 | 7 |
| 13 | 6 | 6 |
| 12 | 5 | 6 |
| 11 | 5 | 5 |
| 10 | 4 | 5 |
| 9 | 4 | 4 |
| 8 | 3 | 4 |
| 7 | 3 | 3 |
| 6 | 2 | 3 |
| 5 | 2 | 2 |
| 4 | 1 | 2 |
| 3 | 1 | 1 |
| 2 | 0 | 2 |
| 1 | 0 | 1 |
| 0 | 0 | 0 |

FIG. 45

WEIGHTING FOR GREEN COLOR

| GREEN COLOR DATA 4001 | LC DISPLAY DATA 4311 | |
|---|---|---|
| | OUTPUT OF FIRST DECODER 4306 | OUTPUT OF SECOND DECODER 4308 |
| 15 | 7 | 7 |
| 14 | 6 | 7 |
| 13 | 6 | 6 |
| 12 | 5 | 6 |
| 11 | 5 | 5 |
| 10 | 4 | 5 |
| 9 | 4 | 4 |
| 8 | 3 | 4 |
| 7 | 3 | 3 |
| 6 | 2 | 3 |
| 5 | 2 | 2 |
| 4 | 1 | 2 |
| 3 | 1 | 1 |
| 2 | 0 | 2 |
| 1 | 0 | 1 |
| 0 | 0 | 0 |

FIG. 46

WEIGHTING FOR BLUE COLOR

| BLUE COLOR DATA 4002 | LC DISPLAY DATA 4317 | |
|---|---|---|
| | OUTPUT OF FIRST DECODER 4312 | OUTPUT OF SECOND DECODER 4314 |
| 15 | 7 | 7 |
| 14 | 6 | 7 |
| 13 | 6 | 6 |
| 12 | 5 | 6 |
| 11 | 5 | 5 |
| 10 | 4 | 5 |
| 9 | 4 | 4 |
| 8 | 3 | 4 |
| 7 | 3 | 3 |
| 6 | 2 | 3 |
| 5 | 2 | 2 |
| 4 | 1 | 2 |
| 3 | 1 | 1 |
| 2 | 0 | 2 |
| 1 | 0 | 1 |
| 0 | 0 | 0 |

DISPLAY PATTERN

1ST, 3RD, 6TH OR 8TH FRAME

2ND, 4TH, 5TH OR 7TH FRAME

DISPLAY PATTERN

1ST FRAME

2ND FRAME

FIG. 55

OPERATION OF DECODER 5310

| INPUT 5307 FROM COUNTER 5306 | INPUT 5309 FROM COUNTER 5308 | SELECT SIGNAL 5311 | SELECT SIGNAL 5312 | SELECT SIGNAL 5313 |
|---|---|---|---|---|
| 0 | 0 | 0 | 2 | 0 |
| 0 | 1 | 2 | 0 | 2 |
| 1 | 0 | 3 | 1 | 3 |
| 1 | 1 | 1 | 3 | 1 |

FIG. 57

ANOTHER OPERATION OF DECODER 5310

| INPUT FROM COUNTER 5306 | INPUT FROM COUNTER 5308 | SELECT SIGNAL 5311 | SELECT SIGNAL 5312 | SELECT SIGNAL 5313 |
|---|---|---|---|---|
| 0 | 0 | 0 | 0 | 2 |
| 0 | 1 | 2 | 0 | 0 |
| 0 | 2 | 2 | 2 | 0 |
| 0 | 3 | 0 | 2 | 2 |
| 1 | 0 | 1 | 3 | 3 |
| 1 | 1 | 1 | 1 | 3 |
| 1 | 2 | 3 | 1 | 1 |
| 1 | 3 | 3 | 3 | 1 |
| 2 | 0 | 3 | 1 | 1 |
| 2 | 1 | 3 | 3 | 1 |
| 2 | 2 | 1 | 3 | 3 |
| 2 | 3 | 1 | 1 | 3 |
| 3 | 0 | 2 | 2 | 0 |
| 3 | 1 | 0 | 2 | 2 |
| 3 | 2 | 0 | 0 | 2 |
| 3 | 3 | 2 | 0 | 0 |

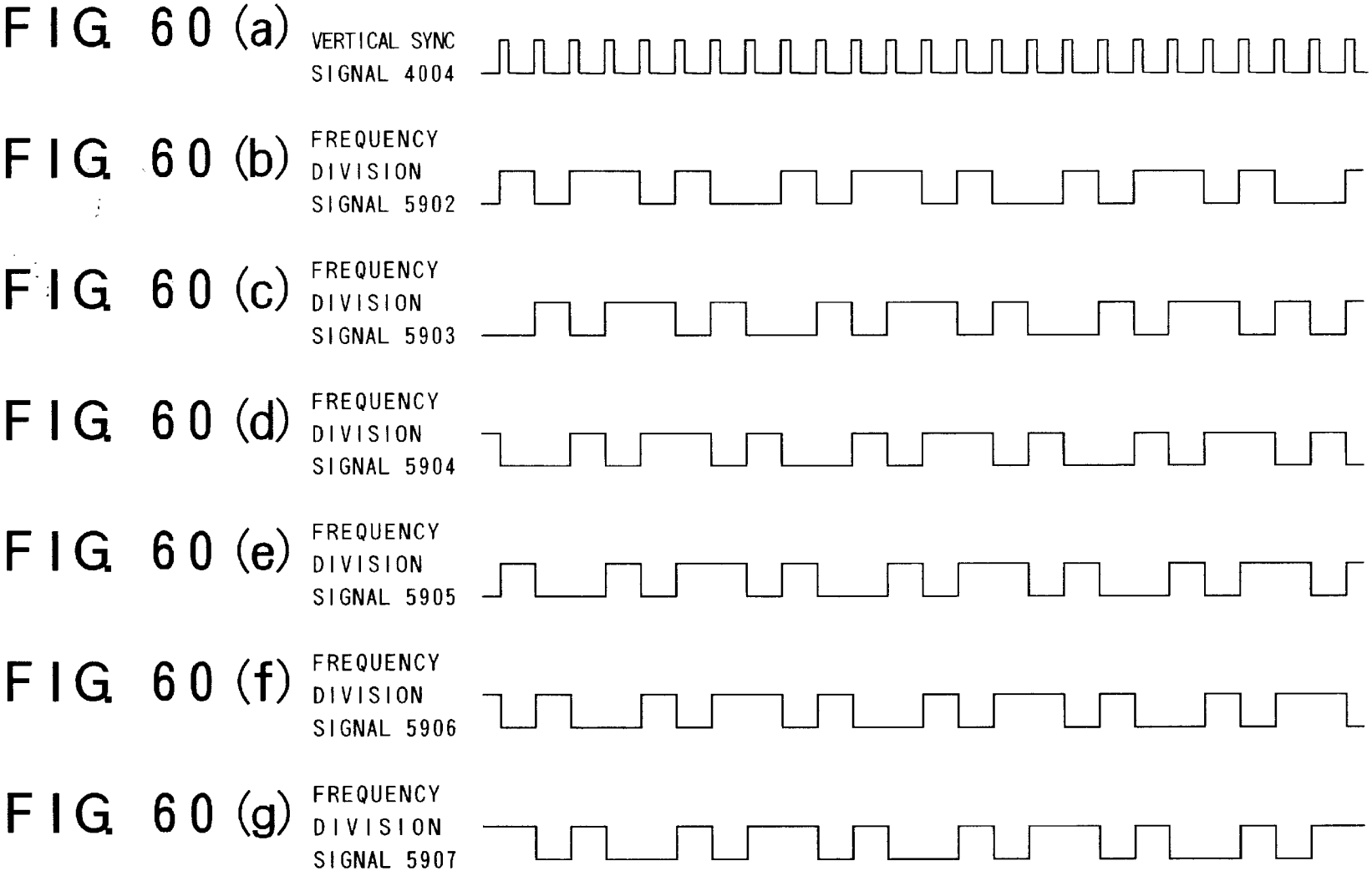
FIG 60 (a) VERTICAL SYNC SIGNAL 4004
FIG 60 (b) FREQUENCY DIVISION SIGNAL 5902
FIG 60 (c) FREQUENCY DIVISION SIGNAL 5903
FIG 60 (d) FREQUENCY DIVISION SIGNAL 5904
FIG 60 (e) FREQUENCY DIVISION SIGNAL 5905
FIG 60 (f) FREQUENCY DIVISION SIGNAL 5906
FIG 60 (g) FREQUENCY DIVISION SIGNAL 5907

FREQUENCY DIVISION SIGNAL 5908

FREQUENCY DIVISION SIGNAL 5909

LC ALTERNATING CLOCK 4012

FIG. 61 (a)

OUTPUT OF SELECT SIGNAL 5915

| | | INPUTS FROM COUNTER 5912 | | | | | | | |
|---|---|---|---|---|---|---|---|---|---|
| | | 0 | 1 | 2 | 3 | 4 | 5 | 6 | 7 |
| INPUTS FROM COUNTER 5910 | 0 | 1 | 4 | 7 | 2 | 5 | 0 | 3 | 6 |
| | 1 | 2 | 5 | 0 | 3 | 6 | 1 | 4 | 7 |
| | 2 | 3 | 6 | 1 | 4 | 7 | 2 | 5 | 0 |
| | 3 | 4 | 7 | 2 | 5 | 0 | 3 | 6 | 1 |
| | 4 | 5 | 0 | 3 | 6 | 1 | 4 | 7 | 2 |
| | 5 | 6 | 1 | 4 | 7 | 2 | 5 | 0 | 3 |
| | 6 | 7 | 2 | 5 | 0 | 3 | 6 | 1 | 4 |
| | 7 | 0 | 3 | 6 | 1 | 4 | 7 | 2 | 5 |

FIG. 61 (b)

OUTPUT OF SELECT SIGNAL 5915

| | | INPUTS FROM COUNTER 5912 | | | | | | | |
|---|---|---|---|---|---|---|---|---|---|
| | | 0 | 1 | 2 | 3 | 4 | 5 | 6 | 7 |
| INPUTS FROM COUNTER 5910 | 0 | 2 | 5 | 0 | 3 | 6 | 1 | 4 | 7 |
| | 1 | 3 | 6 | 1 | 4 | 7 | 2 | 5 | 0 |
| | 2 | 4 | 7 | 2 | 5 | 0 | 3 | 6 | 1 |
| | 3 | 5 | 0 | 3 | 6 | 1 | 4 | 7 | 2 |
| | 4 | 6 | 1 | 4 | 7 | 2 | 5 | 0 | 3 |
| | 5 | 7 | 2 | 5 | 0 | 3 | 6 | 1 | 4 |
| | 6 | 0 | 3 | 6 | 1 | 4 | 7 | 2 | 5 |
| | 7 | 1 | 4 | 7 | 2 | 5 | 0 | 3 | 6 |

FIG. 61 (c)

OUTPUT OF SELECT SIGNAL 5917

| | | INPUTS FROM COUNTER 5912 | | | | | | | |
|---|---|---|---|---|---|---|---|---|---|
| | | 0 | 1 | 2 | 3 | 4 | 5 | 6 | 7 |
| INPUTS FROM COUNTER 5910 | 0 | 3 | 6 | 1 | 4 | 7 | 2 | 5 | 0 |
| | 1 | 4 | 7 | 2 | 5 | 0 | 3 | 6 | 1 |
| | 2 | 5 | 0 | 3 | 6 | 1 | 4 | 7 | 2 |
| | 3 | 6 | 1 | 4 | 7 | 2 | 5 | 0 | 3 |
| | 4 | 7 | 2 | 5 | 0 | 3 | 6 | 1 | 4 |
| | 5 | 0 | 3 | 6 | 1 | 4 | 7 | 2 | 5 |
| | 6 | 1 | 4 | 7 | 2 | 5 | 0 | 3 | 6 |
| | 7 | 2 | 5 | 0 | 3 | 6 | 1 | 4 | 7 |

LIQUID-CRYSTAL HALFTONE DISPLAY SYSTEM

BACKGROUND OF THE INVENTION

1. Field of the Invention

The present invention relates to a liquid-crystal display system in which a halftone display is presented by applying two voltages to a pixel of a liquid-crystal display panel alternately in successive frames. More particularly, it relates to a liquid-crystal display system which is most suited to present a flickerless halftone display.

2. Related Art

Heretofore, a method of displaying halftone in a liquid-crystal display system has prevented flicker in such a way that the timing for alternately applying two voltages is different for adjacent lines, as stated in the official gazette of Japanese Patent Application Laid-open No. 195628/1987. With this method, however, when displaying a specified display pattern in which the halftone display is presented every second line by way of example, the effect of preventing the flicker using different timings as mentioned above will be canceled and so flicker is again incurred.

The prior-art technique will be described in detail with reference to FIGS. 63~65. In these figures, a black box represents "display-OFF", a hatched box a "halftone display", and a blank box "display-ON".

FIG. 63 is a diagram showing the display patterns of respective frames in the case where four illustrated lines are all displayed at a halftone level by the use of the prior art (hereinbelow, the patterns shall be called "halftone patterns"). Timings for bestowing the display-ON and the display-OFF states are made different for the adjacent lines in such a manner that the odd lines are in the display-OFF state in the odd frames and in the display-ON state in the even frames, whereas the even lines are in the display-ON state in the odd frames and the display-OFF state in the even frames. Thus, the halftone display is presented within a certain area (the four lines in FIG. 63).

FIG. 64 illustrates a display example being the condition which is perceived by the eye when respective frames are successively displayed on an actual display screen. Although the halftone display is presented for all the four lines in the example of FIG. 63, the halftone is displayed only every second line in this example of FIG. 64. FIG. 65 is a diagram showing the display patterns of the respective frames in the case of the display depicted in FIG. 64.

A liquid crystal displays the halftone between white (display-ON) and black (display-OFF) when repeatedly endowed with the display-ON and the display-OFF states alternately in successive frames. However, when adjacent lines are simultaneously in halftone display states, the repetition of display-ON and display-OFF of these lines at the same timings gives rise to flicker. As illustrated in FIG. 63, therefore, the timings are made different between the adjacent lines so as to prevent the liquid crystal display from flickering.

However, in such a case where the odd lines are set at the halftone display and the even lines at display-ON as shown in FIG. 64, the liquid crystal display flickers as seen from FIG. 65 illustrative of the display patterns of the respective frames. More specifically, in the odd frames, the odd lines are in the display-OFF state, and the even lines are in the display-ON state, while in the even frames, all the lines are in the display-ON state, so that only the odd lines repeatedly alternate between display-ON and display-OFF. The prior-art technique mentioned above does not take into consideration the flickering which is ascribable to the interference between the display pattern as shown in FIG. 64 and the timings for alternately applying the two voltages.

Incidentally, each of the official gazettes of Japanese Patent Applications Laid-open No. 2722/1991 and No. 20780/1991 discloses a method of driving a liquid-crystal display system wherein tone or grayscale display of different brightnesses in several steps is accomplished by setting a plurality of frames as one cycle and then ON-driving pixels over the number of frames, which corresponds to a grayscale level of display data, within the cycle. In this method, a plurality of adjacent pixels (for example, four pixels or eight pixels) are combined into one group, and the display data for stipulating a tone is designated in group units. Such a method, is intended to reduce the flickering of the displays. This technique, however, adopts a so-called areal modulation system designating a tone in plural-pixel unit and is not directly applicable to a system designating a tone (halftone) in single-pixel unit.

SUMMARY OF THE INVENTION

An object of the present invention is to provide a liquid-crystal display system which is not restricted to the areal modulation system, and which can present halftone displays with reduced flicker irrespective of display patterns.

A liquid-crystal halftone display system according to the present invention comprises a data driver which accepts liquid-crystal display data corresponding to input display data representing any of display-ON, display-OFF and halftone for every pixel, for one line, and which delivers the liquid-crystal display data for one line as horizontal display data; a scan driver which appoints a line for displaying the horizontal display data; a liquid-crystal panel which displays the horizontal display data as visible information; a line memory in which the input display data are stored for, at least, one line; and halftone display means for generating the liquid-crystal display data to be afforded to the data driver, by the use of the stored contents of the line memory and the input display data; the halftone display means generating ON data in response to the input display data which represents display-ON for a pixel; generating OFF data in response to the input display data which represents display-OFF for a pixel; and generating the ON data and the OFF data alternately in successive frames as halftone data in response to the input display data which represents halftone display for a pixel, and also comparing the input display data of a pertinent line and those of a preceding line for every line so as to invert a phase of changing-over the ON data and the OFF data in accordance with a result of the comparison.

Another liquid-crystal halftone display system according to the present invention comprises a data driver which accepts liquid-crystal display data corresponding to input display data, for one line, and which delivers the liquid-crystal display data for the one line as horizontal display data; a scan driver which appoints a line for displaying the horizontal display data; a liquid-crystal panel which displays the horizontal display data as visible information; and halftone data generation means provided in correspondence with each at least two of a plurality of tones expressed by the input display data, for delivering first data and second data as the liquid-crystal display data for one pixel alternately in successive frames, wherein a phase of changing-over the first data and the second data is made different for every pixel or for every plurality of pixels and for every line or every plurality of lines.

In operation, with the first liquid-crystal halftone display system of the present invention, the halftone display is presented using the liquid-crystal panel which is capable of ON/OFF (binary) control in pixel units. To this end, the input display data (requiring at least 2 bits per pixel) which represents any of display-ON, display-OFF and halftone states, is received for every pixel, thereby attaining a ternary display brightness per pixel. More specifically, in presenting the halftone display, the halftone display means generates the ON data for the input display data which represents the display-ON of the pixel, generates the OFF data for the input display data which represents display-OFF of the pixel, and generates the ON data and the OFF data alternately in successive frames as the halftone data, for the input display data which represents halftone display of the pixel. Moreover, regarding the halftone display pixel, the halftone display means compares the input display data of the pertinent line and those of the preceding line for every line so as to invert the phase of changing-over the ON data and the OFF data in accordance with the result of the comparison. The phase of changing-over the ON data and the OFF data includes two phases; the first phase in which the data are changed-over in the sequence ON, OFF, ON, OFF, . . . in successive frames with reference to a certain frame, and the second phase which differs 180 degrees from the first phase and in which the data are changed-over in the sequence OFF, ON, OFF, ON, . . . .

More specifically, a signal which repeats ON and OFF alternately for every frame is generated as a halftone reference signal in advance, and the first and second phases are obtained using the halftone reference signal as it is or the inverted signal of this halftone reference signal. As to each of the halftone pixels of the first line in the certain frame (assumed to be, for example, an odd frame), the ON or OFF data is generated in accordance with the phase of the halftone reference signal on that occasion. As to the halftone pixels of the second line et seq. in the same frame, the data of the preceding line are, in principle, inverted. By way of example, when the halftone pixel of the preceding line is ON, the halftone pixel of the pertinent line is turned OFF. Thus, the phases at both the lines become different. In a predetermined case, however, the inversion of the data is inhibited. By way of example, the dot positions and number of the halftone pixels at the pertinent line are compared with those at the preceding line. Then, when the number of those halftone pixels of the pertinent line which differ in the dot positions from the halftone pixels of the preceding line is greater than a predetermined number, the inversion is inhibited. In an even frame, the inverted data of the data of the same lines in the preceding frame are used as the data of the halftone pixels. By way of example, when the halftone data of the same line is OFF in the preceding frame, it is turned ON in the current frame. Incidentally, the phase of the ON/OFF change-over may be made different for the adjacent halftone pixels within one line in such a way that a group of pixels (for example, every other pixels on the line) for which the phase is fixed or unchanged are previously determined on the basis of the dot positions within the line.

In this manner, in the liquid-crystal display control which can appoint the halftone in pixel units, the ON and OFF states are repeated alternately in the successive frames at each of the halftone pixels, and the ON/OFF phases are determined by reference to the display states of the halftone pixels of the preceding line. Accordingly, the ON display states for the halftone display states are prevented from being concentrated in either the even frame or the odd frame, and the liquid-crystal panel is prevented from flickering depending on the display patterns.

With another liquid-crystal halftone display system of the present invention, the halftone display is presented using the liquid-crystal panel which is capable of multiple-valued control in pixel units. When the liquid-crystal pixel is subjected to the multiple-valued control in accordance with the liquid-crystal display data which consists of a plurality of bits per pixel, a ternary or more multiple-valued tone is attained for each pixel. In order to enlarge the number of such tones, the first data and the second data are output alternately in the successive frames as the liquid-crystal display data corresponding to one pixel. In this regard, the halftone display system is characterized in that the phase of changing-over the first data and the second data is made different for every pixel or for every plurality of pixels and for every line or every plurality of lines.

Also in this case, as will be described later, various measures are taken in order that the first and second data for the halftone display in the individual frames may disperse substantially uniformly. Moreover, regarding the relationship between the halftone display and so-called liquid-crystal alternation for an applied liquid-crystal voltage, various expedients are offered from the viewpoint of reducing flicker.

The present invention is applicable, not only to a monochromatic display, but also to a color display, and can realize a flickerless halftone display.

BRIEF DESCRIPTION OF THE DRAWINGS

FIG. 26 is a table of individual-tone display data in the second embodiment;

FIG. 29 is a table for exemplifying the specifications of a liquid-crystal panel employed in the embodiment;

FIG. 33 is a table for setting flickerless 16 tones in the third embodiment;

FIG. 37 is a diagram for explaining the decided results of the flicker in the fourth embodiment;

FIG. 38 is a diagram for explaining flickerless display patterns in the fourth embodiment;

FIG. 44 is a table of weighting for a red color in the fifth embodiment of the present invention;

FIG. 45 is a table of weighting for a green color in the fifth embodiment;

FIG. 46 is a table of weighting for a blue color in the fifth embodiment;

FIG. 55 is a table showing the operation of a decoder in the seventh embodiment;

FIG. 57 is a table showing another operation of the decoder;

FIGS. 61(*a*) thru 61(*c*) are diagrams showing the operation of the decoder;

DETAILED DESCRIPTION OF THE PREFERRED EMBODIMENTS

In the ensuing description of embodiments, the mode of operation which realizes multiple-tone (or polytonal) displays in such a way that voltages to be applied to a liquid crystal in pixel units are changed-over in successive frames, thereby apparently attaining the intermediate brightness between brightnesses corresponding to the applied voltages, shall be called the "FRC (Frame Rate Control) mode". First, the principle of the FRC mode will be elucidated.

Figure 27:
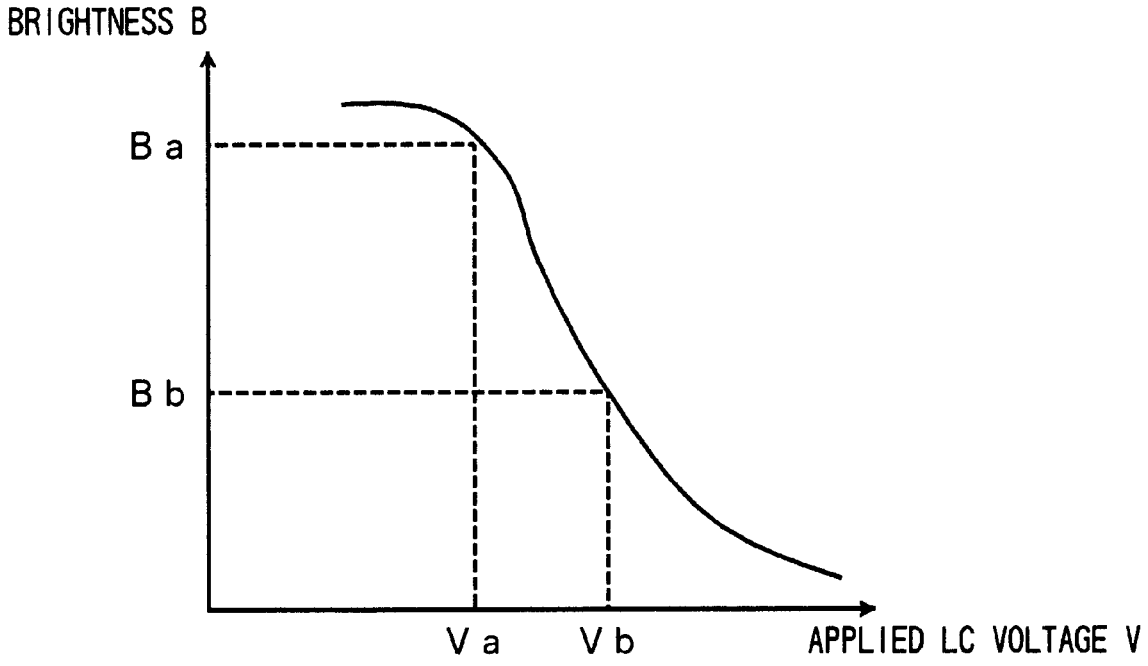
FIG. 27 is a graph showing the brightness-versus-applied voltage characteristic of a liquid crystal.

FIG. 27 is a graph of the typical characteristic of a liquid crystal between an applied voltage and a brightness attained in correspondence therewith. The liquid crystal mentioned in FIG. 27 is a so-called "normally-white liquid crystal" which exhibits the maximum brightness (that is, which brightens) when the voltage applied to the liquid crystal is null, and whose brightness lowers (that is, which darkens) as the voltage applied to the liquid crystal is increased. As seen from the characteristic curve shown in FIG. 27, when the applied voltage to such a liquid crystal is Va, a brightness Ba is exhibited. Further, when a voltage Vb greater than the applied voltage Va (Vb>Va) is applied, a lower brightness Bb (Bb<Ba) is exhibited. The FRC mode realizes the multiple-tone display (a halftone display) in the way that the applied LC (liquid crystal) voltages Va and Vb are alternately afforded in successive frames, thereby apparently attaining the intermediate brightness B between the brightnesses Ba and Bb which are respectively exhibited when the voltages Va and Vb are applied alone.

Figure 1:
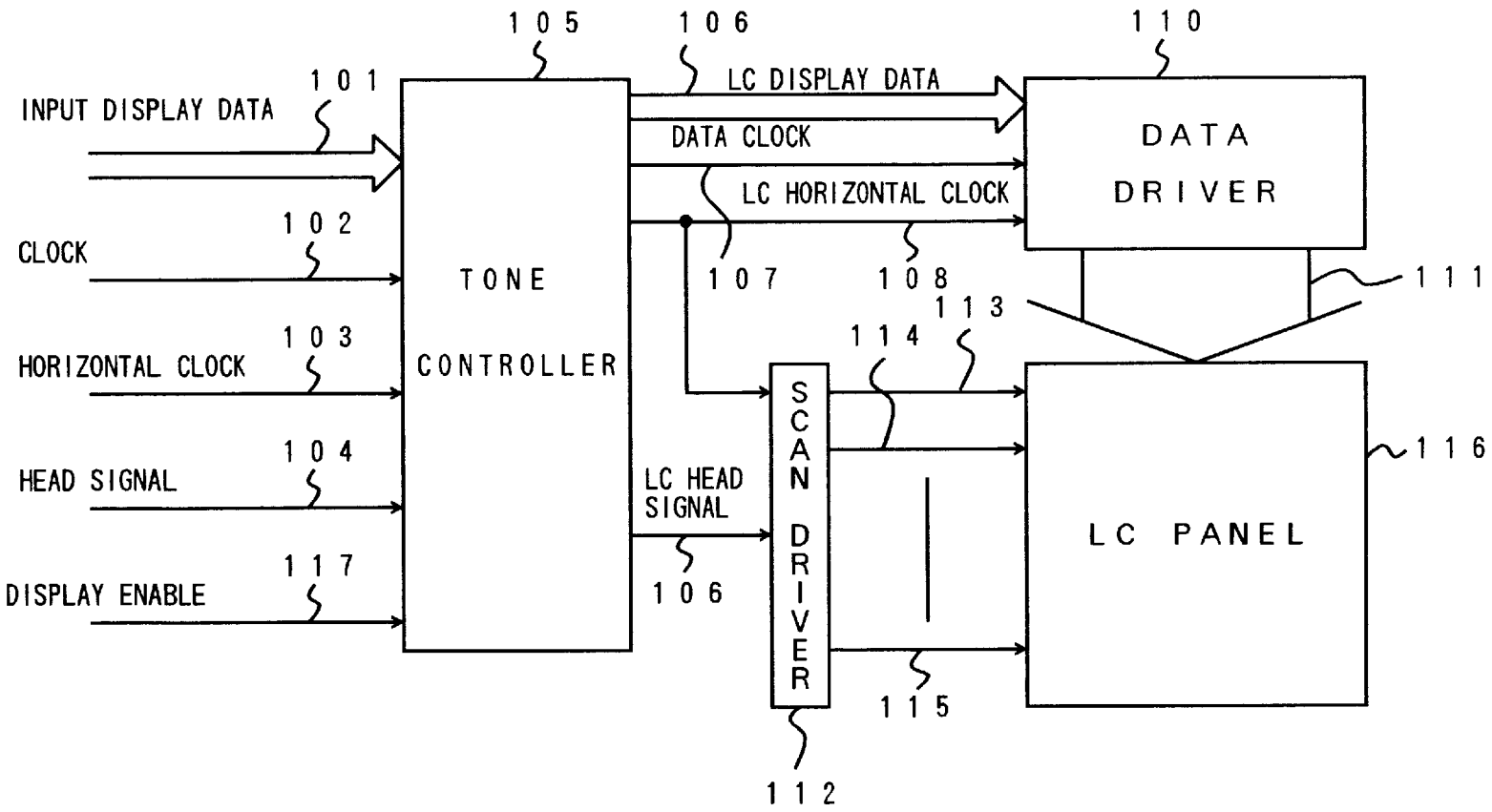
FIG. 1 is a block diagram of a liquid-crystal halftone display system which is an embodiment of the present invention.

Now, FIG. 1 shows a block diagram of an embodiment of a halftone display system to which the present invention is applied. This embodiment consists in, using a line memory which stores therein display data at the last or previous horizontal line (also, simply termed "line"), to generate halftone data on the basis of the distributions of halftone dots in the display data of a current line and those of the last line.

The halftone display system is constructed having a tone controller 105, a data driver 110, a scan driver 112, and an active matrix type liquid-crystal (LC) panel 116. Input display data 101 are supplied to the tone controller 105 in synchronism with a clock 102 as 4 parallel dots which correspond to 4 pixels. Each of the dots of the input display data 101 is composed of 2 bits, of which (0, 0) represents "display-OFF", (1, 1) represents "display-ON" and (0, 1) represents a halftone display. A horizontal clock 103 stipulates one cycle (one horizontal period), within which display data for one horizontal line are input. A head signal 104 indicates the head line of display data for one frame, and the display data for one frame are input in one cycle of this signal 104. For the sake of convenience, this embodiment will be described below, assuming one horizontal line to consist of 16 dots and one frame to consist of 8 lines. A display enable signal 117 indicates valid data from among data sent in within one horizontal period, when it is at logic "1". Upon receiving the signals 101~104 and 117, the tone controller 105 converts the input display data 101 so as to deliver "1" for the display-ON, to deliver "0" for the display-OFF, and to deliver "1" and "0" alternately in successive frames for the halftone. Such output data are liquid-crystal (LC) display data 106 of 4 dots. In addition, the tone controller 105 generates a data clock 107, a liquid-crystal (LC) horizontal clock 108 and a liquid-crystal (LC) head signal 109 in conformity with the skew of the conversion of the display data, respectively. After having accepted the LC display data 106 for one line in accordance with the data clock 107, the data driver 110 delivers the accepted data as liquid-crystal (LC) horizontal data 111 in synchronism with the LC horizontal clock 108. Accordingly, the data driver 110 delivers the LC horizontal data 111 at the last line directly preceding a line at which LC display data 106 are being accepted in accordance with the data clock 107. The scan driver 112 appoints that line of the frame at which the LC horizontal data 111 delivered from the data driver 110 are to be displayed. In the illustration, the outputs 113, 114 and 115 of the scan driver 112 correspond to the first scan line, second scan line and eighth scan line, respectively. The LC panel 116 is set at a resolution of 16 dots in the horizontal direction thereof and 8 lines in the vertical direction thereof in conformity with the organization of the display data assumed before.

In more detail, the data driver 110 accepts the LC display data 106 of 4 dots for one horizontal line of 16 dots successively in accordance with the data clock 107, and it latches the accepted data for one horizontal line and also delivers them as the LC horizontal data 111 in accordance with the LC horizontal clock 108. The scan driver 112 accepts the LC head signal 109 and sets the first scan line 113 to "1" in accordance with the LC horizontal clock 108, whereby the LC horizontal data 111 delivered from the data driver 110 are displayed on the first line of the LC panel 116. While delivering the LC horizontal data 111 of the first line, the data driver 110 accepts the LC display data 106 of the second line in accordance with the data clock 107, so that it delivers the data of the second line as the LC horizontal line 111 in accordance with the next cycle of the LC horizontal clock 108. At the same time, the scan driver 112 shifts "1" from the first scan line 113 to the second scan line 114 in accordance with the LC horizontal clock 108, so that the LC horizontal data 111 of the second line are displayed on the second line of the LC panel 116. Such operations are repeated in succession down to the eighth line, whereby one frame is displayed. The display of, e. g., a personal computer is realized by repeating the display operation of one frame as described above. The tone controller 105 receives the input display data 101, clock 102, horizontal clock 103, head signal 104 and display enable signal 117, and it generates the LC display data 106, data clock 107, LC horizontal clock 108 and LC head signal 109. Especially, in a case where the input display data 101 of a certain dot represents the halftone display, the tone controller 105 operates to subject the dot to display-ON and display-OFF alternately in successive frames.

Figure 2:
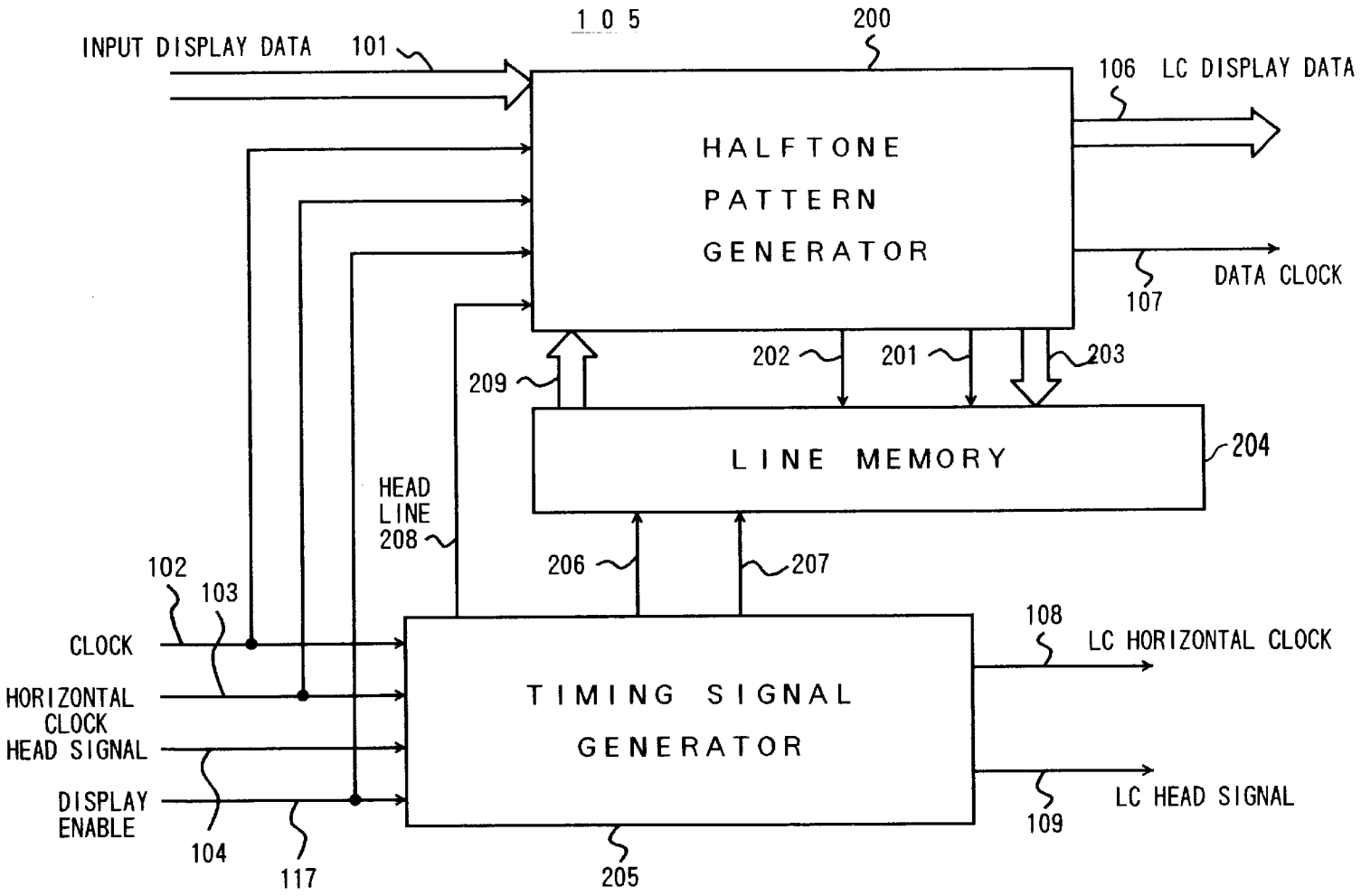
FIG. 2 is a block diagram of an example of a tone controller illustrated in FIG. 1.

FIG. 2 shows an example of the arrangement of the tone controller 105. This tone controller 105 is constructed of a halftone pattern generator 200, a timing signal generator 205 and a line memory 204. The timing signal generator 205 receives the clock 102, the horizontal clock 103, the head signal 104 and the display enable signal 117, and it generates a read reset signal 206, a read clock 207, a head line signal 208, the LC horizontal clock 108 and the LC head signal 109. The line memory 204 stores therein display data corresponding to one horizontal line. More specifically, the line memory 204 is supplied with a write reset signal 201, a write clock 202 and write data 203 from the halftone pattern generator 200. The head of the line memory 204 is appointed by the write reset signal 201. Subsequently, the write data 203 are written into the line memory 204 from the head thereof in the order of addresses in synchronism with the write clock 202. The data for one line thus written have the head of the addresses appointed by the read reset signal 206. Subsequently, the data are read out from the head data thereof successively for every 4 dots in synchronism with the read clock 207, thereby being converted into read data 209. The halftone pattern generator 200 receives the input display data 101, read data 209, clock 102, horizontal clock 103 and display enable signal 117, and it generates a halftone pattern for the halftone display data so as to deliver this pattern as the LC display data 106. At the same time, it delivers the data clock 107.

Figure 3:
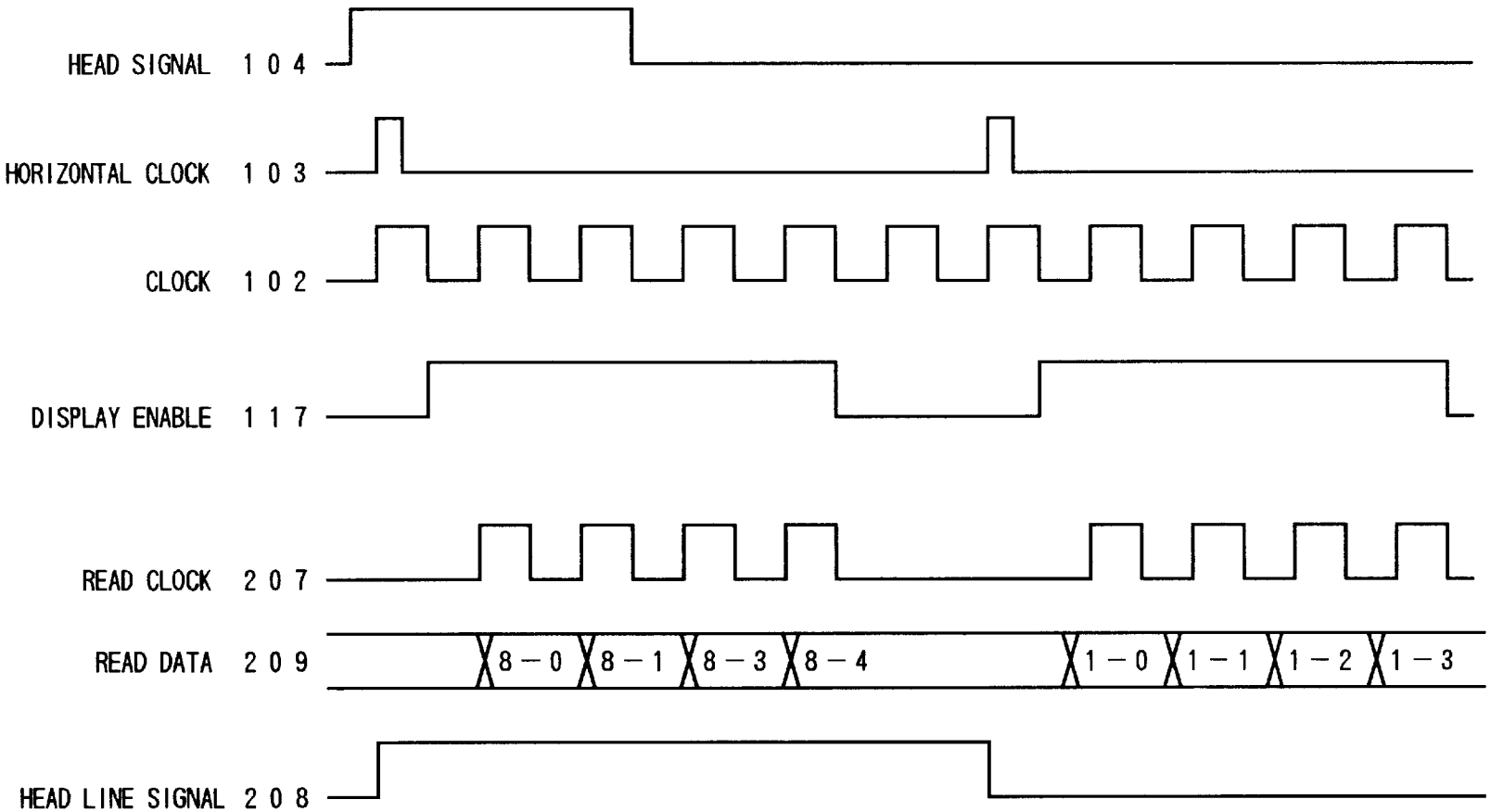
FIG. 3 is a timing chart showing the operation of a timing signal generator illustrated in FIG. 2.

As illustrated in FIG. 3, the timing signal generator 205 in FIG. 2 accepts the head signal 104 in accordance with the horizontal clock 103, thereby generating the head line signal 208. This head line signal 208 being at logic "1" indicates that the display data of the first line are being input as the input display data 101. The read clock 207 corresponds to the clock 102 when the display enable signal 117 is at "1". The read reset signal 206 used here is the directly supplied horizontal clock 103. As seen from the read data 209 in FIG. 3, accordingly, the data of the eighth line, being the last line, are read out of the line memory 204 in one horizontal period during which the head line signal 208 is at "1", and the data of the first line are read out in the succeeding horizontal period. That is, the read data 209 fetched are the input display data 101 of the directly preceding line. In addition, the timing signal generator 205 delivers the u modified horizontal clock 103, as the LC horizontal clock 108. Also, it generates the LC head signal 109 in such a way that, as will be described later, the head signal 104 is latched by the leading edge of the pulse of the horizontal clock 103 and is thereafter shifted by the leading edges of the pulses of the horizontal clock 103 by the use of two latching stages.

Figure 4:
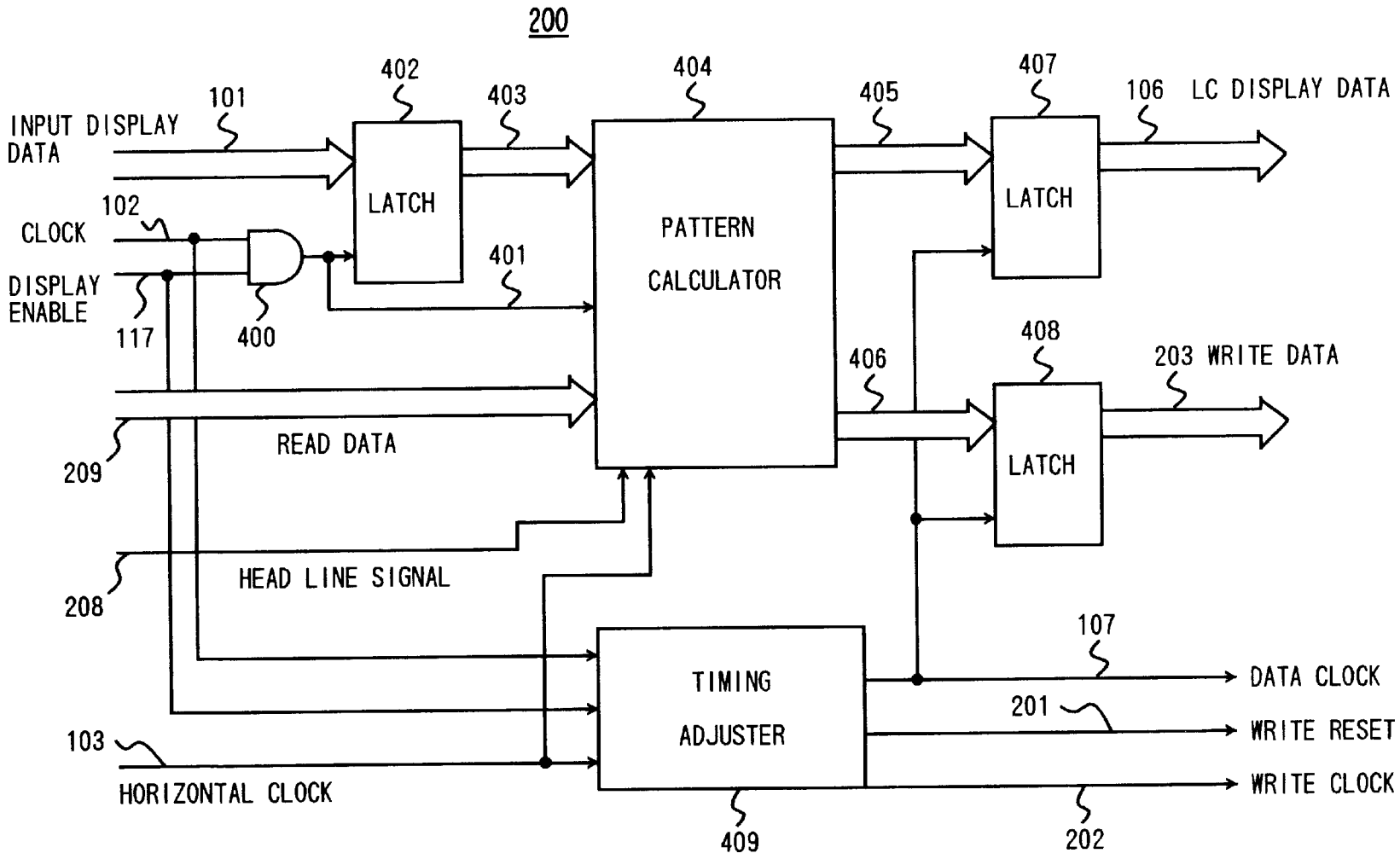
FIG. 4 is a block diagram of an example of a halftone pattern generator illustrated in FIG. 2.
Figure 5:
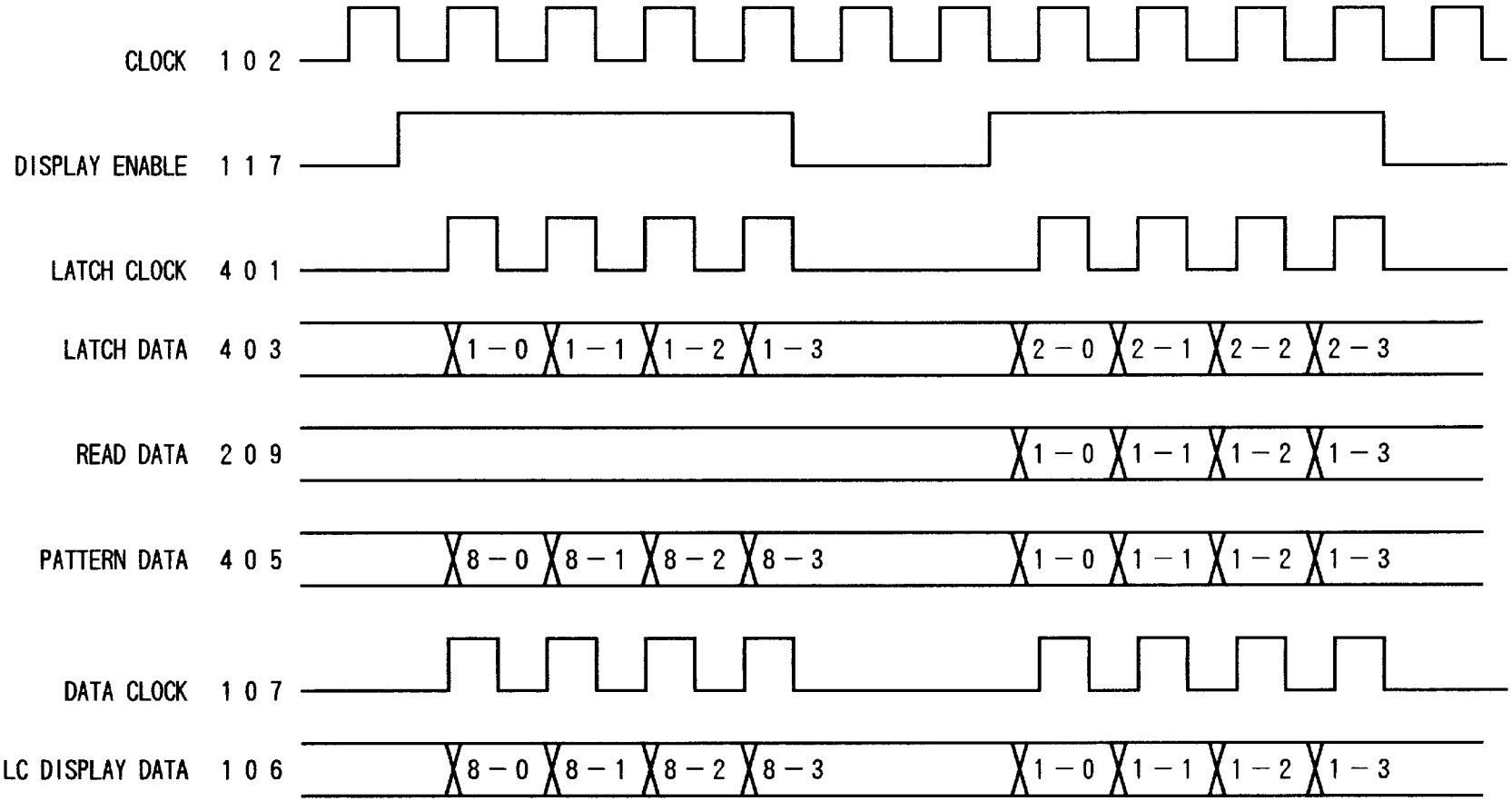
FIG. 5 is a timing chart showing the operation of the halftone pattern generator illustrated in FIG. 4.

FIG. 4 is a block diagram of an example of the arrangement of the halftone pattern generator 200 shown in FIG. 2. This halftone pattern generator 200 is configured of an AND circuit 400, a latch 402, a pattern calculator 404, latches 407 and 408, and a timing adjuster 409. The AND circuit 400 delivers the AND output of the clock 102 and the display enable signal 117, as a latch clock 401. The latch clock 401 is connected to the latch 402 and the pattern calculator 404. The latch 402 latches the input display data 101 in accordance with the latch clock 401. As illustrated in FIG. 5, the latch 402 delivers 16 dots for one horizontal line as latch data 403 in one horizontal period, four dots of the 16 dots being output with each of the four latch clock 401 leading edges. The latch data 403 are input to the pattern calculator 404. Then, the pattern calculator 404 generates the halftone pattern on the basis of the latch data 403 and the read data 209 of the last line or the directly preceding line and delivers the generated pattern as pattern data 405. The pattern data 405 becomes the halftone pattern in a case where the content of each of the 4 dots of the read data 209 indicates the halftone, it becomes "1" in a case where the same indicates the display-ON, and it becomes "0" in a case where the same indicates the display-OFF. In addition, the pattern calculator 404 delivers the latch data 403 left intact, as line memory data 406. The latches 407 and 408 latch the pattern data 405 and the line memory data 406 and deliver them as the LC display data 106 to the data driver 110 and the write data 203 to the line memory 204, respectively. The timing adjuster 409 receives the clock 102, display enable signal 117 and horizontal clock 103, and it generates the data clock 107, write reset signal 201 and write clock 202. More specifically, the timing adjuster 409 takes the clock 102 and the display enable signal 117 shifted by one clock cycle by the clock 102, and delivers the AND output as the data clock 107. Besides, it delivers the clock 102 as the write clock 202 and the horizontal clock 103 left intact, as the write reset signal 201. The operation of the halftone pattern generator 200 is as illustrated in the timing chart of FIG. 5.

The line memory data 406 are latched in the latch 408 and are delivered as the write data 203 in accordance with the data clock 107. The write data 203 are written into the line memory 204 (FIG. 2) in accordance with the same write clock 202 as the data clock 107. In the write operation, the data for one horizontal line are written successively every 4 dots because the line memory 204 has its write position returned to its head position in accordance with the write reset signal 201.

Figure 6:
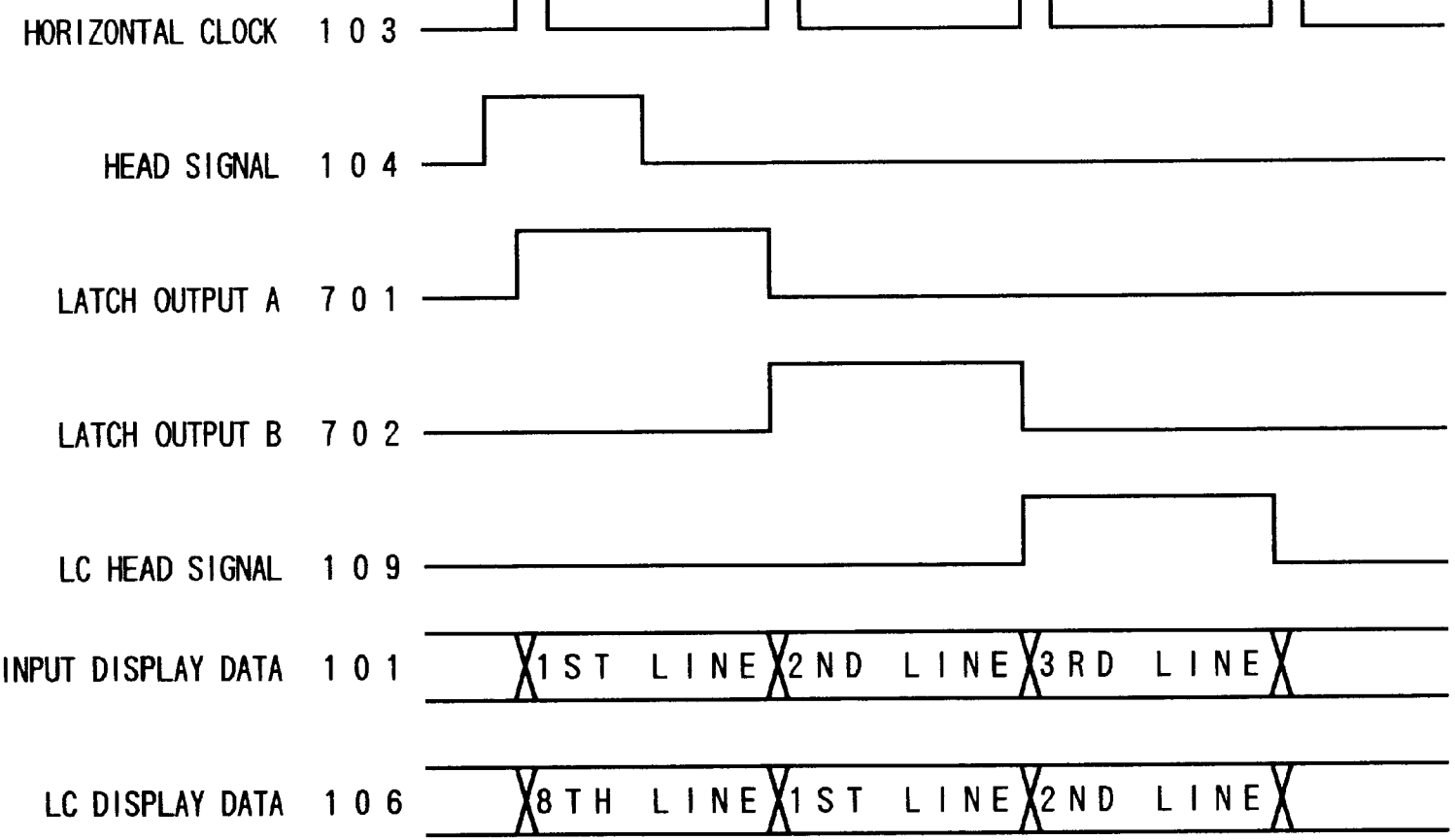
FIG. 6 is a timing chart for explaining the generation of a liquid-crystal head signal.

As illustrated in FIG. 6, accordingly, when the LC display data 106 of the second line are being output, the LC head signal 109 becomes "1", and the scan driver 112 latches the "1" signal in accordance with the trailing edge of the pulse of the LC horizontal clock 108. Consequently, the scan driver 112 holds the first scan line 113 at "1" while the LC display data 106 are at the second line, that is, while the data driver 110 is delivering the LC horizontal data 111 of the first line. Owing to the operations thus far described, the liquid-crystal halftone display system illustrated in FIG. 1 can realize flickerless halftone displays irrespective of display patterns, in such a way that the display data of 4 dots each being composed of 2 bits are stored temporality in the line memory 204, whereupon "1" is delivered for the display-ON as the LC display data 106, "0" is delivered for the display-OFF as the LC display data 106, and the display data is calculated for the halftone display so as to deliver the resulting halftone pattern as the LC display data 106.

Figure 7:
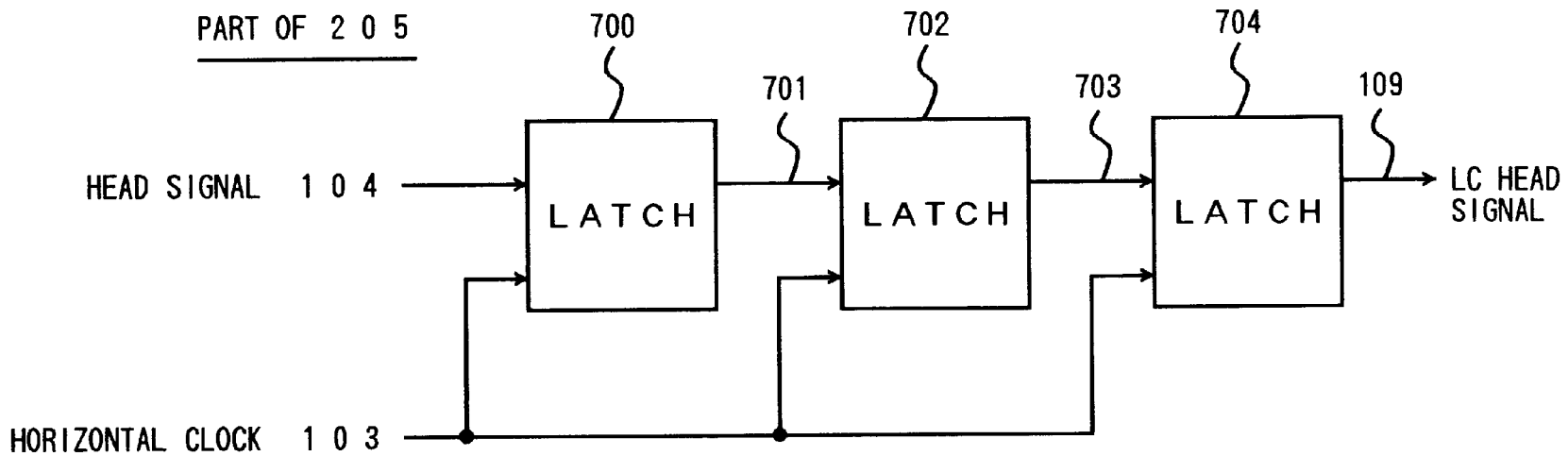
FIG. 7 is a block diagram of an example of a liquid-crystal head signal generator.

FIG. 7 illustrates an example of the arrangement of that portion of the timing signal generator 205 shown in FIG. 2 which generates the LC head signal 109. This portion is a circuit arrangement which is configured of three latches 700, 702 and 704 connected in series, and in which the head signal 104 is shifted successively in synchronism with the horizontal clock 103 and then delivered as the LC head signal 109. The timing of the generation of the LC head signal 109 by the timing signal generator 205 is as illustrated in FIG. 6.

Figure 8:
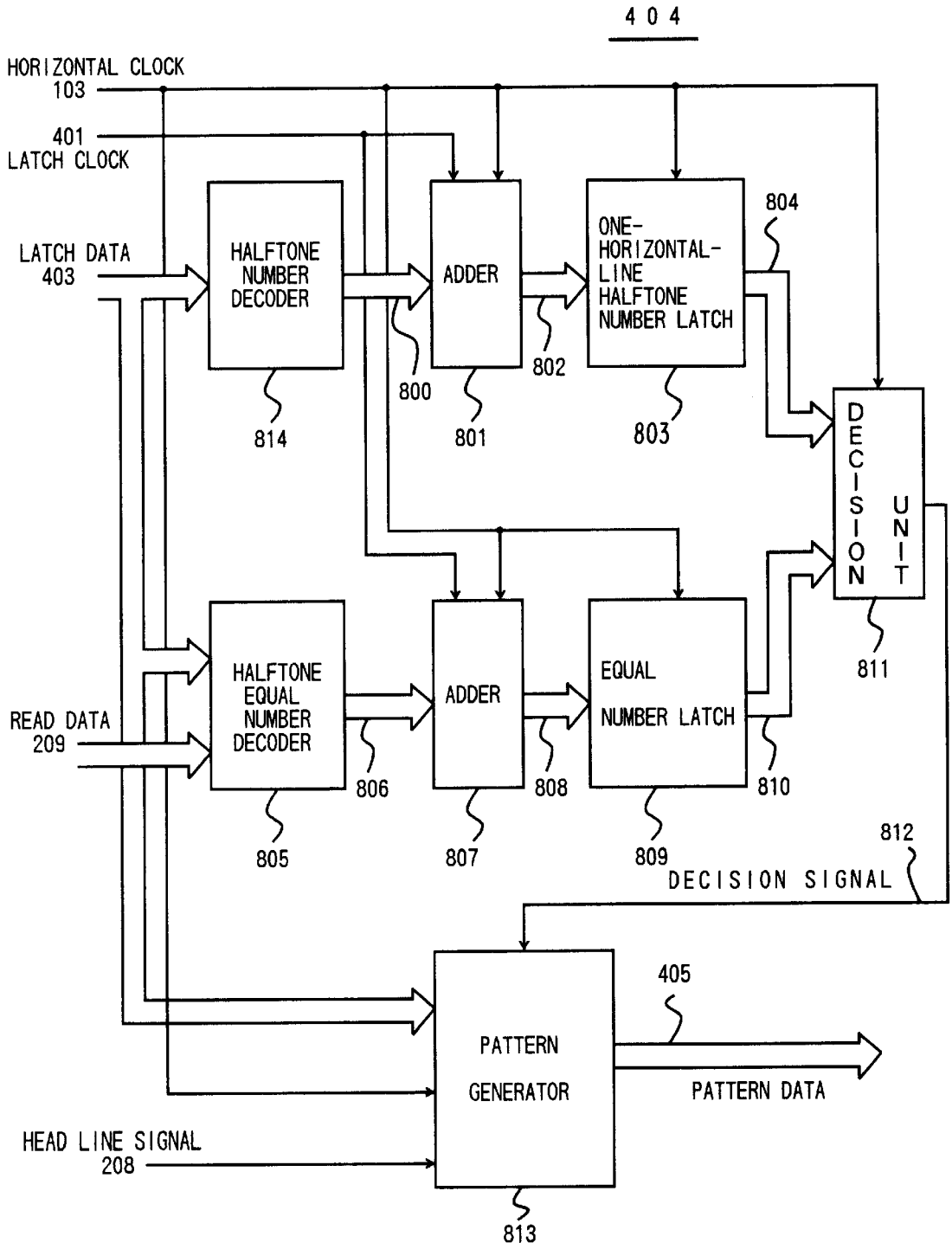
FIG. 8 is a block diagram of an example of a pattern calculator illustrated in FIG. 4.

FIG. 8 is a block diagram of an example of the arrangement of the pattern calculator 404 shown in FIG. 4. A halftone number decoder 814 decodes the number of dots to present halftone displays, in the input display data 101 of 4 dots, and it delivers the decoded number as a halftone number 800. An adder 801 is reset to "0" by the horizontal clock 103. Thereafter, it adds the halftone numbers 800 successively and delivers the resulting sum as a one-horizontal-line halftone number 802 in accordance with the latch clock 401. A one-horizontal-line halftone number latch 803 latches the one-horizontal-line halftone number 802 and delivers the latched number as a decision halftone number 804 in accordance with the horizontal clock 103. On the other hand, a halftone equal number decoder 805 decodes the number of the halftone display dots being presented at the same dot positions between 4 dots of the latch data 403 (the input display data 101) and 4 dots of the read data 209 from the previous line, and it delivers the decoded number as an equal number 806. An adder 807 is reset to "0" by the horizontal clock 103. Thereafter, it adds the equal numbers 806 successively and delivers the resulting sum as a one-horizontal-line equal number 808 in accordance with the latch clock 401. An equal number latch 809 latches the one-horizontal-line equal number 808 and delivers the latched number as a decision equal number 810 in accordance with the horizontal clock 103. A decision unit 811 compares the decision halftone number 804 with the decision equal number 810. In a case where the decision halftone number 804 is greater than or equal to a value obtained by adding a stipulated or predetermined number to the decision equal number 810 (that is, in a case where a value obtained by subtracting the decision equal number 810 from the decision halftone number 804 is greater than or equal to the stipulated number), the decision unit 811 sets a decision signal 812 to "0". In contrast, in a case where the decision halftone number 804 is smaller than the aforementioned value obtained by the addition, the decision unit 811 sets the decision signal 812 to "1". In this embodiment, the stipulated number is set at "4". As to each of the 4 dots of the latch data 403 (the input display data 101), a pattern generator 813 delivers "0" for the display-OFF, delivers "1" for the display-ON, and converts the halftone display into halftone data ("1" or "0") conforming to the decision signal 812 and delivers the halftone data as the pattern data 405.

The function of the stipulated number will be explained. Since the decision halftone number 804 is the number of the dots of the halftone displays within the current horizontal line, the minimum value thereof is "0" (no halftone display dot exists), and the maximum value thereof is "16" (all the dots of one horizontal line are halftone display dots). Besides, since the decision equal number 810 is the number in which the halftone display dots of the current horizontal line and those of the last or preceding horizontal line coincide, the minimum value thereof is "0" (the halftone display dots of the current and last horizontal lines do not coincide at all), and the maximum value thereof is "16" (all of the dots of the current and last horizontal lines are halftone display dots). Further, the following relationship holds true without fail:

(Decision halftone number 804)≧(Decision equal number 810)

The difference Δ between both the numbers represents the number of those halftone dots among the dots for one line of the latch data 403 whose dot positions differ from the dot positions of the halftone dots of the last line. This difference Δ being great signifies that, at the current line, the number of the halftone dots differing in the dot positions from the halftone dots of the last line is large. The stipulated number is a reference numerical value for setting the decision signal 812 to either "0" or "1". When the difference Δ is greater than or equal to the stipulated number, the decision signal 812 is set to "0". As will be described later in conjunction with FIGS. 10(*a*) and 10(*b*), the decision signal 812 serves as a signal for determining whether or not the halftone data at the second line et seq. are inverted with respect to the halftone data of the preceding lines. Therefore, as the stipulated number is made larger, the difference Δ is less liable to exceed the stipulated number, and the decision signal 812 is more liable to become "1". That is, the halftone data become more liable to be inverted every line. The values which the stipulated number can take, are in a range of 0 to 16 inclusive. In this embodiment, the value of the stipulated number is assumed to be "4".

Figure 9:
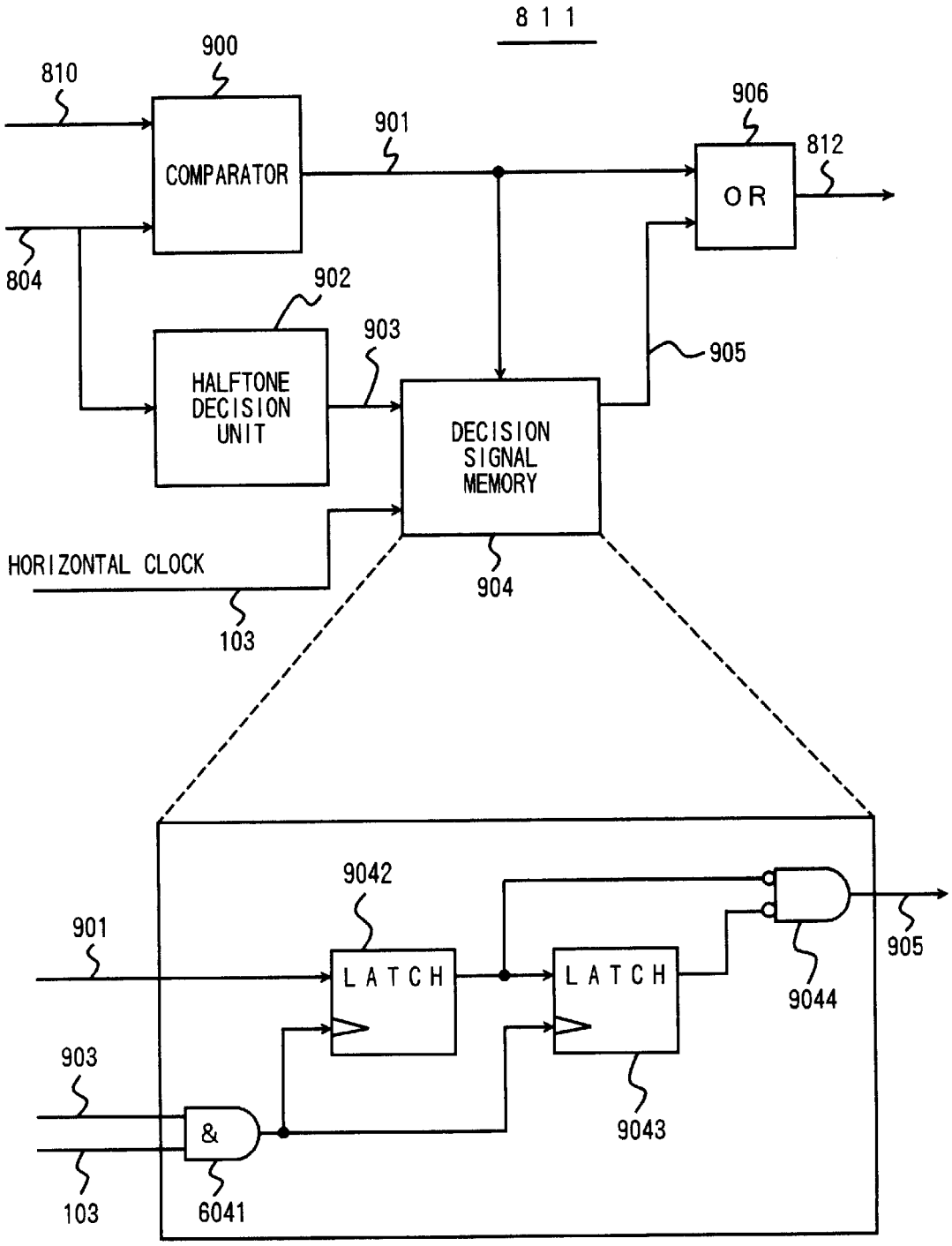
FIG. 9 is a block diagram of an example of a decision unit illustrated in FIG. 8.

FIG. 9 is a block diagram of an example of the arrangement of the decision unit 811. A comparator 900 decides whether or not the difference Δ between the decision halftone number 804 and the decision equal number 810 is, at least, equal to "4". When the difference Δ is, at least, equal to "4", a comparison signal 901 is set to "0", and when not, the comparison signal 901 is set to "1". A halftone decision unit 902 sets a halftone signal 903 to "0" when the decision halftone number 804 is "0", and to "1" when not. A decision signal memory 904 stores therein the comparison signals 901 for 2 lines at each of which the halftone display exists to bring the halftone signal 903 to "1", in accordance with the horizontal clock 103. In a case where the stored results of the 2 lines are "0's", the memory 904 sets a designation signal 905 to "1". That is, in a case where the decision signals 901 for the lines at which the halftone displays exist are "0's" at the 2 successive lines, the decision signal 812 is set to "1". As shown on an enlarged scale, the internal arrangement of the decision signal memory 904 includes an AND circuit 9041, latches 9042 and 9043, and a NOR circuit 9044. An OR circuit 906 brings the decision signal 812 to "1" when at least either of the comparison signal 901 and the designation signal 905 is "1".

Figure 10:
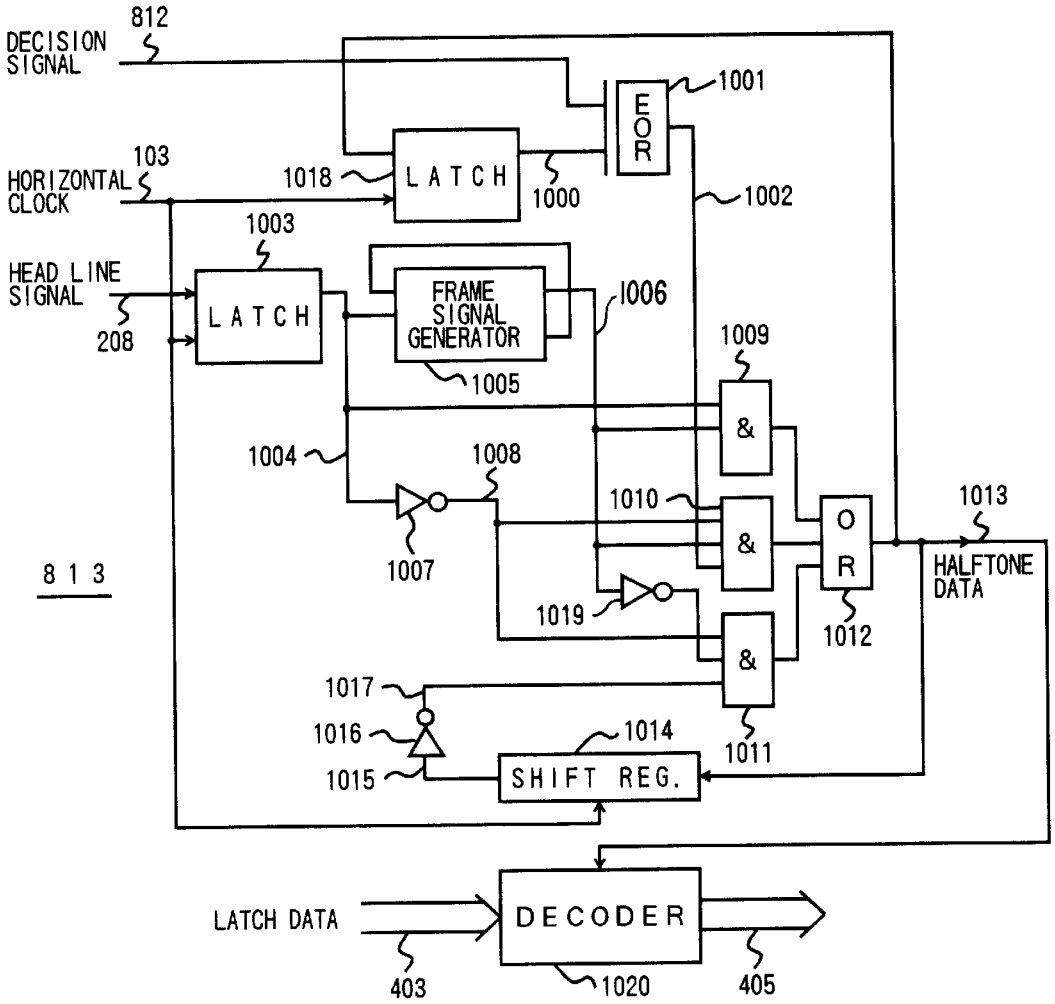
FIGS. 10(*a*) and 10(*b*) are a block diagram and a table respectively for explaining the generation of halftone data by a pattern generator illustrated in FIG. 8.

FIG. 10(*a*) is a block diagram of an example of on arrangement for the generation of the halftone data by the pattern generator 813 shown in FIG. 8. As stated before, the pattern generator 813 converts the ternary (display-ON, display-OFF or halftone) input display data 101 into the binary (display-ON or display-OFF) pattern data 405. A latch 1018 latches halftone data 1013 at the last line or the directly preceding line and delivers last-line halftone data 1000 in accordance with the horizontal clock 103. When the decision signal 812 is "1", an exclusive OR circuit 1001 inverts the last-line halftone data 1000 to deliver the inverted data as a halftone signal 1002, and when the decision signal 812 is "0", the circuit 1001 delivers the last-line halftone data 1000 left intact, as the halftone signal 1002. A latch 1003 latches the head line signal 208 and delivers a latch head signal 1004 in accordance with the horizontal clock 103. A frame signal generator 1005 inverts a frame signal 1006 at the leading edge of the pulse of the latch head signal 1004. Inverter circuits 1007 and 1019, AND circuits 1009, 1010 and 1011, and an OR circuit 1012 constitute a selector. In this selector, when the latch head signal 1004 is "1", the AND circuit 1009 is enabled to deliver the frame signal 1006 as the halftone data 1013. On the other hand, when the latch head signal 1004 is "0", an inverted latch signal 1008 becomes "1", and hence, the AND circuits 1010 and 1011 are enabled. Herein, subject to the frame signal 1006 being "1", the AND circuit 1010 delivers the halftone signal 1002 as the halftone data 1013. In contrast, subject to the frame signal 1006 being "0", the AND circuit 1011 delivers the inverted data 1017 of the halftone data 1013 of the preceding frame as the halftone data 1013. The values "0" and "1" of the halftone data 1013 form the pattern of the halftone display. A one-line latch or shift register 1014 latches the halftone data 1013 for all the lines (8 lines in this embodiment) successively in accordance with the horizontal clock 103. When the latch head signal 1004 is "1", the one-line latch 1014 delivers the halftone display data 1013 of the first line of the preceding frame as preceding-frame halftone data 1015. At the same time that the one-line latch 1014 latches the halftone data 1013 of the first line of the current frame, it delivers the halftone data 1013 of the second line of the preceding frame as the preceding-frame halftone data 1015. The preceding-frame halftone data 1015 is inverted by an inverter circuit 1016 into the inverted preceding-frame halftone data 1017, which is input to the AND circuit 1011. In accordance with the halftone data 1013, a decoder 1020 generates the pattern data 405 from the latch data 403. As to each of the dots of the read data 209, the decoder 1020 functions to deliver "1" for the ON dot, "0" for the OFF dot, and the halftone data 1013 for the halftone dot.

FIG. 10(*b*) illustrates how the halftone data 1013 is determined with regard to the latch head signal 1004 and the frame signal 1006. As can be understood from the illustrated relationship, when the latch head signal 1004 is "1" indicating the first line of each frame, the frame signal 1006 left intact is used as the halftone data 1013. Herein, the frame signal 1006 becomes data which is inverted every frame to turn ON and OFF alternately. Besides, when the latch head signal 1004 is "0" indicating the second line et seq. of each frame, the halftone signal 1002 serves as the halftone data 1013 on condition that the frame signal 1006 is "1" (indicating an odd frame). Herein, the halftone signal 1002 is such that the halftone data 1013 of the last or directly preceding line as it is, or the inverted data thereof is output in accordance with the decision signal 812 by the latch 1018. On condition that the frame signal 1006 is "0" (indicating an even frame), the inverted data 1017 of the halftone data of the preceding frame serves as the halftone data 1013 at each of the second line et seq. Thus, at each of the second line et seq., in the odd frame, the halftone display state of the last line of the same frame is reflected, and in the even frame, the halftone display state of the same line of the preceding frame is inverted.

Figure 11:
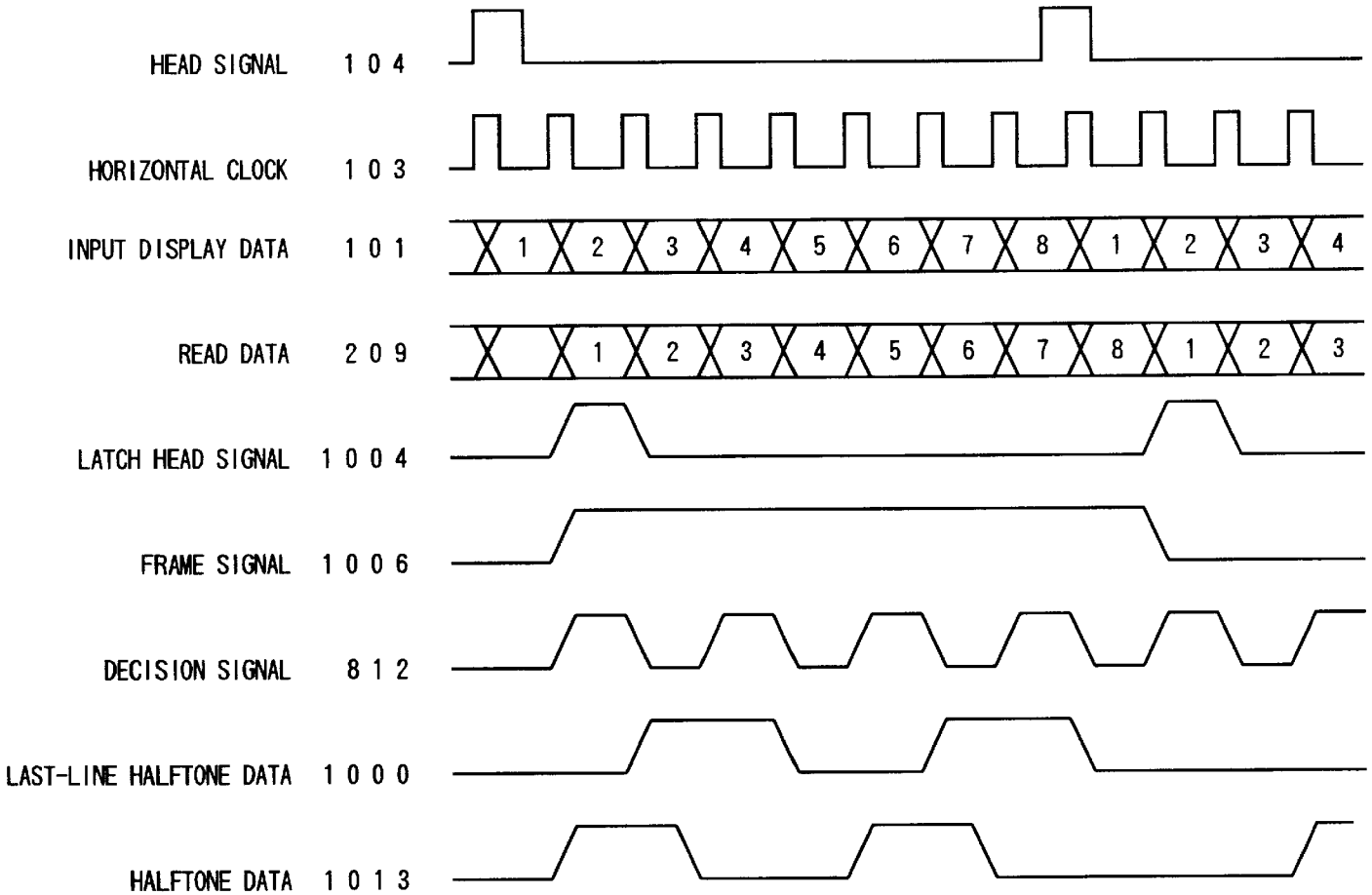
FIG. 11 is a timing chart for explaining the generation of the halftone data.

The concrete operations of the pattern generator 813 will be explained with reference to a timing chart illustrated in FIG. 11. The decision signal 812 alternates between "1" and "0" every line in this example. Since the head line signal 208 is latched in accordance with the horizontal clock 103 by the latch 1003, the latch head signal 1004 is held at "1" for one horizontal period of the first-line data of the read data 209. When the latch head signal 1004 is "1", the AND circuit 1009 is enabled, and the halftone data 1013 becomes the output frame signal 1006 of the frame signal generator 1005 which is toggled by the leading edge of the pulse of the latch head signal 1004. Since, in FIG. 11, the frame signal 1006 is "1", the halftone data 1013 also becomes "1". When the read data 209 corresponds to any of the second line et seq., the halftone data 1013 of the last line is latched in the latch 1018 and is delivered as the last-line halftone data 1000, which is inverted or passed through into the halftone signal 1002 depending on the decision signal 812. On condition that the frame signal 1002 is "1", the AND circuit 1010 is enabled, and this halftone signal 1002 becomes the halftone data 1013. As seen from the figure, when the read data 209 corresponds to the second line, the decision signal 812 is "0", and hence, the halftone signal 1002 is set at "1" by passing through the last-line halftone data 1000. Accordingly, also the halftone data 1013 of the second line becomes "1". On the other hand, when the read data 209 corresponds to the third line, the decision signal 812 is "1", and hence, the last-line halftone data 1000 is inverted to bring the halftone signal 1002 to "0". Therefore, the halftone data of the third line becomes "0". The above operations are repeated down to the eighth line being the final line. In the next frame, the frame signal 1006 becomes "0". Then, when the latch head signal 1004 is "1", the above frame signal 1006 is delivered as the halftone data 1013. Besides, at the second line et seq., the AND circuit 1011 is enabled, so that the preceding-frame halftone data 1015 being the outputs of the one-line latch 1014 are read out and inverted into the halftone data 1013 successively in accordance with the horizontal clock 103. This operation ensures the operation of repeating the display-ON and the display-OFF in the two frames for the halftone display.

Figure 12:
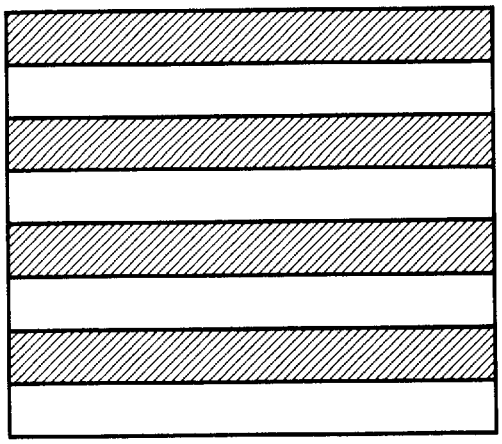
FIG. 12 is an explanatory diagram of a display example.
Figure 13:
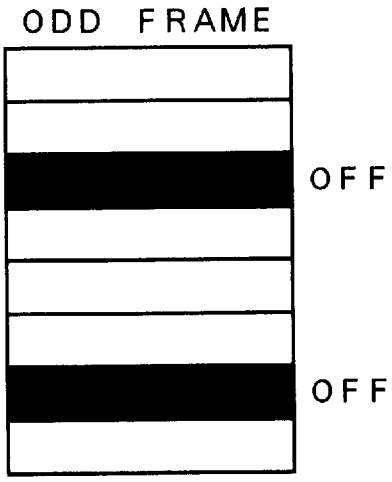
FIGS. 13(*a*) and 13(*b*) are diagrams for explaining the display patterns of individual frames in the display example of FIG. 12.
Figure 13:
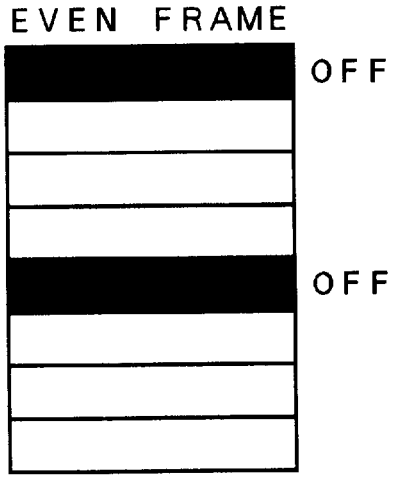
Figure 64:
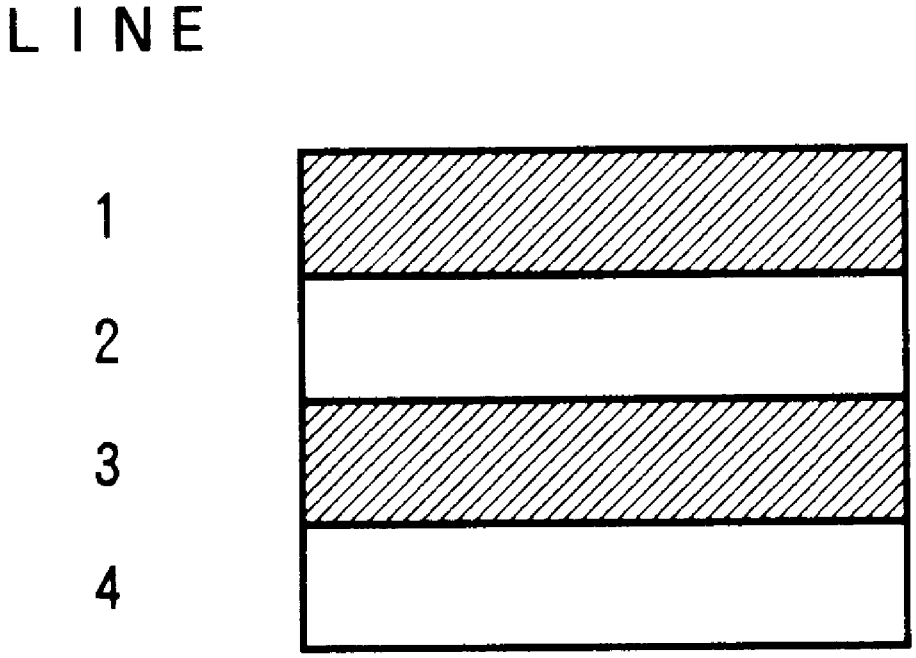
FIG. 64 PRIOR ART
FIG. 64 is a diagram for explaining a display example in the prior art.
Figure 65:
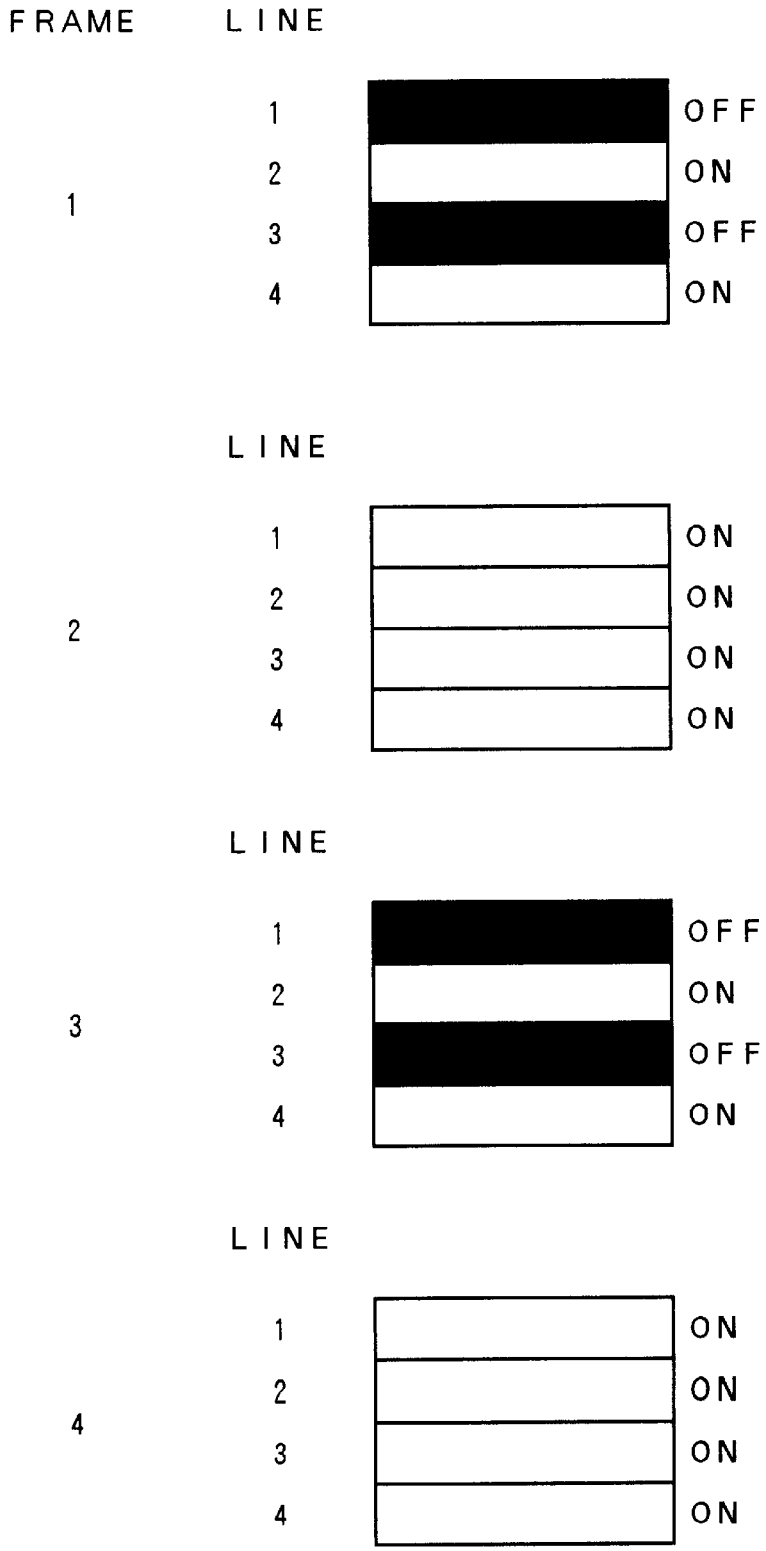
FIG. 65 PRIOR ART
FIG. 65 is a diagram for explaining display patterns in individual frames in the prior art.

The operation of generating the halftone data has thus far been described, and will now be explained in conjunction with display examples. FIG. 12 illustrates a display example which is seen as visual information with the human eye, and in which each hatched part indicates a halftone display. In the case of the exemplified pattern, the decision signal 812 becomes the same as shown in FIG. 11. Herein, the halftone data 1013 repeat "1" and "0" every second line. As illustrated in FIGS. 13(*a*) and 13(*b*), therefore, the display data of the pattern are such that the display-OFF in black exists at two lines in each of an odd frame and an even frame. Accordingly, the display-OFF state does not become concentrated in only either frame as indicated in the prior-art example, and the flicker is less prone to appear. More specifically, although the display example of FIG. 12 is substantially the same as the display example of FIG. 64 in the description of the prior art, the display patterns of the respective frames for presenting the display examples are clearly different as can be understood by comparing FIGS. 13(*a*) and 13(*b*) with FIG. 65. When note is taken of only one line lying in the halftone display state, the ON display and the OFF display are alternately repeated in the display patterns of both the display examples. However, the OFF displays for a plurality of lines lying in the halftone display state become concentrated in the same frames in the display patterns shown in FIG. 65, whereas they disperse into separate frames in the display patterns of this embodiment shown in FIGS. 13(*a*) and 13(*b*). Thus, the flicker is reduced.

Figure 14:
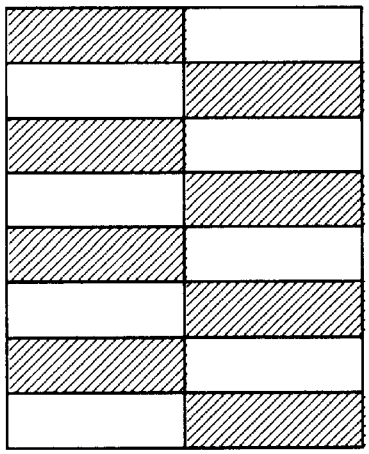
FIG. 14 is an explanatory diagram of another display example.
Figure 15:
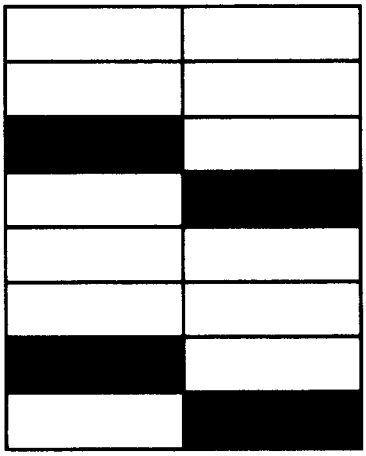
FIGS. 15(*a*) and 15(*b*) are diagrams for explaining the display patterns of individual frames in the display example of FIG. 14.
Figure 15:
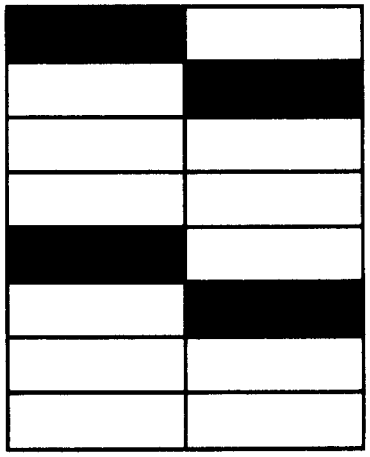

FIG. 14 illustrates another display example as visual information. Also in this case, no halftone display exists at the coincident dot positions of even lines and odd lines, so that the decision signal 812 becomes as shown in FIG. 11. The display patterns of respective frames on this occasion are as illustrated in FIGS. 15(*a*) and 15(*b*). With the prior art, the display OFF of the odd frame appears in the left half thereof, and the display OFF of the even frame appears in the right half thereof. In contrast, owing to the application of this embodiment, the display OFF is uniformly distributed in the right and left halves of each frame in both the odd and even frames, and the flicker is less prone to arise.

Figure 16:
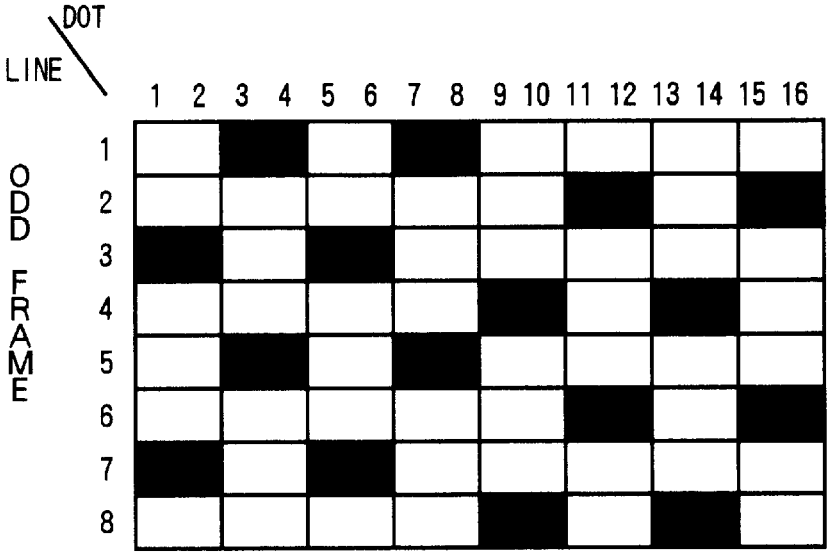
FIGS. 16(*a*) and 16(*b*) are diagrams for explaining another example of the generation of a halftone pattern.
Figure 16:
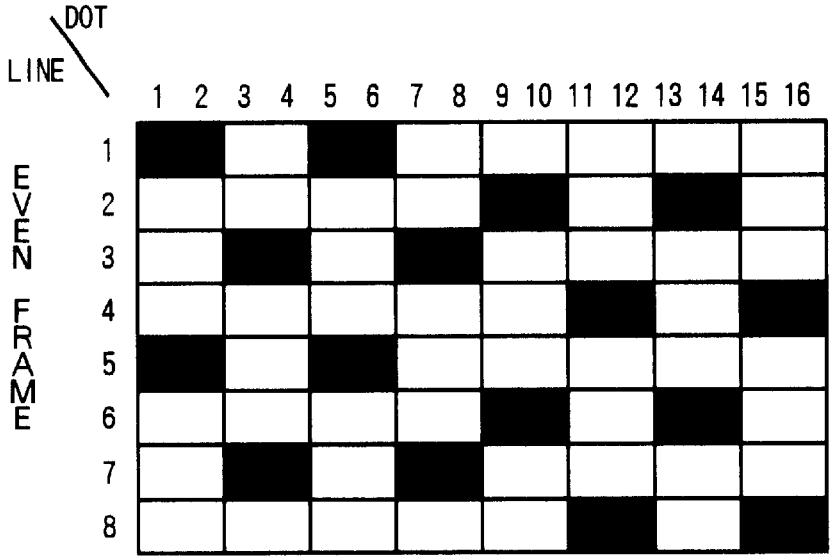

Although, in the above, the embodiment for generating the halftone display patterns has been described in connection with the display pattern examples, various modifications are possible. For example, the halftone data 1013 have been applied to all the halftone display dots of one line in the foregoing. However, when the halftone data 1013 left intact are used for the first and second dots of the four dots and the inverted data of the halftone data 1013 are used for the third and fourth dots by way of example, the display patterns of the respective frames in FIGS. 15(*a*) and 15(*b*) become as illustrated in FIGS. 16(*a*) and 16(*b*), in which the areas of the display-OFF are still finer to render the flicker more difficult to discern. In addition, it is possible to change the positions of the dots where the halftone data 1013 are used as they are and the dots where they are inverted. It is also possible that the number of dots to be dealt with at one time is set at any desired number such as 8 or 16. In a case where the number of dots is enlarged in this manner, the conversion of the dot displays into the halftone patterns is followed by conversion which adapts the halftone patterns to the number of input dots of the data driver 110. Further, in this embodiment, the halftone patterns are generated by calculating the data of the line of the LC display data 106 to be input to the data driver and the data of the last line or immediately preceding line. However, the present invention is not restricted to this aspect, but halftone patterns can also be generated by calculating the contents of several lines. Such an aspect can be realized by the use of a line memory whose storage capacity is of several lines. On this occasion, the head line of a frame is not affected by the other lines as in the embodiment described above, and the second line et seq. are processed by increasing the line Nos. for the calculations to the second line, the third line, etc. down to the prescribed line No.

As set forth above, according to the embodiment of the present invention, the halftone patterns of the successive patterns, in which the timings for affording the display-ON and the display-OFF are changed at the adjacent dots or lines, are determined on the basis of the contents of the display data, so that the flickerless halftone displays are possible at all times irrespective of display patterns.

Now, the second embodiment of the present invention will be described. In this embodiment, halftone data are generated on the basis of the display data of a current line (in other words, without employing any line memory and without regard to the display data of a preceding line).

Figure 17:
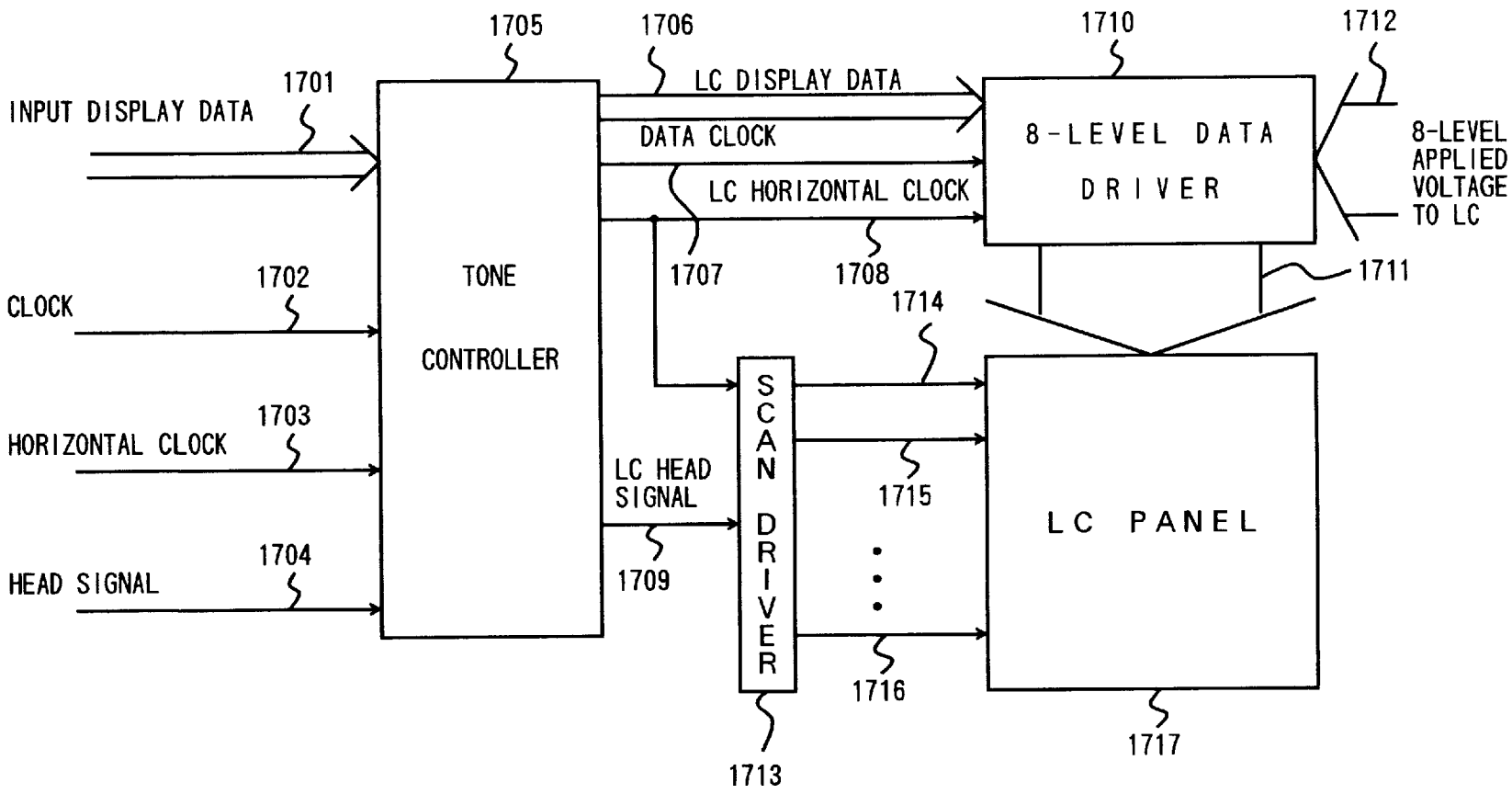
FIG. 17 is a block diagram showing the second embodiment of the present invention.

FIG. 17 is a block diagram of the embodiment of a halftone display system to which the present invention is applied. In the figure, numeral 1701 indicates input display data, and numeral 1702 a clock. Unlike those of the first embodiment, the input display data 1701 are serial data each being of one dot. Each dot is composed of 4 bits, and the input display data 1701 express 16 tones from tone #0 indicated by (0, 0, 0, 0), to tone #15 indicated by (1, 1, 1, 1). As will be stated later, however, display data to be afforded to a data driver are composed of 3 bits per dot.

The display data 1701 are sent into the display system in synchronism with the clock 1702 in dot units. Numeral 1703 denotes a horizontal clock, and numeral 1704 a head signal. The display data for one line are received in one cycle of the horizontal clock 1703 (in one horizontal period). In addition, the head signal 1704 indicates the head line of the display data, and the display data for one frame are received in one cycle of this head signal. Numeral 1705 denotes a tone controller, numeral 1706 liquid-crystal display data, numeral 1707 a data clock, numeral 1708 a liquid-crystal horizontal clock, and numeral 1709 a liquid-crystal head signal. The tone controller 1705 converts the input display data 1701 of 4 bits into data of 3 bits, which are delivered as the LC display data 1706. Besides, the tone controller 1705 is supplied with the clock 1702, horizontal clock 1703 and head signal 1704 so as to generate the data clock 1707, LC horizontal clock 1708 and LC head signal 1709, respectively. Numeral 1710 denotes an 8-level data driver, numeral 1711 liquid-crystal horizontal data, and numeral 1712 voltages of 8 levels to be applied to a liquid crystal. The 8-level data driver 1710 accepts the LC display data 1706 of 3 bits for one horizontal line in accordance with the data clock 1707, and thereafter delivers the accepted data in synchronism with the LC horizontal clock 1708. In accordance with the output data, corresponding levels are selected from among the 8-level applied LC voltages 1712 and are delivered as the LC horizontal data 1711. Accordingly, the 8-level data driver 1710 delivers the LC horizontal data 1711 of the last line immediately preceding the line whose LC display data 1706 are being accepted in accordance with the data clock 1707.

In this embodiment, the displays of 16 tones in total are presented by 8 tones which are attained by applying an identical voltage in successive frames, and 8 tones which are attained by changing-over applied voltages in the successive frames. The 8 tones which are attained by applying the identical voltage in the successive frames shall be called the "8 tones based on a voltage display mode", while the 8 tones which are attained by changing-over the applied voltages in the successive frames shall be called the "8 tones based on an FRC (Frame Rate Control) display mode".

Shown at numeral 1713 is a scan driver, by which the line of one frame to display the LC horizontal data 1711 delivered from the 8-level data driver 1710 is appointed in terms of "1". In-the illustration, the outputs 1714, 1715 and 1716 of the scan driver 1713 correspond to the first scan line, second scan line and nth scan line, respectively. The scan driver 1713 accepts the LC head signal 1709 of "1" in accordance with the LC horizontal clock 1708, and brings the first scan line 1714 to "1". Subsequently, it shifts the line for the display to the second scan line 1715, . . . and the nth scan line 1716 successively in accordance with the LC horizontal clock 1708, thereby scanning the frame. Numeral 1717 denotes a liquid-crystal panel, which is set at a resolution of m dots in the horizontal direction thereof and n lines in the vertical direction thereof in this embodiment.

Figure 18:
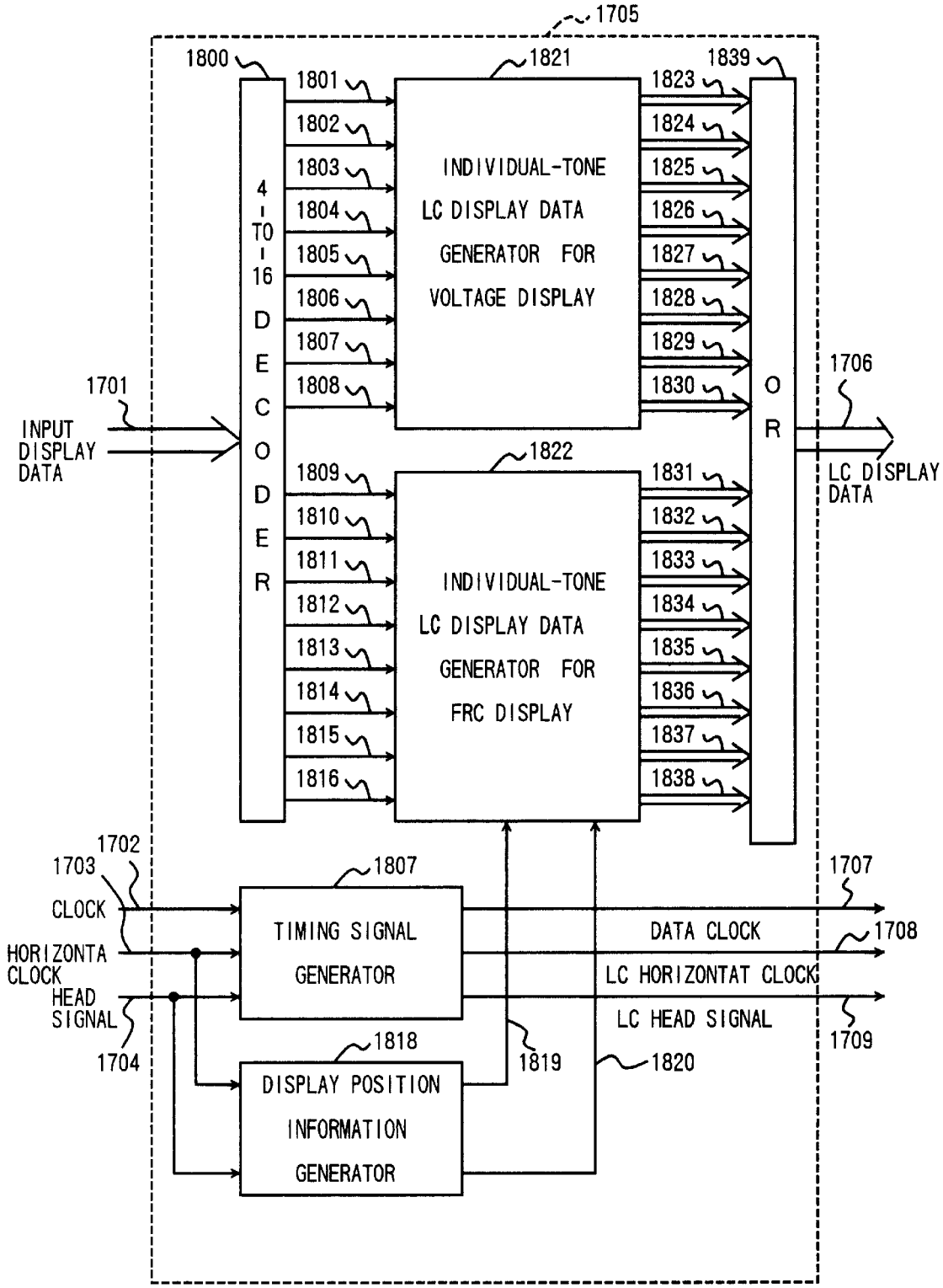
FIG. 18 is a block diagram of an example of a tone controller illustrated in FIG. 17.

FIG. 18 is a block diagram of an example of the arrangement of the tone controller 1705. Numeral 1800 represents a 4-to-16 decoder, and numerals 1801~1816 represent tone signals #0~#15 corresponding respectively to the 16 tones of tones #0~#15. The 4-to-16 decoder 1800 sets only one of the tone signals 1801~1816 to "1" to indicate which of the 16 tones the input display data 1701 of 4 bits expresses. This example of arrangement will be explained below, assuming the tone signals 1801~1816 as follows: The signal 1801 corresponds to the tone #15, the signal 1802 to the tone #12, the signal 1803 to the tone #10, the signal 1804 to the tone #8, the signal 1805 to the tone #6, the signal 1806 to the tone #4, the signal 1807 to the tone #2, the signal 1808 to the tone #0, the signal 1809 to the tone #14, the signal 1810 to the tone #13, the signal 1811 to the tone #11, the signal 1812 to the tone #9, the signal 1813 to the tone #7, the signal 1814 to the tone #5, the signal 1815 to the tone #3, and the signal 1816 to the tone #1. In this way, when the input display data 1701 of 4 bits expresses the tone #2, only the tone #2 signal 1807 is set to "1". Shown at numeral 1817 is a timing signal generator, which generates the data clock 1707, LC horizontal clock 1708 and LC head signal 1709 from the clock 1702, horizontal clock 1703 and head signal 1704, respectively. Numeral 1818 denotes a display position information generator, numeral 1819 a line information signal, and numeral 1820 a frame information signal. The display position information generator 1818 generates the line information signal 1819 expressive of a display line in terms of "1" or "0" and the frame information signal 1820 expressive of a display frame in terms of "1" or "0", from the horizontal clock 1703 and the head signal 1704. In the ensuing description of this example of the arrangement, the line information signal 1819 assumed to be a signal which becomes "0" for the display line of the first or second line and "1" for the display line of the third or fourth line, and which repeats this aspect thenceforth. Also, the frame information signal 1820 is assumed to be a signal which repeats "0" for the display frame of an odd frame and "1" for the display frame of an even frame. The tone controller 1705 further includes an individual-tone LC display data generator for the voltage display mode 1821, an individual-tone LC display data generator for the FRC display mode 1822, and an OR circuit 1839. Numerals 1823~1838 represent the individual-tone LC display data of the tones #0~#15. The individual-tone LC display data generator for the voltage display mode 1821 generates the individual-tone LC display data 1823~1830 in accordance with those 1801~1808 of the tone signals 1801~1816 which indicate the tones based on the voltage display mode. On the other hand, the individual-tone LC display data generator for the FRC display mode 1822 generates the individual-tone LC display data 1831~1838 in accordance with those 1809~1816 of the tone signals 1801~1816 which indicate the tones based on the FRC display mode, the line information signal 1819 which indicates the line No. of the display, and the frame information signal 1820 which indicates the frame No. of the display. The individual-tone LC display data generated by the generator 1821 or 1822 is delivered as the LC display data 1706 through the OR circuit 1839.

The operation of the tone controller 1705 will be explained in detail. In the halftone display system of FIG. 17, the display data 1701 of 4 bits is converted by the tone controller 1705 into the LC display data 1706 of 3 bits which is as shown in FIG. 26, and which is afforded to the 8-level data driver 1710. Besides, the tone controller 1705 generates the data clock 1707, LC horizontal clock 1708 and LC head signal 1709 from the clock 1702, horizontal clock 1703 and head signal 1704 and then drives the 8-level data driver 1710 and the scan driver 1713 so as to display the contents of the input display data 1701 on the liquid-crystal panel 1717.

The operation of the tone controller 1705 for converting the input display data 1701 into the LC display data 1706 is carried out as stated below.

In the tone controller 1705 shown FIG. 18, the input display data 1701 is supplied to the 4-to-16 decoder 1800, and one of the tone signals 1801~1808 is set to "1" in accordance with the value of the 4-bit data, namely, any of (0, 0, 0, 0)~(1, 1, 1, 1). By way of example, in the case of converting the input display data 1701 into the LC display data 1706 in conformity with the relationship shown in FIG. 26, one of the tone signals 1801~1808 is set to "1" when the input display data 1701 represents any of the tones #0, #2, #4, #6, #8, #10, #12 and #15. The tone signals 1801~1808 are input to the individual-tone display data generators for the voltage display mode 1821. This individual-tone display data generator for the voltage display mode 1821 can be implemented by an arrangement illustrated in FIG. 19 as will be explained later. One of the display data generators 1900~1907 for the individual tones generates corresponding data among individual-tone display data 1823~1830 in response to the "1" signal of the tone signals 1801~1808 and in conformity with the relationship of FIG. 26. Those of the individual-tone display data 1823~1830 which correspond to the tone signals 1801~1808 set to "0" become (0, 0, 0). Meanwhile, when the input display data 1701 represents any of the tones #1, #3, #5, #7, #9, #11, #13 and #14, one of the tone signals 1809~1816 is set to "1". The tone signals 1809~1816 are input to the individual-tone display data generators for the FRC display mode 1822. This individual-tone display data generators for the FRC display mode 1822 can be implemented by an arrangement illustrated in FIG. 20 as will be explained later. One of display data generators 2000~2007 for the individual tones generates corresponding data among individual-tone display data 1831~1838 in response to the "1" signal of the tone signals 1809~1816 and in conformity with the relationship of FIG. 26. Herein, as seen from FIG. 26, the corresponding display data to be generated contains two values which are changed-over in the successive frames. On this occasion, the two values are changed-over in accordance with the line information signal 1819, the frame information signal 1820 and the clock 1702, and the details will be elucidated later. Those of the individual-tone display data 1831~1838 which correspond to the tone signals 1809~1816 set to "0" become (0, 0, 0). Finally, in the tone controller 1705 of FIG. 18, only one of the individual-tone LC display data 1823~1838 is output as illustrated in FIG. 26, and all the others become (0, 0, 0), so that the output data is delivered as the 3-bit LC display data 1706 through the OR circuit 1839 which takes the logical sum of the corresponding bits.

Figure 19:
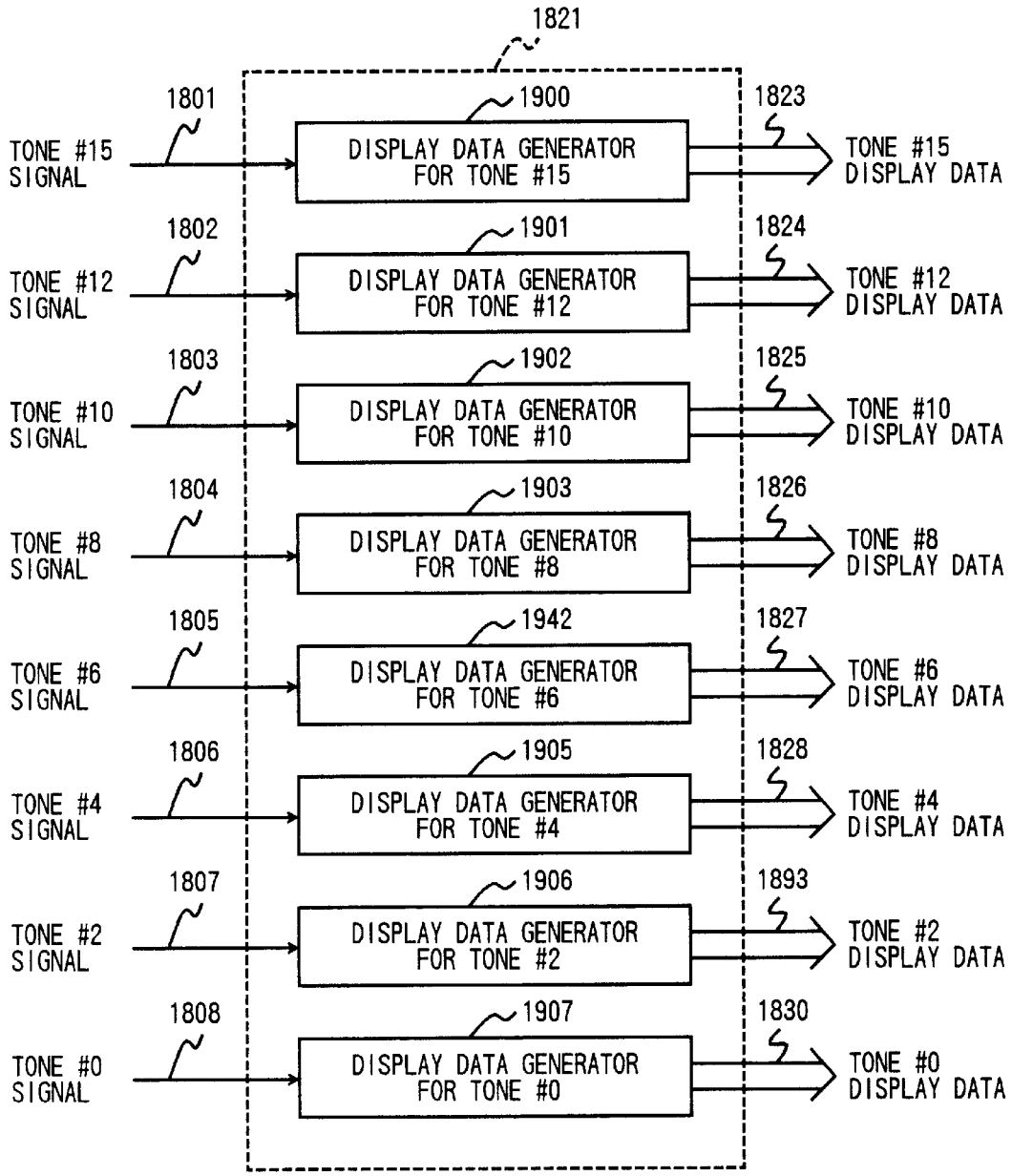
FIG. 19 is a block diagram of an example of an individual-tone display data generator for a voltage display mode illustrated in FIG. 18.

FIG. 19 is a block diagram showing an example of the arrangement of the individual-tone display data generators for the voltage display mode 1821. As mentioned before, numerals 1801~1808 represent the tone signals, numerals 1900~1907 the individual-tone display data generators, and numerals 1823~1830 the individual-tone display data. The individual-tone display data generators 1900~1907 generate the corresponding individual-tone display data 1823~1830 having the same values every frame, in response to the "1" signals of the corresponding tone signals 1801~1808, respectively.

Figure 20:
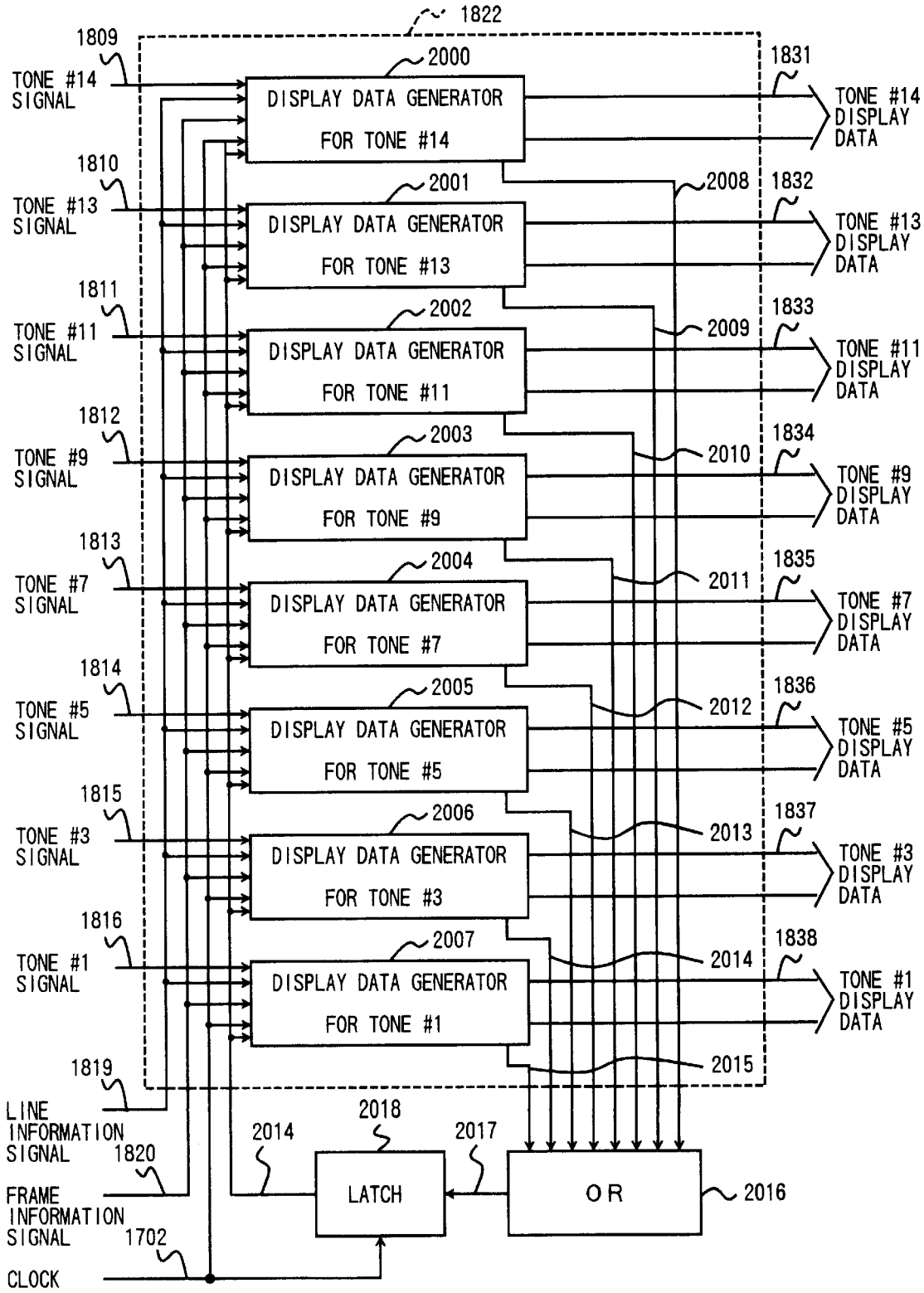
FIG. 20 is a block diagram of an example of an individual-tone display data generator for an FRC display mode illustrated in FIG. 18.

FIG. 20 is a block diagram showing an example of the arrangement of the individual-tone display data generators for the FRC display mode 1822. As mentioned before, numerals 1809~1816 represent the tone signals, numerals 2000~2007 the individual-tone display data generators, and numerals 1831~1838 the individual-tone display data. The individual-tone display data generators 2000~2007 generate the corresponding individual-tone display data 1831~1838 each having the two values, in response to the "1" signals of the corresponding tone signals 1809~1816, respectively, the two values being changed-over in the successive frames in accordance with the line information signal 1819, frame information signal 1820 and clock 1702. The two change-over data shall be denoted by two polarities α and β below. Shown at numerals 2008~2015 are dot polarity signals for the individual tones. Numeral 2016 denotes an OR circuit, numeral 2017 an OR output signal, numeral 2018 a latch, and numeral 2014 an adjacent-dot polarity signal.

Figure 21:
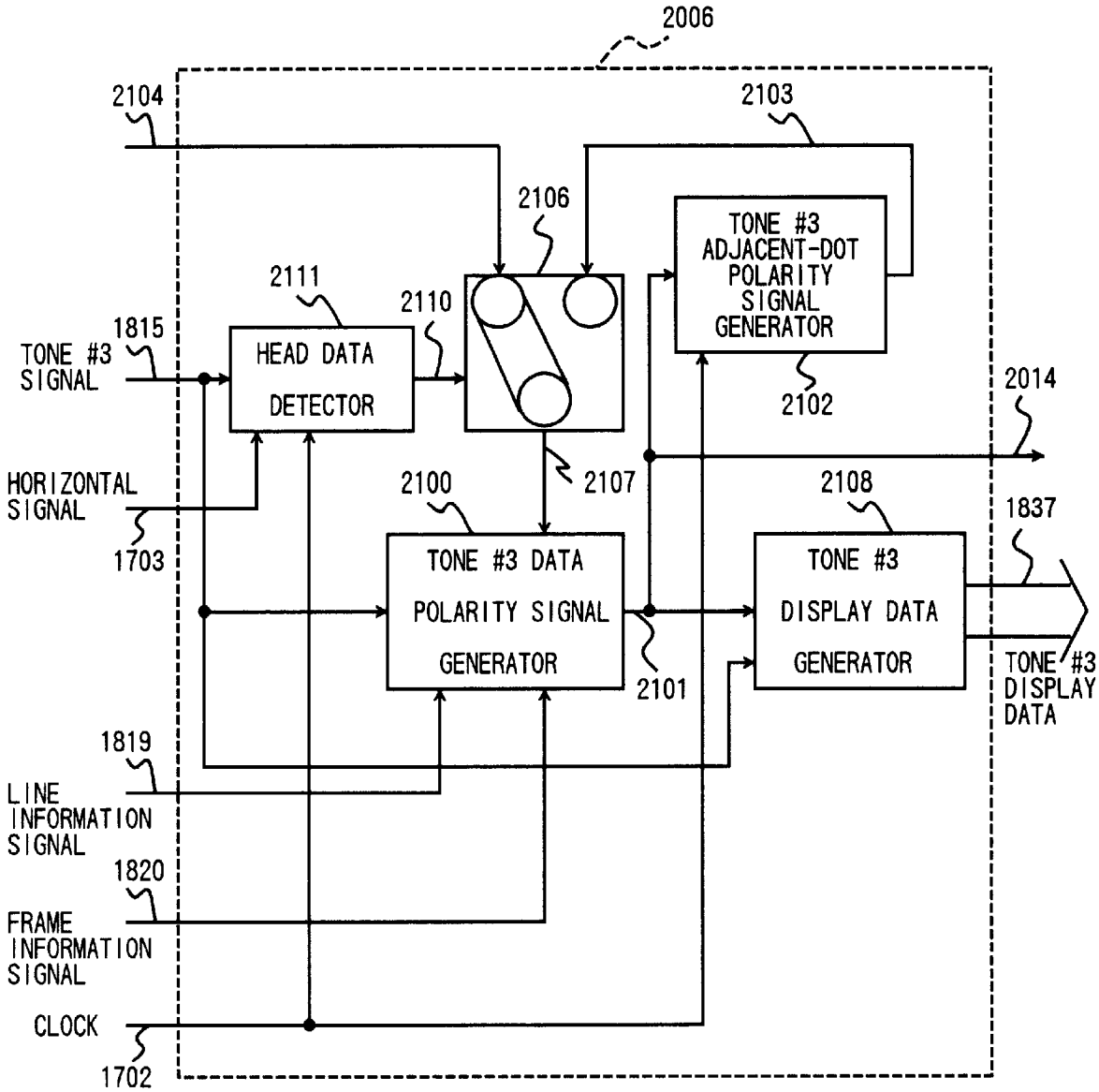
FIG. 21 is a block diagram of an example of a display data generator for tone #3 illustrated in FIG. 20.

FIG. 21 is a block diagram showing an example of the arrangement of the display data generator for the tone #3, 2006 among the individual-tone LC display data generators for the FRC mode 2000~2007. A data polarity signal generator corresponding to one dot (for tone #3), 2100 generates a data polarity signal 2101 which becomes "1" for the data polarity α and "0" for the data polarity β. An adjacent-dot polarity signal generator 2102 delivers the data polarity signal 2101 as an adjacent-dot polarity signal 2103 in synchronism with the clock 1702. Herein, the signal 2103 is a tone-#3 adjacent-dot polarity signal which expresses the data polarity of the dot adjacent to the dot of the tone #3. As mentioned before, numeral 2104 denotes the adjacent-dot polarity signal. A switch 2106 changes-over the adjacent-dot polarity signal 2104 and the tone-#3 adjacent-dot polarity signal 2103 in accordance with a select signal 2110. Herein, when the select signal 2110 is "0", the adjacent-dot polarity signal 2104 is selected, and when it is "1", the tone-#3 adjacent-dot polarity signal 2103 is selected. The select signal 2110 is generated by a head data detector 2111. This head data detector 2111 delivers "0" in accordance with the horizontal signal 1703. On the other hand, it delivers "1" in response to the next pulse of the clock 1702 which is delivered after the tone-#3 signal 1815 first becomes "1" in the pertinent display line being dealt with, and it thereafter continues to deliver "1" while the pertinent display line is being processed, in other words, until the next pulse of the horizontal signal 1703 is input. Shown at numeral 2107 is a preceding-dot polarity signal which indicates the data polarity of the preceding dot. When the tone signal 1815 is "0", the data polarity signal generator 2100 outputs the preceding-dot polarity signal 2107 as it is. In contrast, when the signal 1815 is "1", the generator 2100 determines the output polarity to be either α or β in accordance with the line information signal 1819 and the frame information signal 1820, on condition that the tone #3 is being displayed on the same line. In this example of arrangement, the data polarities are so determined that, in the odd frame, α is afforded to the first and second lines, while β is afforded to the third and fourth lines, and that, in the even frame, β is afforded to the first and second lines, while α is afforded to the third and fourth lines. Besides, in a case where the tone #3 is not of the first FRC display on the identical line, that is, where it has been displayed at any preceding dot, the data polarity is determined to be opposite to the preceding-dot data polarity signal 2107. "1" is delivered as the data polarity signal 2101 when the determined polarity is α, and "0" when the determined polarity is β. The adjacent-dot polarity signal generator 2101 delivers the data polarity signal 2101 to the switch 2106 as the tone-#3 adjacent-dot polarity signal 2103 in synchronism with the clock 1702. Numeral 2108 denotes an individual-tone display data generator, which delivers the tone-#3 display data 1837 in accordance with the data polarity signal 2101 and the tone-#3 signal 1815.

FIG. 26 illustrates the corresponding relations between the tones #0~#15 and the individual-tone display data. The same data is output every frame as to each of the tones based on the voltage display mode, while the data of the two polarities α and β are output in the successive frames as to each of the tones based on the FRC display mode. By way of example, the tone-#3 display data 1837 in FIG. 21 becomes (0, 0, 0) subject to the tone-#3 signal 1815 of "0". Subject to the tone-#3 signal 1815 of "1", the tone-#3 display data 1837 conforms to the relationship in FIG. 26, and it becomes (0, 1, 0) for the data polarity signal 2101 of "1" and (0, 0, 1) for the signal 2101 of "0". This tone-#3 display data 1837 is output through the OR circuit 1839 shown in FIG. 18.

The operation of the individual-tone display data generators for the FRC display mode 1822 will be explained in detail with reference to FIGS. 20~24 and FIG. 26. In the arrangement of FIG. 20, when any of the tones #1, #3, #5, #7, #9, #11, #13 and #14 has become "1", one of the display data generators 2000~2007 corresponding to the "1" tone operates. In the ensuing explanation, it will be assumed that the tone-#3 signal 1815 has become "1".

Figure 22:
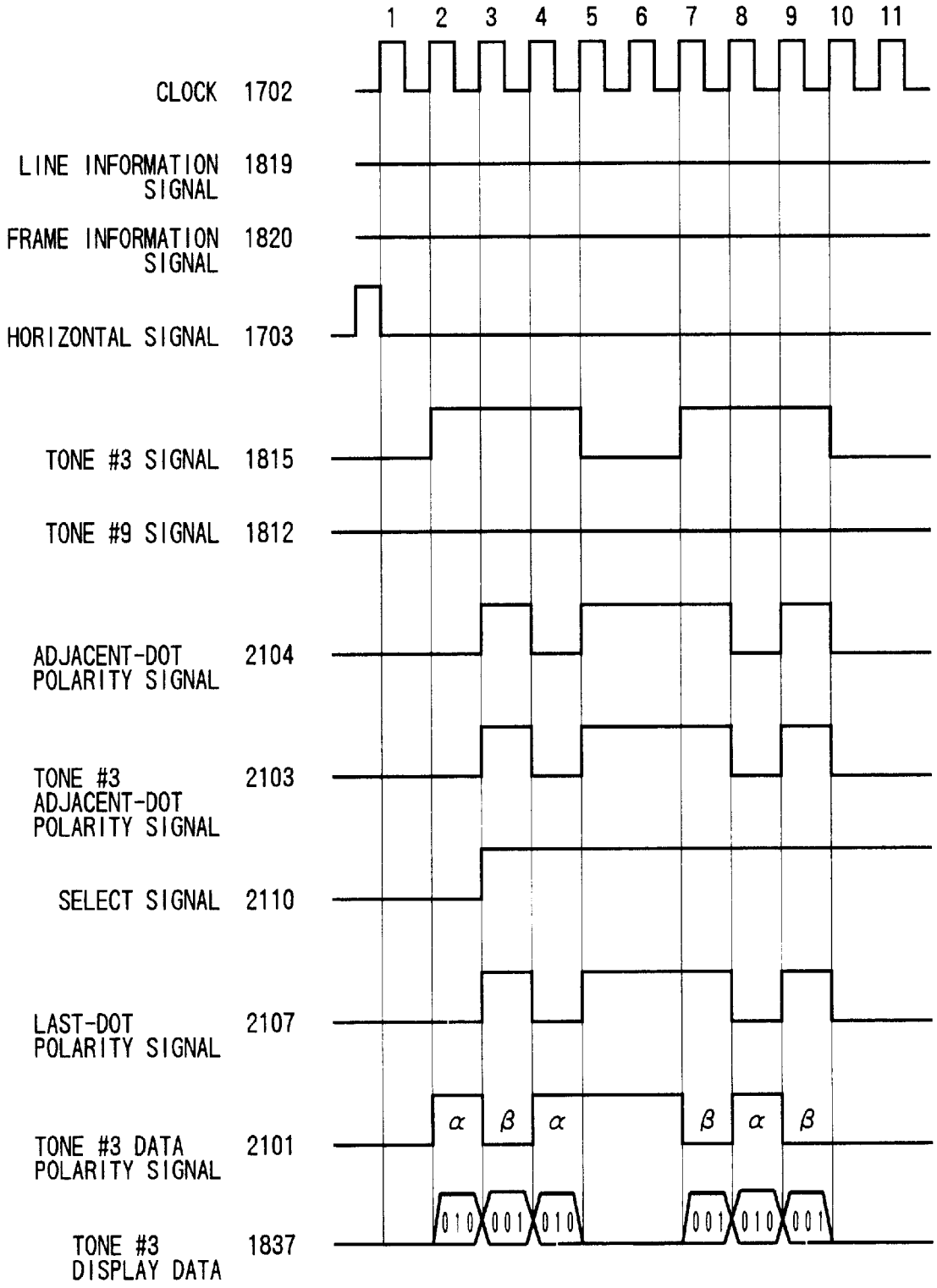
FIG. 22 is a timing chart of the operation of the tone-#3display data generator in the case where the tone #3 is displayed at the second, third, fourth, seventh, eighth and ninth dots on the first line in the first frame in the second embodiment.
Figure 23:
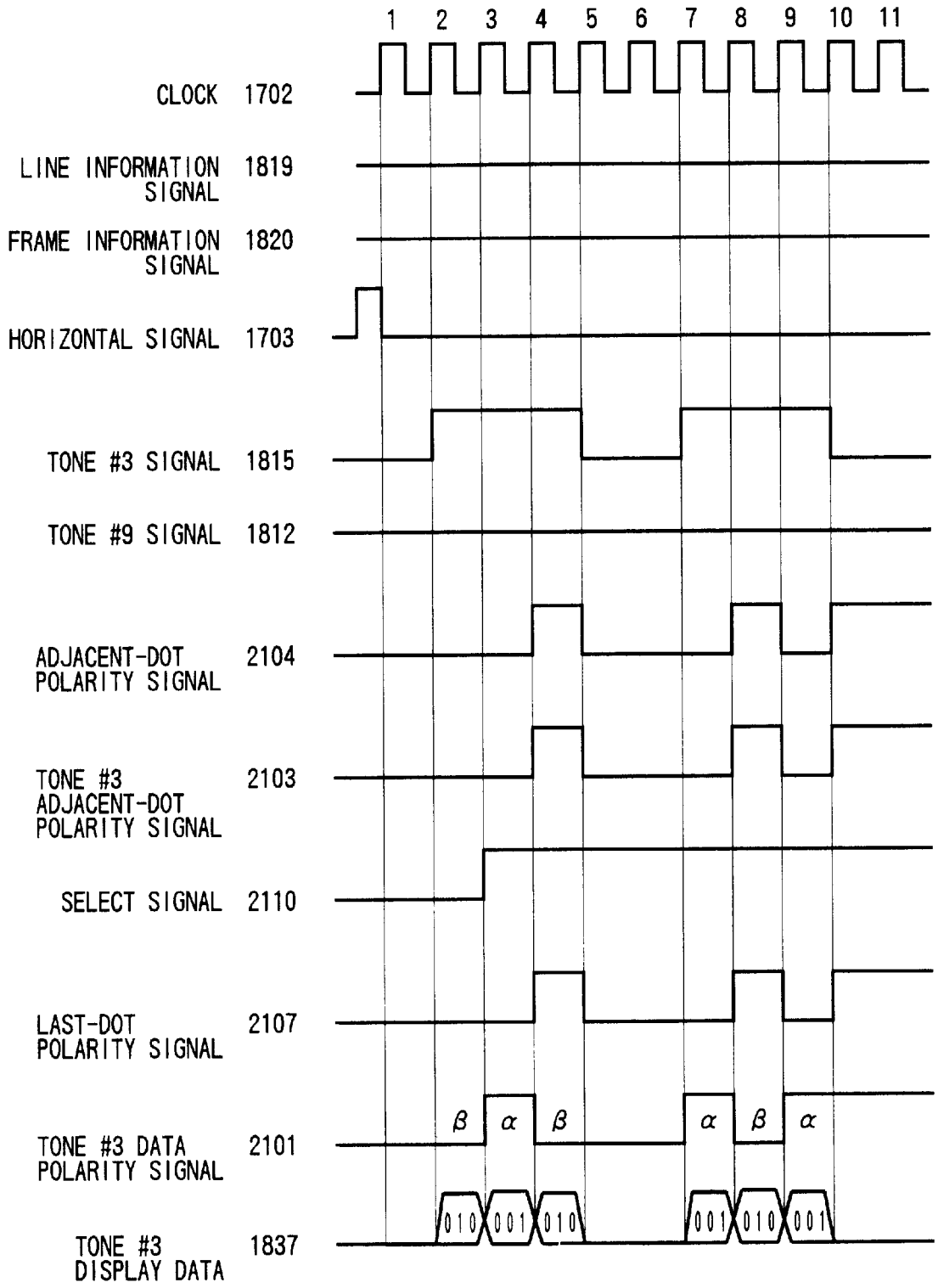
FIG. 23 is a timing chart of the operation of the tone-#3 display data generator in the case where the tone #3 is displayed at the second, third, fourth, seventh, eighth and ninth dots on the third line in the first frame in the second embodiment.
Figure 24:
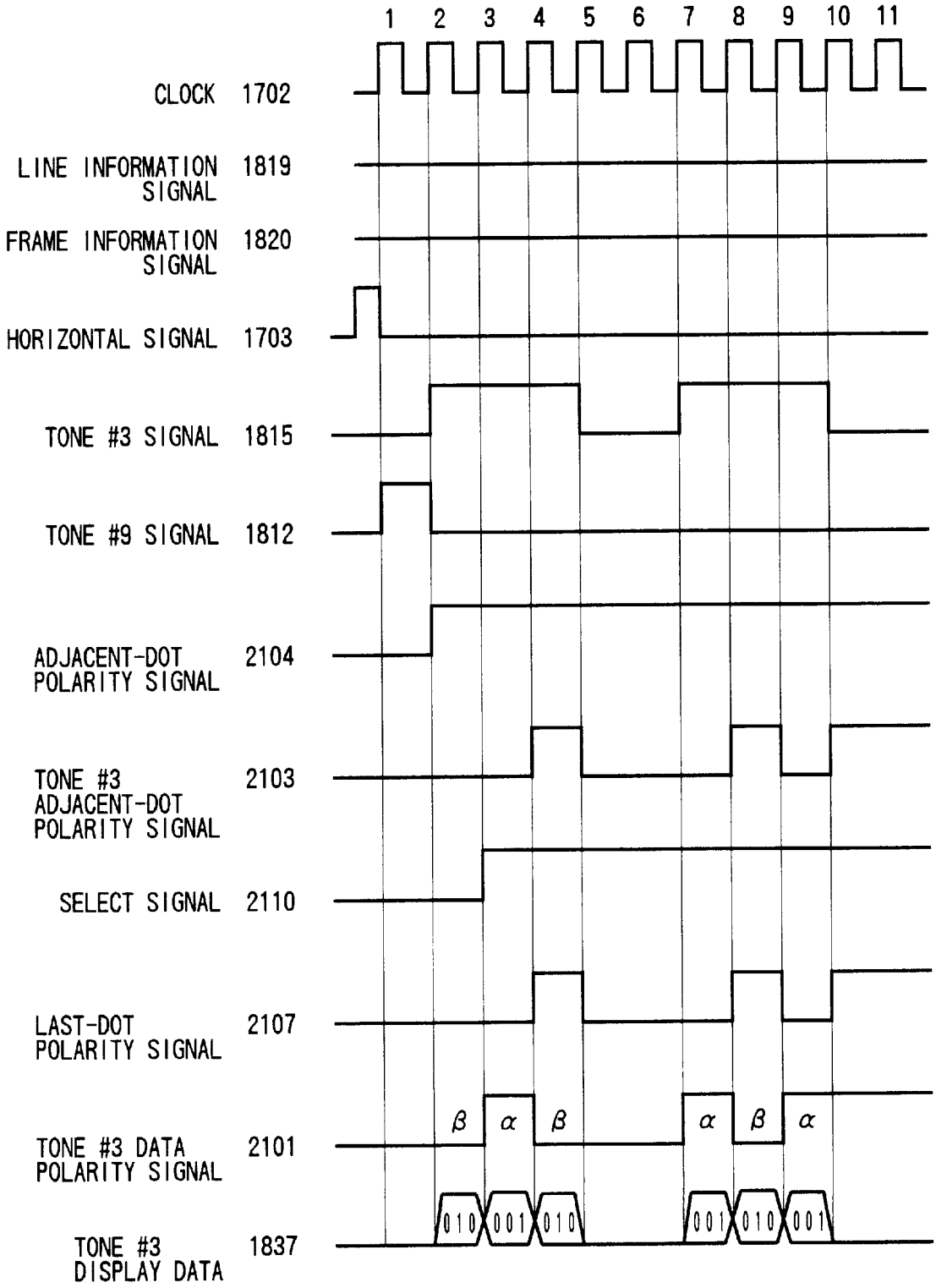
FIG. 24 is a timing chart of the operation of the tone-#3 display data generator in the case where tone #9 is displayed at the first dot and the tone #3 is displayed at the second, third, fourth, seventh, eighth and ninth dots on the first line in the first frame in the second embodiment.

The tone-#3 display data generator 2006 in FIG. 21 operates as illustrated in the timing charts of FIGS. 22~24. FIG. 22 depicts a case where the tone #3 is displayed at the second, third, fourth, seventh, eighth and ninth dots on the first line in the first frame; FIG. 23 a case where the tone #3 is displayed at the second, third, fourth, seventh, eighth and ninth dots on the third line in the first frame; and FIG. 24 a case where the tone #9 is displayed at the first dot on the first line in the first frame and where the tone #3 is similarly displayed at the second, third, fourth, seventh, eighth and ninth dots.

Referring to FIG. 22, the tone-#3 signal 1815 becomes "1" at the second dot. This signal is the first FRC tone signal on the pertinent line being dealt with. Besides, the line information signal 1819 is "0", and the frame information signal 1820 is "0". Consequently, the data polarity signal 2101 becomes "1" expressive of the polarity α. This data polarity signal 2101 is latched in the adjacent-dot polarity signal generator 2102 and then delivered as the tone-#3 adjacent-dot polarity signal 2103 for the third dot in accordance with the clock 1702. Since the tone #3 has already been displayed at the second dot, the tone-#3 adjacent-dot polarity signal 2103 is selected and delivered as the preceding-dot polarity signal for the third dot, 2107 by the switch 2106. More specifically, the tone-#3 signal 1815 has first become "1" at the second dot, so that the head data detector 2111 sets the select signal 2110 to "1" in response to the next pulse of the clock 1702. At the third dot et seq., therefore, the tone-#3 adjacent-dot polarity signal 2103 is selected by the switch 2106 to become the preceding-dot polarity signal 2107. At the third dot, since the preceding-dot polarity signal 2107 is "1", the data polarity signal 2101 becomes "0" expressive of the polarity β as has been obtained by inverting the preceding-dot polarity signal 2107. This data polarity signal 2101 is latched in the adjacent-dot polarity signal generator 2102 and then delivered as the tone-#3 adjacent-dot polarity signal 2103 for the fourth dot in accordance with the clock 1702. Regarding the fourth dot, since the preceding-dot polarity signal 2107 becomes "0", the data polarity signal 2101 becomes "1". This data polarity signal 2101 is latched in the adjacent-dot polarity signal generator 2102 and then delivered as the tone-#3 adjacent-dot polarity signal 2103 for the fifth dot in accordance with the clock 1702. Since, however, the tone-#3 signal 1815 is "0" at the fifth dot, the data polarity signal 2101 is held at "1" by delivering the preceding-dot polarity signal 2107 as it is, and the preceding-dot polarity signal 2107 for the fifth dot left intact is output as the tone-#3 adjacent-dot polarity signal 2103 for the sixth dot. The operation proceeds similarly at the sixth dot. At the seventh dot, the tone-#3 signal 1815 becomes "1", and the preceding-dot polarity signal 2107 is "1", so that the data polarity signal 2101 becomes "0". Thenceforth, when the tone-#3 signal 1815 is "1", the data polarity signal 2101 becomes the opposite polarity to the preceding-dot polarity signal 2107, and this data polarity signal 2101 turns into the tone-#3 adjacent-dot polarity signal 2103. On the other hand, when the tone-#3 signal 1815 is "0", the data polarity signal 2101 becomes the same as the preceding-dot polarity signal 2107, and this data polarity signal 2101 turns into the tone-#3 adjacent-dot polarity signal 2103 for the next dot.

In the case of FIG. 23, the tone-#3 signal 1815 becomes "1" at the second dot as in the case of FIG. 22. However, the line information signal 1819 is "1", and the frame information signal 1820 is "0", so that the data polarity signal 2101 becomes "0". The subsequent operation is similar to the operation explained as to the case of FIG. 22, and the polarities are successively inverted as to the dots of the tone #3.

Also in the case of FIG. 24, the tone-#3 signal 1815 becomes "1" at the second dot. Since, however, the tone #9 has become "1" at the first dot, the adjacent-dot polarity signal 2104 becomes "1" at the next pulse of the clock 1702. Accordingly, the preceding-dot polarity signal 2107 of the tone #3 becomes "1", and the data polarity signal 2101 becomes "0". Thenceforth, the data polarity signal 2101 of the tone #3 acts to turn the tone-#3 adjacent-dot polarity signal 2103 into the preceding-dot polarity signal 2107, so that the operation proceeds as in the case of FIG. 23.

Figure 25:
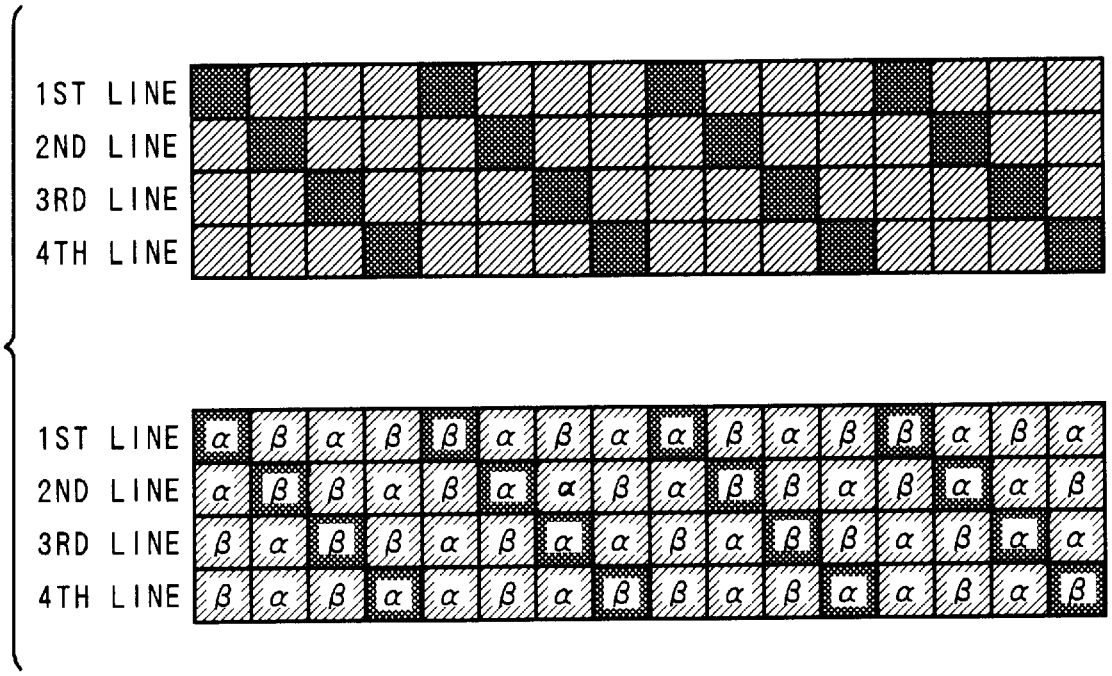
FIG. 25 is a diagram for explaining an example of the generation of the polarities of liquid-crystal display data in individual frames for a display pattern in the second embodiment.

While only the tone #3 has been explained above, a case of displaying different tones will be explained with reference to FIG. 25. This figure illustrates an example of arrangement for generating the polarities of liquid-crystal display data in successive frames in order to present a display pattern. Numerals 2500 and 2501 both denote the displays of tones based on the FRC display mode, each of which is attained by changing-over two values in the successive frames, and which exhibit different brightnesses. In this example of arrangement, it is assumed that the display 2500 is the display of the tone #3 in FIG. 26, while the display 2501 is the display of the tone #9. In FIG. 25, the same sorts of hatching drawn at individual dots represent the same tones.

In displaying the pattern exemplified in FIG. 25, since the polarity of the first or second line begins with α, the polarity of the tone #3 at the first dot of the first line becomes α, and the polarity of the tone #9 at the second dot becomes β. Thenceforth, the polarity of the tone #3 at the first line changes alternately as β, α, β, . . . , and the polarity of the tone #9 changes alternately as α, β, α, . . . . Since the polarity of the tone #9 at the first dot of the second line becomes α, the polarity of the tone #3 at the second dot becomes β. Thenceforth, the polarity of the tone #9 at the second line changes alternately as β, α, β, . . . , and the polarity of the tone #3 changes as α, β, α, . . . . The polarity of the tone #9 at the first dot of the third line is β, and that of the tone #9 becomes α at the second dot, so that the polarity of the tone #3 at the third dot becomes β. Thenceforth, the polarity of the tone #9 at the third line succeeds as β, α, β, . . . , and the polarity of the tone #3 succeeds as α, β, α, . . . . The polarity of the tone #9 becomes β at the first dot of the fourth line, becomes α at the second dot and becomes β at the third dot, so that the polarity of the tone #3 at the fourth dot becomes α. Thenceforth, the polarity of the tone #9 at the fourth line succeeds as α, β, α, . . . , and the polarity of the tone #3 succeeds as β, α, β, . . . . In this manner, the polarity is inverted every dot as to the dots of the tone #3 irrespective of display patterns. The same holds true also of the dots of the tone #9.

Incidentally, this embodiment has been described as the monochromatic display scheme in which the input display data are the serial data in dot unit, and in which the number of tones is 16. However, a color display scheme can be realized in such a way that three sets are disposed for respective colors, each of the sets consisting of the 4-to-16 decoder 1800, the individual-tone display data generators for the voltage display mode 1821, the individual-tone display data generators for the FRC display mode 1822, and the OR circuit 1839 which are shown in FIG. 18. A case where the input display data are 4-dot parallel data, can also be coped with in such a way that individual-tone display data generators as shown at numeral 2108 in FIG. 21 are disposed in the number of four, whereupon each of the generators 2108 latches and delivers only every corresponding fourth adjacent-dot polarity signal as shown at numeral 2101 in FIG. 21, in accordance with the clock 1702. An increased number of tones can be coped with in such a way that individual-tone display data generators for the voltage display mode as shown at numerals 1900~1907 in FIG. 19 are disposed for the tones based on the voltage display mode, while individual-tone display data generators for the FRC display mode as shown at numerals 2000~2007 in FIG. 20 are disposed for the tones based on the FRC display mode, the total number of the generators for both the display modes being equal to the increased tone number. As set forth above, according to the second embodiment of the present invention, the numbers of pixels in the two polarities based on the FRC display mode are substantially equalized every frame, so that the flickerless halftone displays can be realized irrespective of display patterns.

Now, the third embodiment of the present invention will be described.

Figure 28:
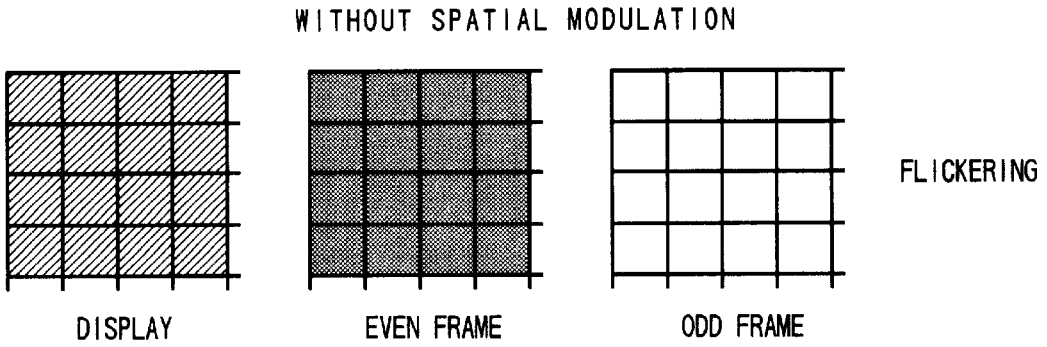
FIGS. 28(*a*) and 28(*b*) are diagrams for elucidating the principle of the FRC display mode.
Figure 28:
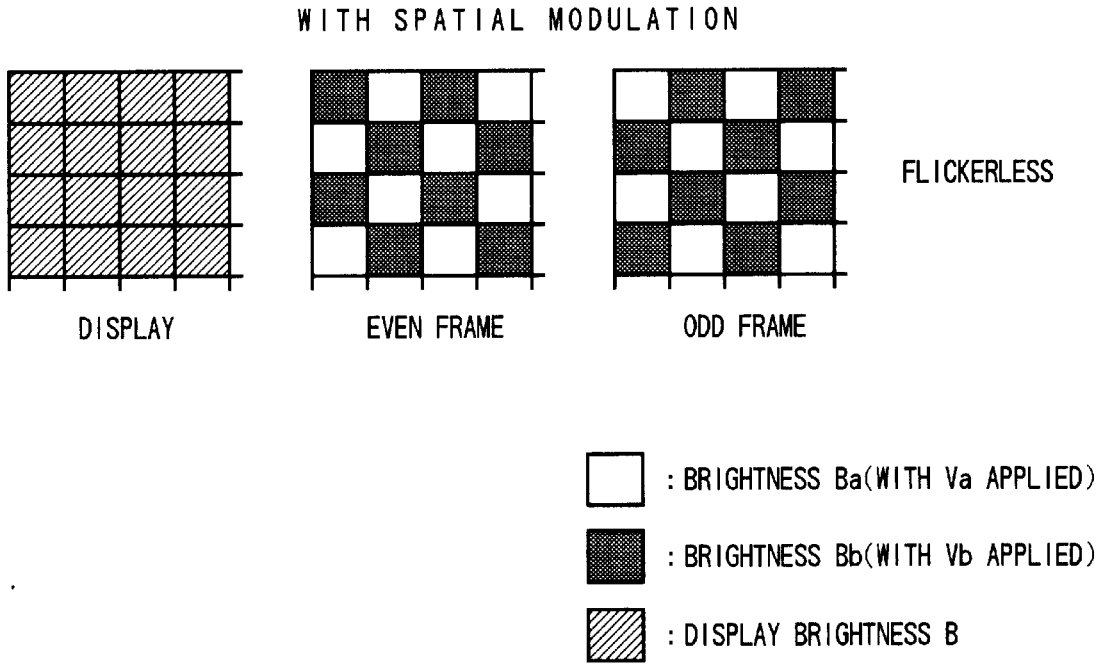

Each of FIGS. 28(*a*) and 28(*b*) illustrates display states in successive frames and a display state attained apparently on the occasion shown in FIG. 27 where the applied voltages Va and Vb are afforded in the successive frames every pixel of the liquid-crystal display system on the basis of the FRC display mode. FIG. 28(*a*) corresponds to a case where the applied voltages Va and Vb are afforded to all the pixels of the liquid-crystal display system at the same timings in synchronism with the frames. The apparent brightness B is attained in such a way that, in the even frame of the successive frames, the applied voltage Vb is afforded to all the pixels so as to exhibit the brightness Bb, while in the odd frame, the applied voltage Va is afforded to all the pixels so as to exhibit the brightness Ba. With this method, however, the whole screen of the liquid-crystal display system darkens and brightens repeatedly in the successive frames, so that flicker is seen. In order to avoid this drawback, spatial modulation as shown in FIG. 28(*b*) is performed. The spatial modulation in FIG. 28(*b*) suppresses the appearance of the flicker in such a way that the applied voltages of pixels adjoining one another vertically and laterally are made different in a certain frame, thereby to uniformalize the numbers of the pixels of the applied voltages Va and Vb which are afforded in the even frame and those of the pixels of the applied voltages Va and Vb which are afforded in the odd frame. In this manner, in the FRC display mode, multiple-tone displays (or polytonal displays) can be realized with the flicker suppressed by employing the spatial modulation. Such a spatial-modulation FRC display mode is realized in the second embodiment. It is implemented in line unit also in the first embodiment (as stated before, the dots at which the halftone data 1013 are used as they are, and the dots at which the halftone data 1013 are inverted are set depending upon the dot positions of one line, whereby the spatial modulation as shown in FIG. 28(*b*) is also possible).

Meanwhile, the inventors observed the phenomenon that, when the voltage difference between the applied voltages Va and Vb was widened in the spatial-modulation FRC display mode, the flicker having been suppressed by the spatial modulation appeared anew. Therefore, they conducted an experiment for revealing the relationship of the flicker with the applied liquid-crystal voltages Va and Vb, namely, the brightnesses Ba and Bb in the spatial-modulation FRC display mode.

The method etc. of the experiment will be explained below with reference to FIGS. 29 thru 32.

FIG. 29 lists the typical specifications of a liquid-crystal display system which was used in the experiment. As indicated in the figure, the number of pixels of the liquid-crystal display system is 640 dots×480 dots, the pixel pitch is 0.33 mm×0.33 mm, the response times of the rise and fall of the brightness are 50 msec. and 40 msec., respectively, the transmission factor is 5%, the number of tones is 8 (512 colors in case of a color display scheme), and the frame frequency is 70 Hz.

Figure 30:
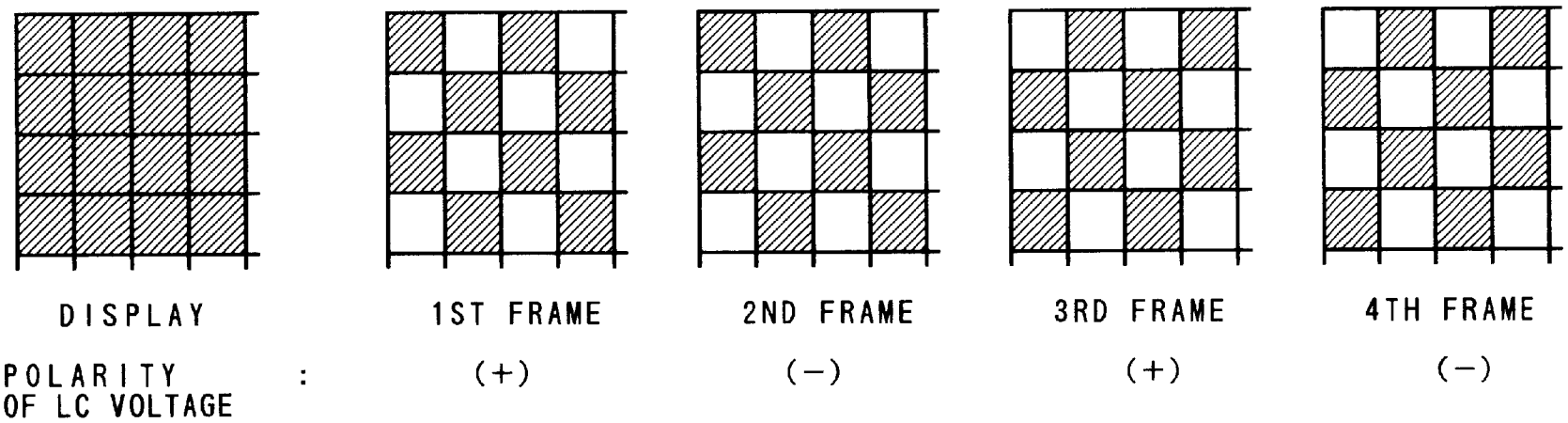
FIG. 30 is a diagram for explaining conditions for driving a liquid crystal on the basis of the FRC display mode.
Figure 31:
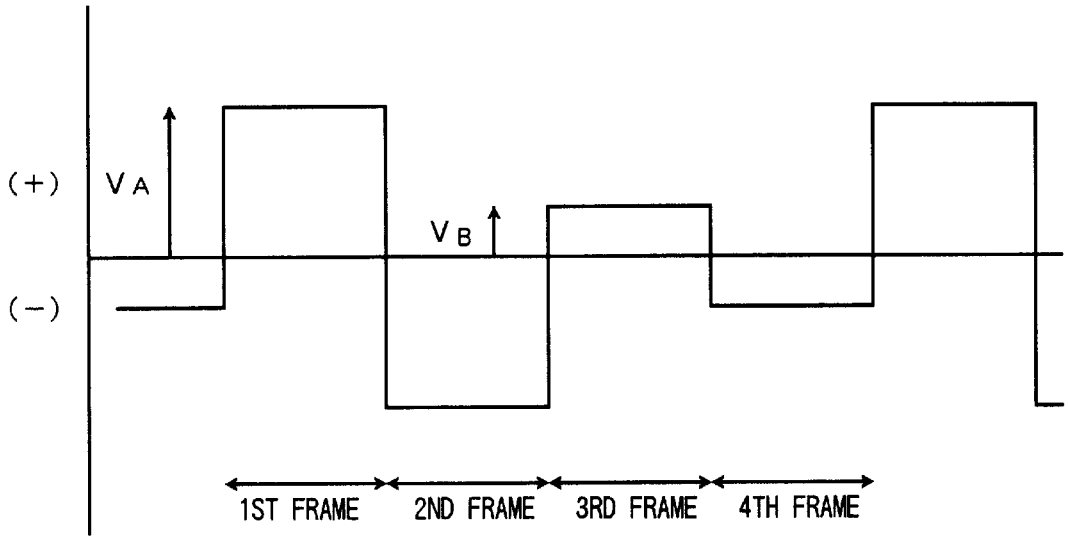
FIG. 31 is a diagram showing the waveform of an applied liquid-crystal voltage in the third embodiment of the present invention.

A liquid crystal deteriorates when a D.C. voltage is applied thereto for a long time. Therefore, an applied liquid-crystal voltage is alternated. Concretely, the alternation is effected by inverting the sign of the voltage which is applied to the liquid crystal every frame. However, applied voltages are changed-over in successive frames in order to realize multiple-tone displays even in the FRC display mode. In the experiment, therefore, the liquid crystal was subjected to the alternation in such a way that timings for changing-over the sign of the applied liquid-crystal voltage and the timings of the applied liquid-crystal voltages to be changed-over in the FRC display mode were held under liquid-crystal driving conditions as illustrated in FIG. 30. More specifically, the sign or polarity of the voltage to be applied to the liquid crystal was changed-over every frame so as to become alternate as (+), (−), (+) and (−). On the other hand, the applied liquid-crystal voltages to be changed-over in the FRC display mode were changed-over every two frames so as to afford the same applied voltage in the first and second frames and another same applied voltage, which is different from the applied voltage n the first and second frames, in the third and fourth frames. The timings of the voltages which are applied to each pixel of the liquid crystal under such liquid-crystal driving conditions, are illustrated in FIG. 31. The applied voltage becomes +Va in the first frame, and −Vb in the second frame. Besides, the applied voltage becomes +Vb in the third frame and −Vb in the fourth frame. As understood from FIG. 31, the D.C. voltages which are impressed on the liquid crystal are canceled in the first and second frames, and the D.C. voltages are canceled also in the third and fourth frames. Thus, the alternation and the FRC display mode are combined by setting the four frames as one cycle.

Figure 32:
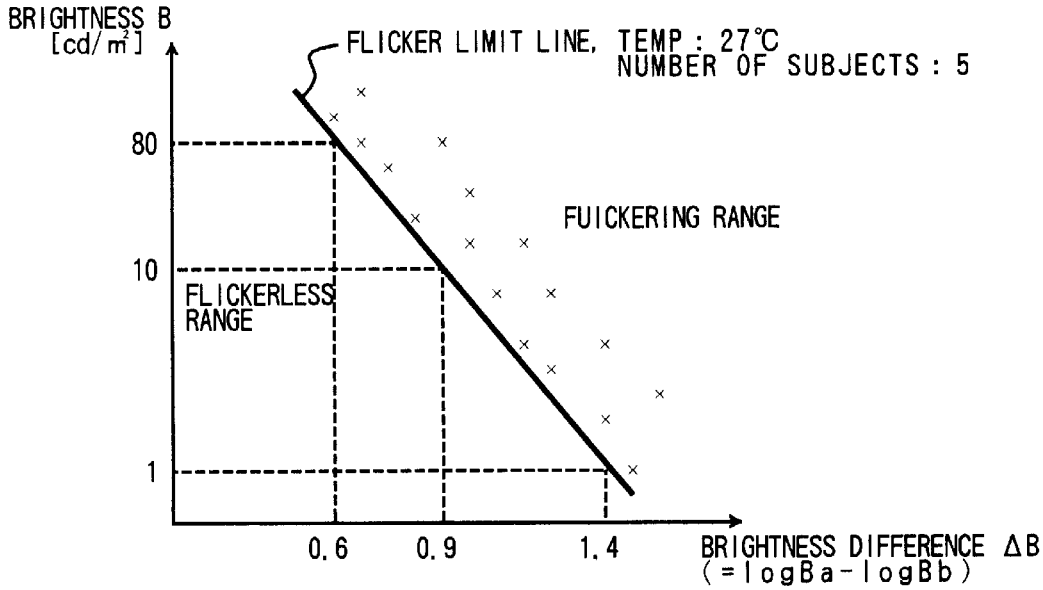
FIG. 32 is a graph showing a flicker limit characteristic in the third embodiment.

The flicker was examined under the liquid-crystal driving conditions as stated above. In the experiment, subjects checked the flicker with their eyes. The difference between the applied liquid-crystal voltages Va and Vb to be afforded in the FRC display mode was gradually widened until the flicker began to be seen with the eyes. There were measured the applied voltages Va and Vb at the time at which the flicker began to be seen, the brightnesses Ba and Bb corresponding respectively to the voltages Va and Vb, and the apparent brightness B. FIG. 32 is a graph in which the relations of the apparent brightness B with the difference ΔB (also termed the "FRC amplitude") between the brightnesses Ba and Bb thus obtained are plotted with marks x. In the graph of FIG. 32, the axis of abscissas represents the brightness difference ΔB (ΔB=|log Ba−log Bb|), while the axis of ordinates represents the apparent brightness B. The flickering was noted at the points indicated by the marks x. The flicker is seen in the range of an area in which the marks x are plotted and an area in which the values of the brightness difference ΔB are still greater. Accordingly, this range shall be called the "flickering range". On the other hand, the flickering is not noted in a range in which the values of the brightness difference ΔB are smaller than in the area of the marks x. Accordingly, this range shall be called the "flickerless range". The boundary between the flickerless range and the flickering range is the limit of the flicker, and this boundary shall be called the "flicker limit line". The flicker limit line is approximately expressed by a line which passes through the point of a brightness value B=80 cd/m$^2$ corresponding to a brightness difference value ΔB=0.6, the point of a brightness value B=10 cd/m$^2$ corresponding to a brightness difference value ΔB=0.9, and the point of a brightness value B=1 cd/m$^2$ corresponding to a brightness difference value ΔB=1.4. The range of the left side with respect to the flicker limit line, that is, the flickerless range is expressed by the following formula (1):

$$|\log Ba-\log Bb|<1.4-0.43\log B \quad (1)$$

Therefore, in the liquid-crystal display system in which the multiple-tone displays are to be presented by the liquid-crystal driving conditions and on the basis of the FRC display mode, favorable tone displays without the flickering can be realized by setting the applied liquid-crystal voltages so as to satisfy the inequality (1).

Incidentally, the flicker limit line fluctuates due to the fluctuations of the liquid-crystal driving conditions. In particular, the flickerless range is enlarged by the lowering of the the liquid-crystal response rate and the rise of the frame frequency which are attendant upon a temperature fall.

Figure 34:
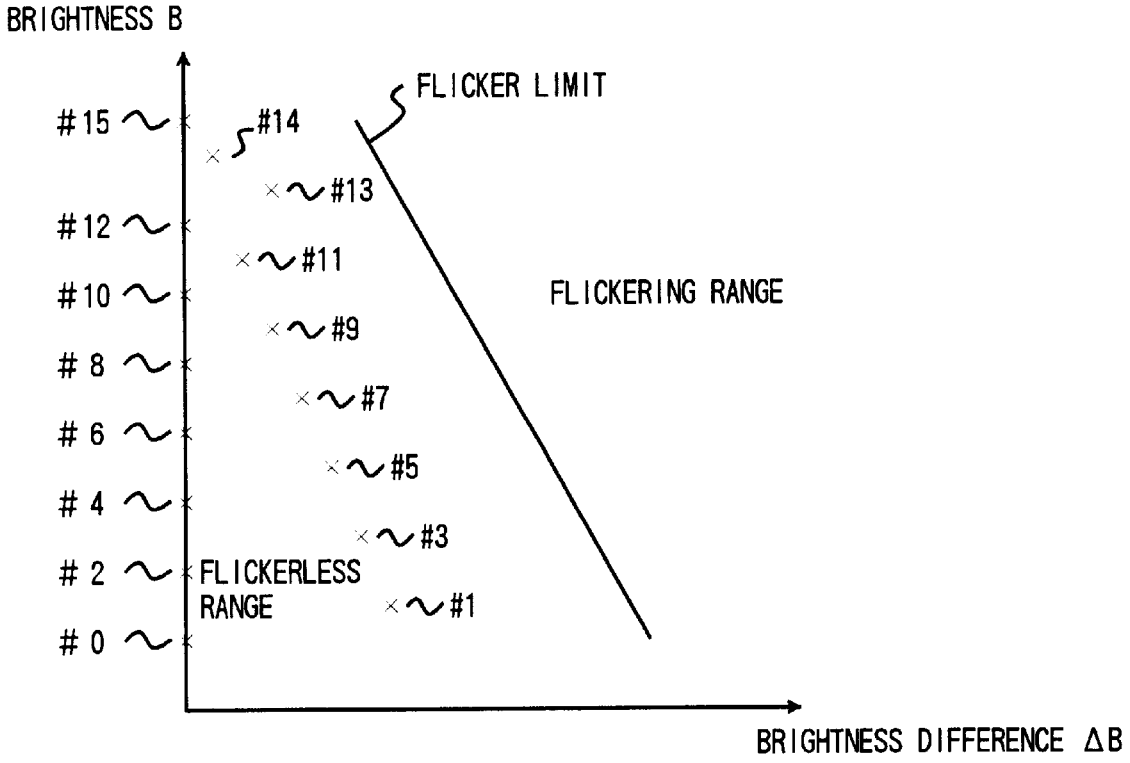
FIG. 34 is a graph showing the result of the setting of the flickerless 16 tones in the third embodiment.

FIGS. 33 and 34 illustrate an example in which a liquid-crystal display system of 8-tone (512-color) displays to 16-tone (4096-color) displays was realized by the use of the liquid-crystal panel specified in FIG. 29 and under the conditions mentioned above. FIG. 33 is a table for setting flickerless 16 tones. In order to present the 16 tones, the eight tones of tones #0, #2, #4, #6, #8, #10, #12 and #15 are attained by affording applied liquid-crystal voltages which are constant irrespective of frames, and the eight tones of tones #1, #3, #5, #7, #9, #11, #13 and #14 are attained by the FRC display mode in which the corresponding tone display is presented by changing-over applied liquid-crystal voltages in successive frames. In addition, since the liquid-crystal panel specified in FIG. 29 displays the eight tones, the applied liquid-crystal voltages of eight levels can be set for the tone displays. Accordingly, the 8-level applied voltages V0 thru V7 and the voltages to be applied to the liquid crystal for the respective tones are combined as listed in FIG. 33. Brightnesses at the respective tones are also listed in FIG. 33.

Regarding the liquid-crystal display system in which the 16 tones were set as stated above, FIG. 34 illustrates a graph in which the brightnesses B of the respective tones are plotted versus the brightness differences ΔB afforded in the successive frames, on the flicker limit characteristic shown in FIG. 32. As a result, all the tones lie within the flickerless range. Accordingly, the flickerless liquid-crystal display system can be realized by setting the 16 tones shown in FIG. 33.

The quantification of flicker based on a multiple regression analysis will be explained as a severer method. The multiple regression analysis clarifies factors thought to affect an objective event, and finds a formula expressive of the relations between the event and the factors. The objective event is called the "objective variable" which is denoted by y, and the factors thought to be influential are called the "explanatory variables" which are denoted by x1, x2, . . . , and xp (where p indicates the number of the explanatory variables). The objective variable y can be predicted by deriving the following relational formula from the explanatory variables:

$$y=a0+a1\ x1+a2\ x2+\ldots+ap\ xp$$

The multiple regression analysis itself is a well-known technique, and shall be omitted from detailed description.

Here, let's consider applying the multiple regression analysis to the quantification of the flicker on the basis of the results of the experiment in which the subjects checked the flickering in relation to the quantities ΔB and B. The flicker depends upon the frame frequency, the FRC amplitude ΔB and the display brightness B. Therefore, the objective variable y was set to be the proportion of persons who saw the flicker, and the explanatory variables were set to be the frame frequency, the FRC amplitude and the display brightness. With these settings, a formula for evaluating the objective variable y in conformity with the multiple regression analysis was calculated, and the contribution rate $R^2$ of this formula was computed. Then, $R^2$=69% was obtained. The contribution rate is a numerical value which indicates the propriety of the calculated formula, and the value of 69% cannot be said satisfactory. Therefore, the frame frequency was removed from the explanatory variables, and a formula for expressing the objective variable y in conformity with the multiple regression analysis was calculated again. More specifically, the formula was calculated for each of cases where the frame frequency was fixed to 70 Hz, 56 Hz and 90 Hz. Then, the proportions y of the persons who saw the flicker and the contribution rates $R^2$ at the respective frame frequencies became as follows:

For the frame frequency of 70 Hz;

$$y=0.003\ x2+1.399\ x1-0.699$$

$$R^2=84.8\%$$

For the frame frequency of 56 Hz;

$$y=0.001\ x2+1.068\ x1+0.056$$

$$R^2=88.7\%$$

For the frame frequency of 90 Hz;

$$y=0.003\ x2+0.430\ x1-0.235$$

$$R^2=78.5\%$$

In these formulae, x1=log Ba−log Bb and x2=B hold.

In order to establish a situation where none of the subjects sees the flicker, the explanatory variables x1 and x2 with which y=0 holds may be evaluated, but this requirement is too severe and is not practicable. In case of visually estimating an image quality in regard to the flicker or the like, the image quality may be deemed good when the proportion of persons who judge the image quality to be bad is less than 16%. Therefore, a flickerless FRC display mode can be realized by selecting the FRC amplitude ΔB and the display brightness B with which the y value at each of the frame frequencies becomes y<0.16 (16%).

Now, the fourth embodiment of the present invention will be described.

Figure 35:
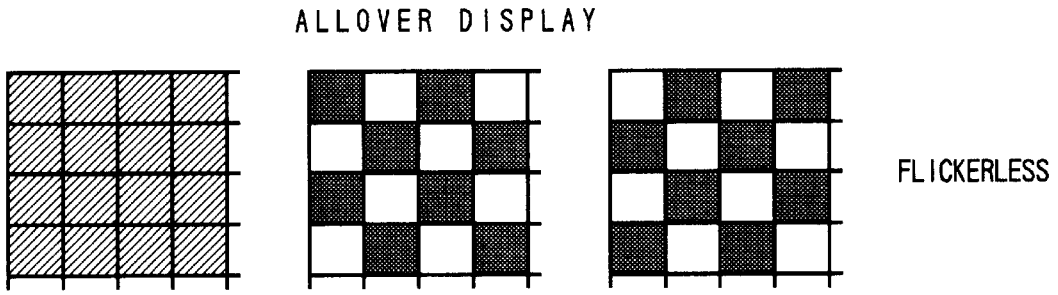
FIGS. 35(*a*) and 35(*b*) are diagrams for elucidating a mechanism in which flicker appears due to a specified display pattern in the fourth embodiment of the present invention.
Figure 35:
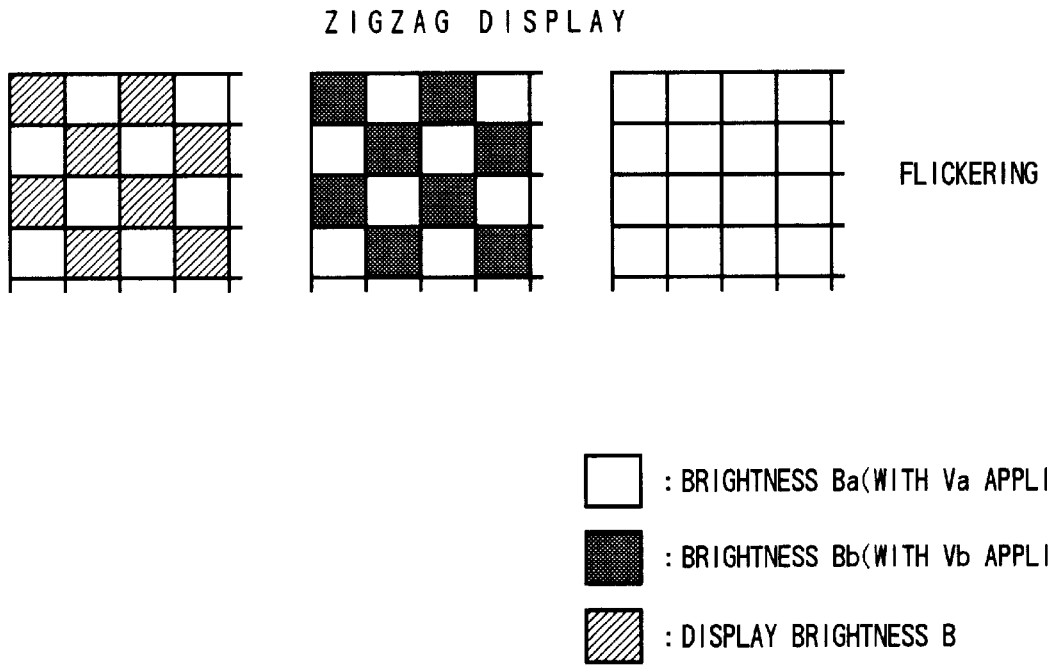

The fourth embodiment consists in a method of suppressing flicker which appears in a specific display pattern. In each of the foregoing embodiments, the FRC display mode is realized by the spatial modulation so as to prevent the liquid-crystal display system from flickering. Regarding the spatial modulation pattern, when an allover display of identical FRC tone as shown in FIG. 35(*a*) is considered, the pattern of an applied voltage in each of successive frames becomes a zigzag pattern. With such a spatial-modulation FRC technique, flicker appears anew in some specified display patterns. By way of example, in a case where the FRC display pattern is a zigzag pattern as shown in FIG. 35(*b*), the effect of suppressing the flicker owing to the spatial modulation is canceled, and the new flicker arises. In this regard, the inventors investigated those display patterns other than the zigzag pattern as to which the flicker appeared.

Figure 36:
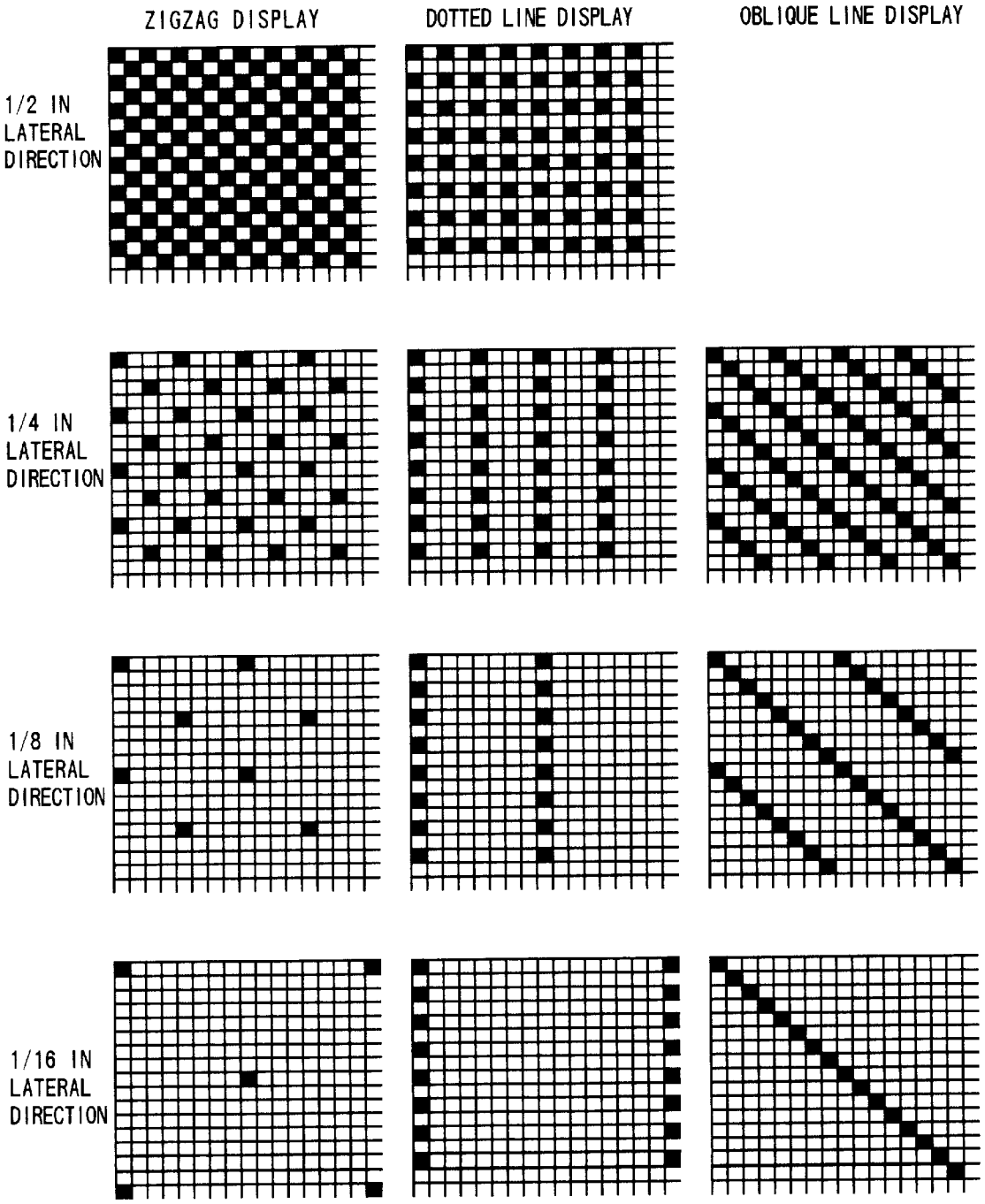
FIG. 36 is a diagram for explaining display patterns which might give rise to flicker in the fourth embodiment.

FIG. 36 illustrates typical display patterns which might incur the flicker on account of the above cause. More specifically, as the display patterns, a dotted line display and an oblique line display were presupposed besides the zigzag display. Regarding the fineness of each display pattern, there were presupposed display patterns in which the number of pixels in the FRC display mode was one relative to two pixels in the lateral direction of the display pattern (½ in the lateral direction), in which it was one relative to four pixels (¼ in the lateral direction), in which it was one relative to eight pixels (⅛ in the lateral direction), in which it was one relative to sixteen pixels (1/16 in the lateral direction), and so forth. As to all of these display patterns, subjects decided flickering with their eyes. By the way, in the decisions of the flickering, the specifications of a liquid-crystal panel, liquid-crystal driving conditions, etc. were the same as in the third embodiment, and the displays of 16 tones were presented in conformity with the flickerless 16-tone setting table shown in FIG. 33. Moreover, as the display patterns for the decisions, there were prepared, not only the black patterns having white backgrounds as depicted in FIG. 36, but also white patterns having black backgrounds, and patterns having various tones in combination.

FIG. 37 illustrates results which were obtained by judging the flickering under the conditions as mentioned above. The flickering was estimated in five stages, in which "5" was afforded to quite no flickering, "1" was afforded to the maximum flickering, and "4"~"2" were allotted to intermediate levels. As understood from FIG. 37, the flickering differs depending upon the display patterns and the numbers of the pixels in the FRC display mode. By way of example, when the pattern fineness was ½ in the lateral direction, the flicker appeared irrespective of the display patterns. It has also been revealed that the flickering differs depending upon the combinations of tones. Among the display patterns shown in FIG. 36, display patterns which were flickerless (exhibiting the decision result "4" or "5") irrespective of the tonal combinations were only the zigzag display in the case of the fineness of ⅛ in the lateral direction and the zigzag display, dotted line display and oblique line display in the case of the fineness of 1/16 in the lateral direction as illustrated in FIG. 38. That is, the four sorts of display patterns shown in FIG. 38 did not undergo the flickering even when the flicker suppressing effect based on the spatial modulation was canceled by the display patterns themselves. From the result, it has been revealed that, when the specifications of the liquid-crystal panel and the liquid-crystal driving conditions are adopted, some display patterns undergo no flickering even with the pattern fineness of ⅛ in the lateral direction, but that the pattern fineness needs to be 1/16 or less in the lateral direction in order to prevent all the display patterns from undergoing the flickering. In other words, it has been revealed that flickerless multiple-tone displays (polytonal displays) can be realized when the number of the FRC tone pixels is at the proportion of one to 16 pixels in the lateral direction.

A case where the above results are applied to the second embodiment of the present invention, will be described below as the fourth embodiment. In the second embodiment, the flickerless multiple-tone displays have been realized in the way that, when the data to be changed-over in the successive frames as to each FRC tone are denoted by α and β (FIG. 25), the data α and β are alternately allotted to the successive pixels of the FRC tone on one line. That is, the numbers of the data α and β have been substantially equalized on one certain line of the liquid-crystal panel. In this regard, the decided result of the flickering dependent upon display patterns implies that no flicker appears in a case where the numbers of the data α and β differ at the rate of substantially one to at least 16 pixels in the lateral direction. In the fourth embodiment, accordingly, the processing of the second embodiment is simplified from the viewpoint of the implied fact.

Figure 39:
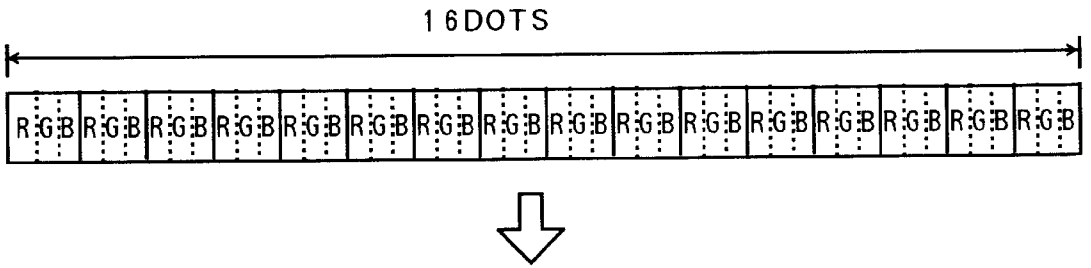
FIGS. 39(*a*) thru 39(*h*) are diagrams for elucidating a flickerless spatial modulation mode in the fourth embodiment.
Figure 39:
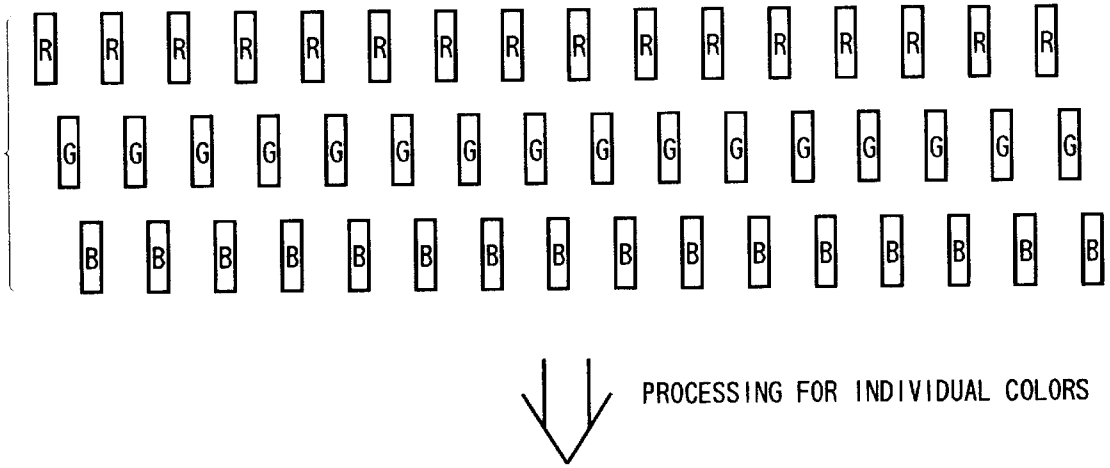
Figures 39C, 39D, 39E:
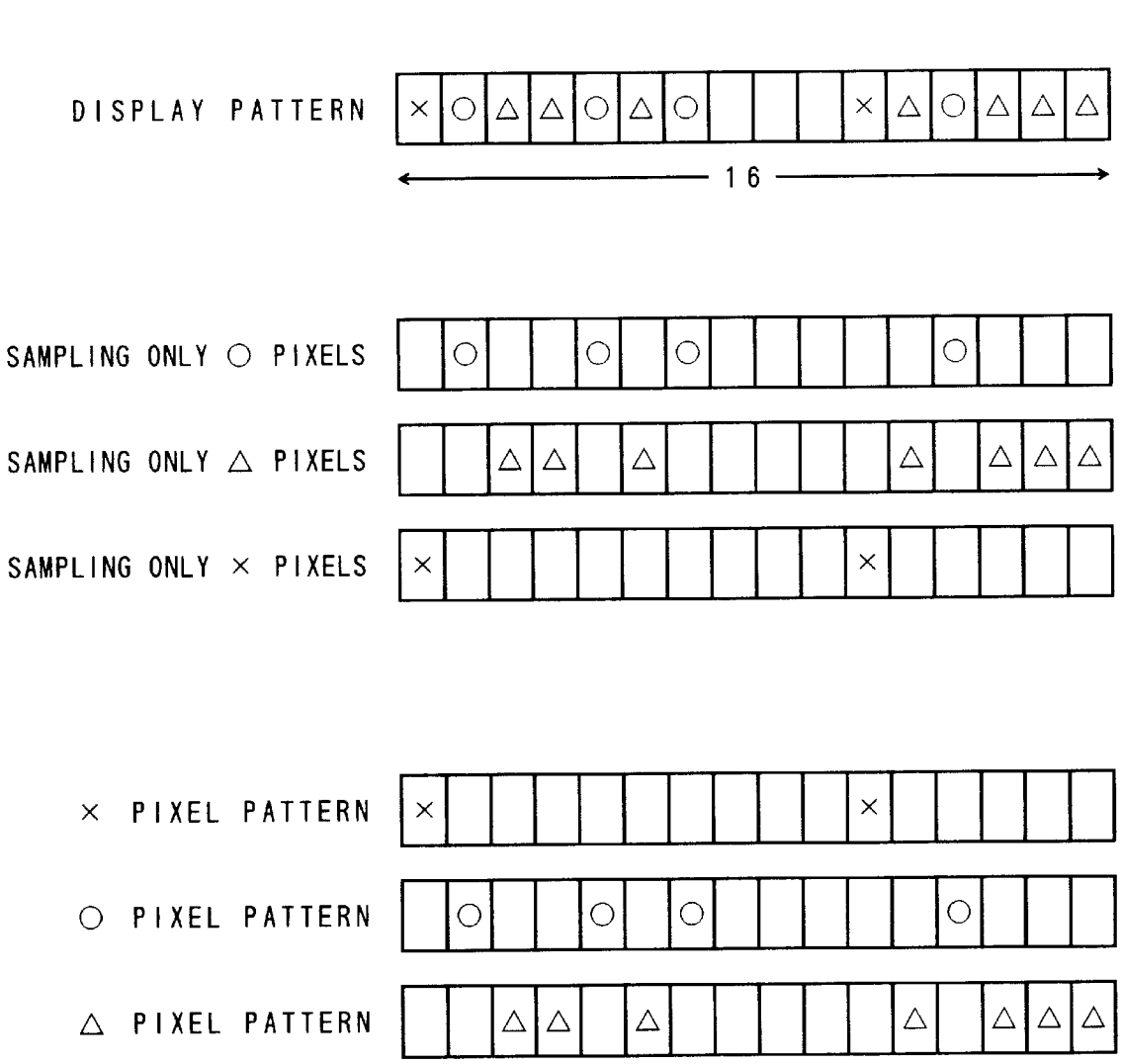
Figure 39F:
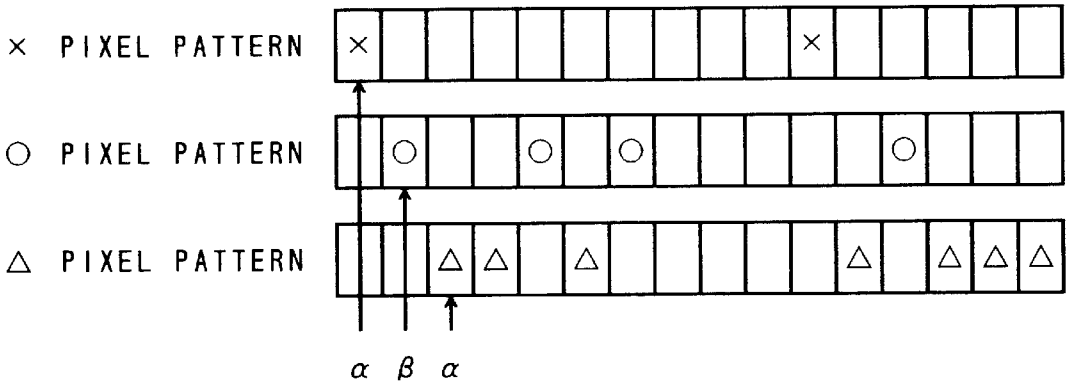
Figure 39G:
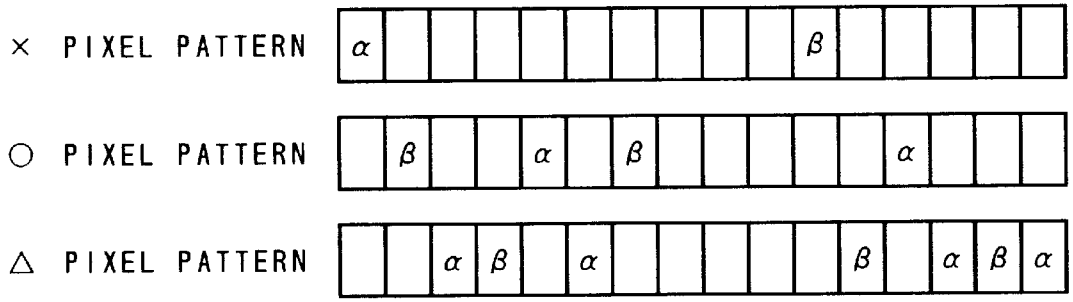
Figure 39:
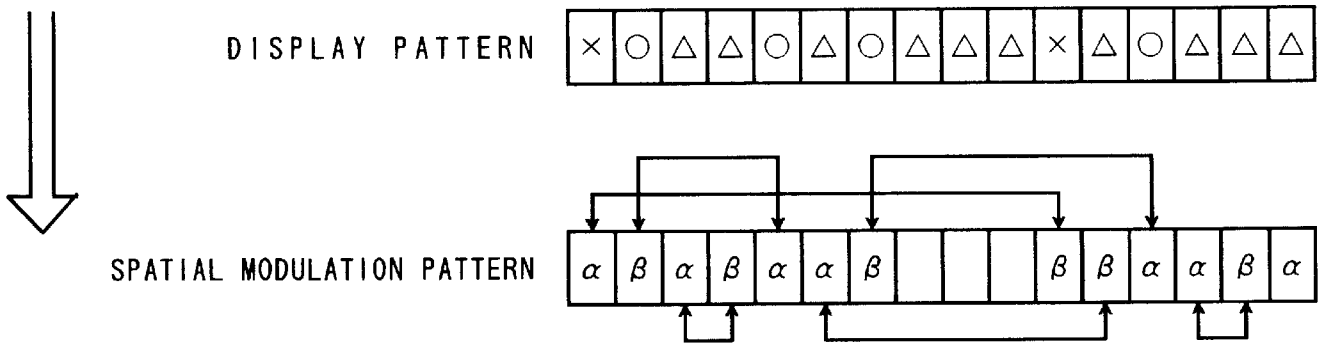

According to the fourth embodiment, a liquid-crystal display system of flickerless multiple-tone displays adopts a flickerless spatial modulation method illustrated in FIGS. 39(*a*)~39(*h*). Although a color display scheme is referred to in the illustrated example, this embodiment is also applicable to a monochromatic multiple-tone display scheme. First, note is taken of the pixels of 16 dots in the lateral direction of the liquid-crystal panel as shown in FIG. 39(*a*). Subsequently, the pixels of the 16 dots are decomposed into individual colors R, G and B as shown in FIG. 39(*b*). Thenceforth, processes shown in FIGS. 39(*c*) thru 39(*h*) are performed for the individual colors. As to the R color by way of example, in a case where o pixels, Δ pixels and x pixels have tones different from one another and are to be displayed by the FRC display mode as shown in FIG. 39(*c*), patterns are sampled for the individual tones as shown in FIG. 39(*d*). Subsequently, as shown in FIG. 39(*e*), the pixel patterns are arrayed in the order in which the sampled pixels are closer to the left end of the display pattern. Further, as shown in FIG. 39(*f*), the data α and β are alternately allocated to the head (leftmost) pixels of the arrayed pixel patterns. By way of example, the data α is allocated to the leftmost pixel of the x pixel pattern, the data β is allocated to the leftmost pixel of the succeeding o pixel pattern, and the data α is allocated to the leftmost pixel of the still succeeding Δ pixel pattern. Next, the data α and β are alternately allocated for the individual tones as shown in FIG. 39(*g*). In the x pixel pattern, the first x pixel has the data α, so that the next x pixel is endowed with the data β. Besides, in the o pixel pattern, the first o pixel has the data β, so that the next o pixel is endowed with the data α, whereupon the data β and α are successively iterated. Also, in the Δ pixel pattern, the first Δ pixel has the data α, so that the next Δ pixel is endowed with the data β, whereupon the data α and β are successively iterated. The patterns of the data α and β thus set for the individual tones are combined into an FRC spatial-modulation pattern as shown in FIG. 39(*h*). In this embodiment, as to each tone, the numbers of the data α and β are sometimes unequal, but the difference between the numbers becomes at most 1 at a high probability. Conversely, the difference becomes 2 or more at a lower frequency. On the other hand, from the decided result of the flickering dependent upon display patterns as stated before, it has been revealed that no flicker appears as to the display pattern in which the difference is one or less relative to at least 16 pixels in the lateral direction. Therefore, this embodiment can offer the liquid-crystal display system capable of flickerless multiple-tone displays. With this embodiment, only display patterns having at least 16 dots in the lateral direction may be noticed, and the flickerless multiple-tone displays can be realized by a simpler system architecture of smaller scale.

As set forth above, according to the fourth embodiment of the present invention, the multiple-tone displays of little flicker can be realized irrespective of display patterns.

Now, the fifth embodiment of the present invention will be described. When a D.C. voltage is applied to a liquid crystal for a long time, the liquid crystal deteriorates. Therefore, the so-called alternation of a liquid-crystal (LC) drive signal is performed as referred to in the description of the third embodiment. In this embodiment, however, flicker is suppressed by applying the D.C. voltage to the liquid crystal for a very short time to the extent that the liquid crystal is not degraded.

Figure 40:
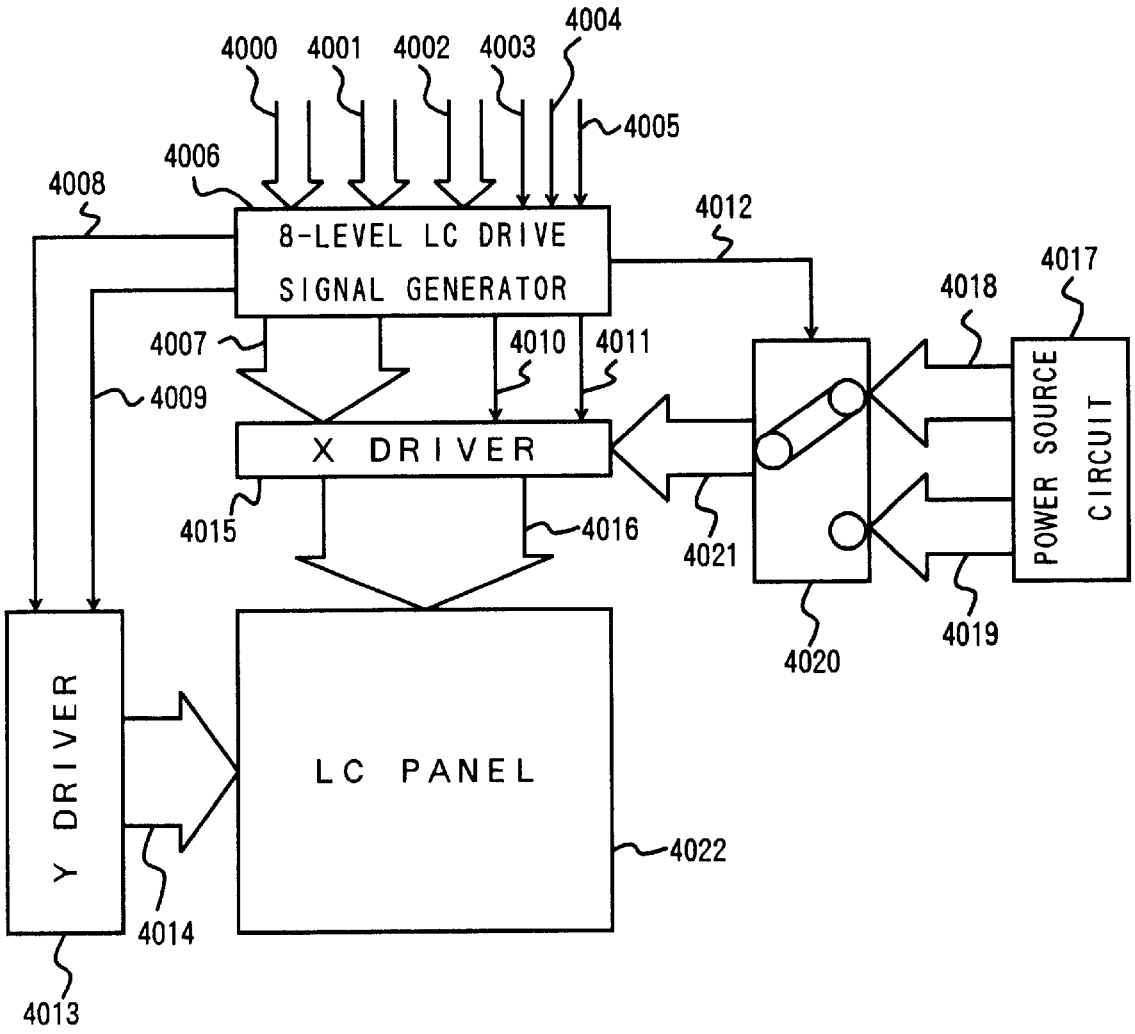
FIG. 40 is a block diagram showing a liquid-crystal display system which is the fifth embodiment of the present invention.

First, the construction of the embodiment shown in FIG. 40 thru FIGS. 49(*a*)~49(*c*) will be outlined. FIG. 40 illustrates an example of a circuit arrangement which realizes a method of driving a liquid-crystal display system according to the present invention. Referring to the figure, numeral 4000 denotes a red (hereinbelow, also termed "R") signal among the display data of interface signals, numeral 4001 a green (hereinbelow, also termed "G") signal, and numeral 4002 a blue (hereinbelow, also termed "B") signal. Each of the signals 4000~4002 is an input of 4 bits. An 8-level LC drive signal generator 4006 generates display data for a liquid crystal, 4007 and liquid-crystal display system drive signals to be stated later. Shown at numeral 4012 is a liquid-crystal alternating clock. Numeral 4015 denotes an X (axial direction) driver, and numeral 4016 one-line data. A power source circuit 4017 produces 8-level LC drive supply voltages on a plus side, 4018 and 8-level LC drive supply voltages on a minus side, 4019. Numeral 4020 represents a voltage selector, which selects any of X driver supply voltages 4021. Numeral 4022 denotes a liquid-crystal panel.

Figure 41:
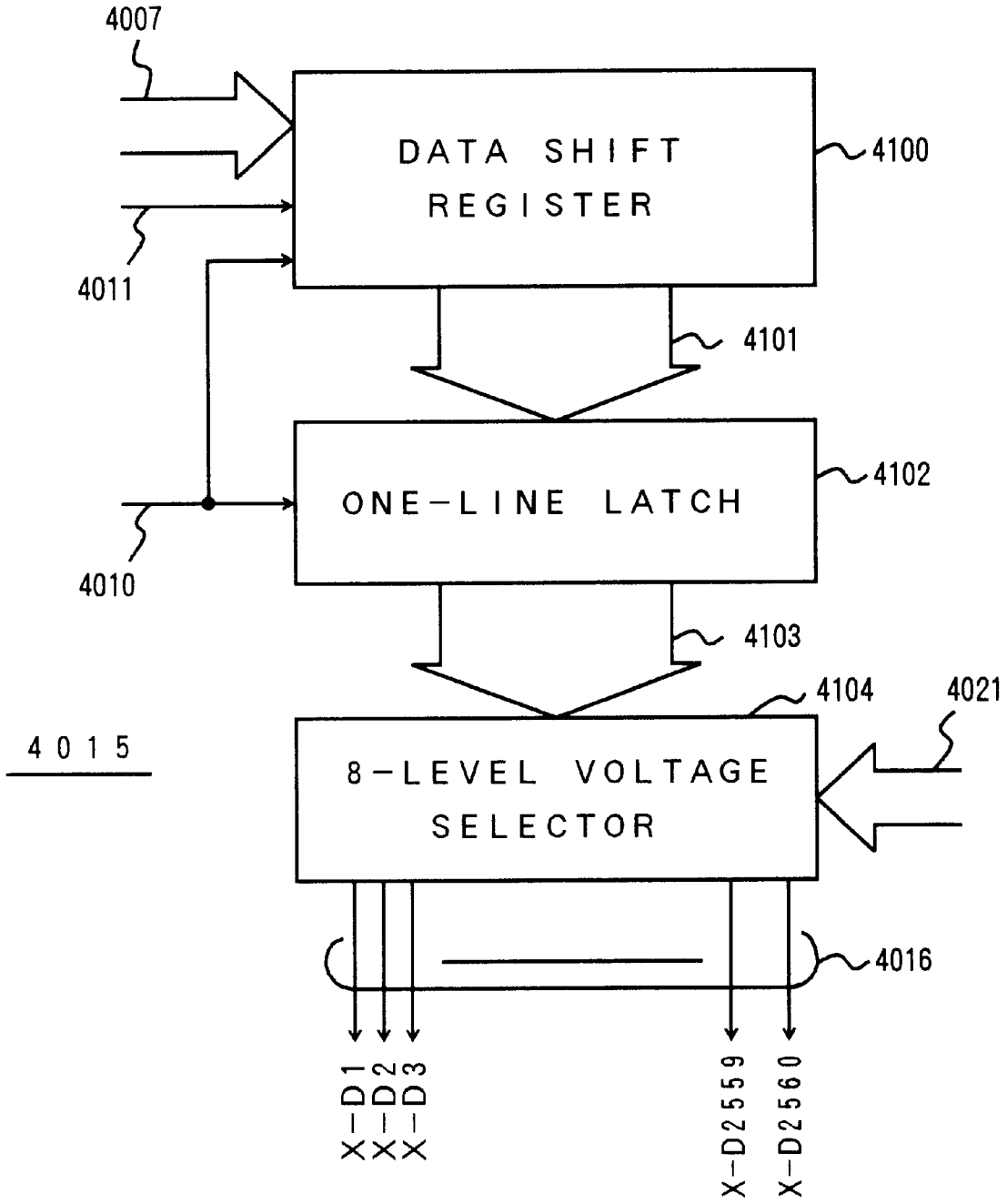
FIG. 41 is a block diagram of an X driver illustrated in FIG. 40.

FIG. 41 is a block diagram of the X driver 4015 shown in FIG. 40. Referring to FIG. 41, numeral 4100 denotes a data shift register which accepts the LC display data 4007 for one line in accordance with a data shift clock 4011, and the output shift data of which are shown at numeral 4101. Numeral 4102 denotes a one-line latch which latches the shift data 4101 in accordance with a horizontal clock 4010, and the output display data of which are shown at numeral 4103. An 8-level voltage selector 4104 selects any of the applied LC voltages of 8 levels.

Figure 43:
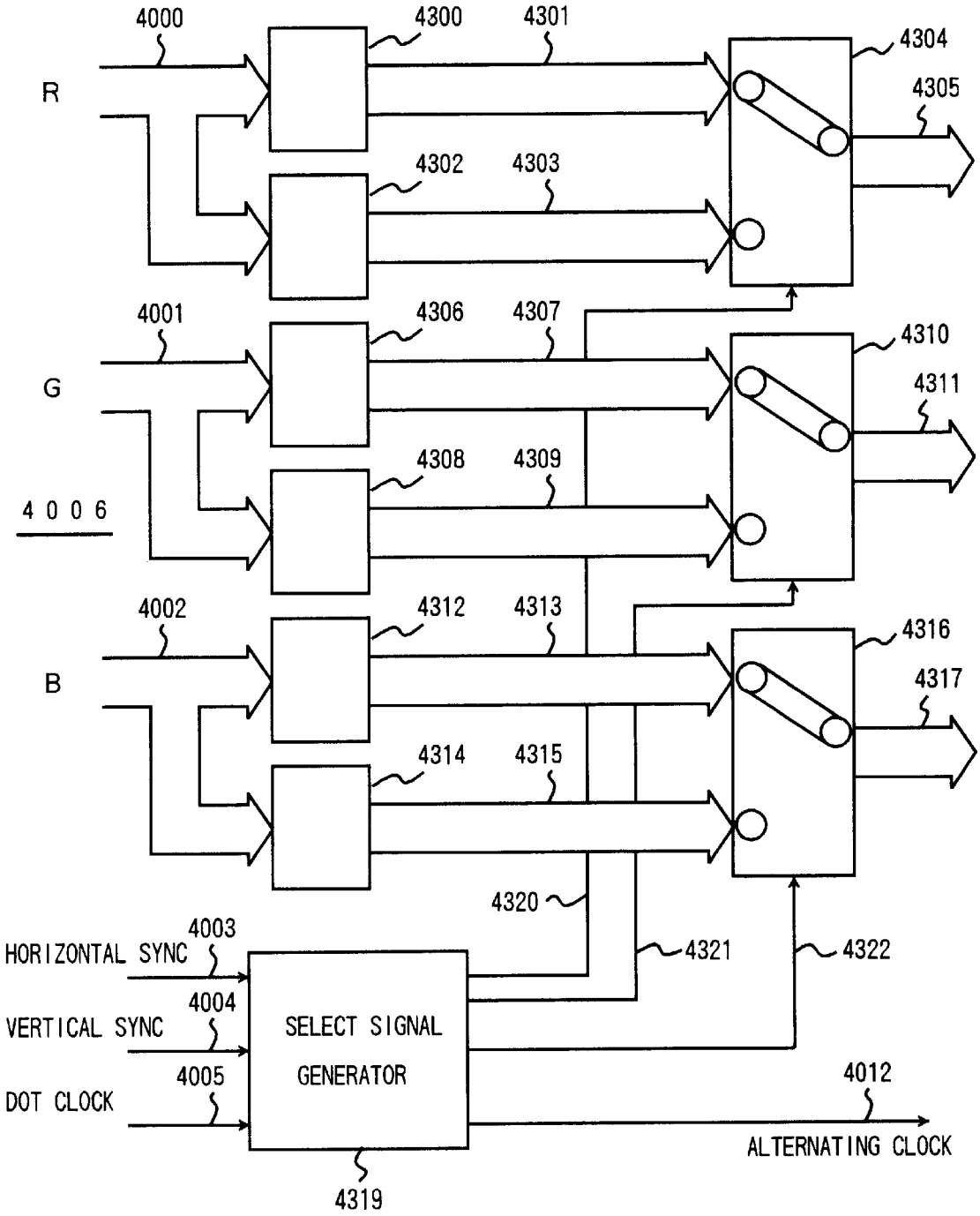
FIG. 43 is a block diagram of an 8-level liquid-crystal drive signal generator illustrated in FIG. 40.

FIG. 43 is a block diagram of the LC drive signal generator 4006 shown in FIG. 40. Referring to FIG. 43, numeral 4300 denotes a first decoder which weights the red signal 4000 among the display data, thereby to produce first decode data 4301. Numeral 4302 denotes a second decoder which weights the red signal 4000, thereby to produce second decode data 4303. A selector 4304 selects either of the first decode data 4301 and the second decode data 4303 so as to deliver LC display data 4305. In addition, numeral 4306 denotes a first decoder which weights the green signal 4001 among the display data, thereby to produce first decode data 4307. Numeral 4308 denotes a second decoder which weights the green signal 4001, thereby to produce second decode data 4309. A selector 4310 selects either of the first decode data 4307 and the second decode data 4309 so as to deliver LC display data 4311. Besides, numeral 4312 denotes a first decoder which weights the blue signal 4002 among the display data, thereby to produce first decode data 4313. Numeral 4314 denotes a second decoder which weights the blue signal 4002, thereby to produce second decode data 4315. A selector 4316 selects either of the first decode data 4313 and the second decode data 4315 so as to deliver LC display data 4317. A select signal generator 4319 generates select control signals for the respective selectors 4304, 4310 and 4316 and the alternating clock 4012 from a horizontal sync signal 4003, a vertical sync signal 4004 and a dot clock 4005. The select control signal for the selector 4304 is denoted by numeral 4320, the select control signal for the selector 4310 is denoted by numeral 4321, and the select control signal for the selector 4316 is denoted by numeral 4322.

FIG. 44 illustrates weighting controls for the LC display data 4305 as based on the decode controls of the red signal 4000 through the decoders 4300 and 4302 of the LC drive signal generator 4006 shown in FIG. 43.

FIG. 45 illustrates weighting controls for the LC display data 4311 as based on the decode controls of the green signal 4001 through the decoders 4306 and 4308 of the LC drive signal generator 4006 shown in FIG. 43.

FIG. 46 illustrates weighting controls for the LC display data 4317 as based on the decode controls of the blue signal 4002 through the decoders 4312 and 4314 of the LC drive signal generator 4006 shown in FIG. 43.

Figure 47:
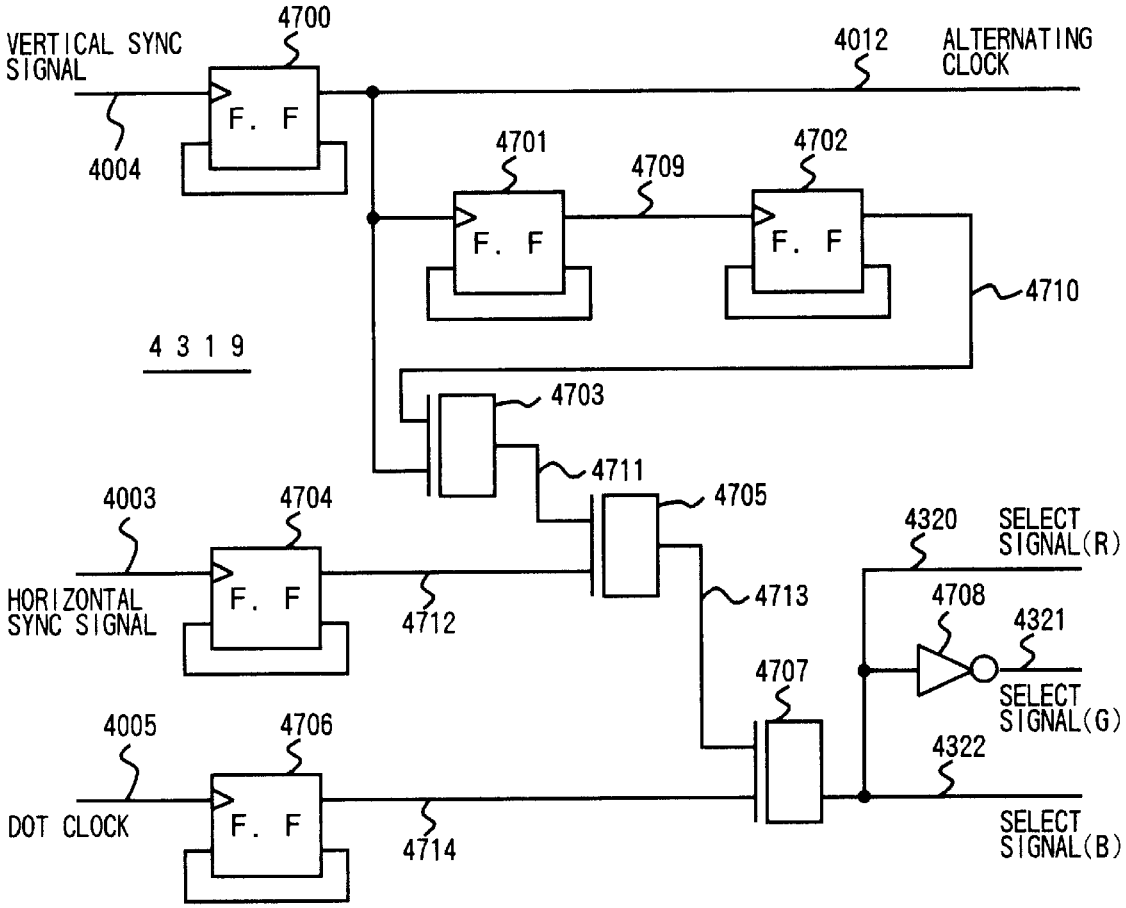
FIG. 47 is a circuit diagram of a select signal generator according to the fifth embodiment.

FIG. 47 illustrates an example of the circuit arrangement of the select signal generator 4319 shown in FIG. 43. Referring to FIG. 47, a flip-flop 4700 divides the frequency of the vertical sync signal 4004, thereby to generate the LC alternating clock 4012 which is inverted every frame. Another flip-flop 4701 further divides the frequency of the LC alternating clock 4012 inverted every frame, thereby to generate a signal 4709 which is inverted every second frame. Still another flip-flop 4702 further divides the frequency of the signal 4709 inverted every second frame, thereby to generate a signal 4710 which is inverted every fourth frame. An EXOR circuit 4703 receives the LC alternating clock 4012 inverted every frame and the signal 4710 inverted every fourth frame, and generates a signal 4711 which is inverted every fourth frame and every frame. A flip-flop 4704 divides the frequency of the horizontal sync signal 4003 so as to generate a signal 4712 which is inverted every line. Another flip-flop 4706 generates a signal 4714 by dividing the frequency of the dot clock 4005. An EXOR circuit 4705 receives the signal 4711 inverted every fourth frame and every frame and the signal 4712 inverted every line, and generates a signal 4713 which is inverted every fourth frame, every frame and every line. A succeeding EXOR circuit 4707 generates the select signals 4320 and 4322 by receiving the frequency division signal 4714 and the signal 4713 inverted every fourth frame, every frame and every line. A NOT circuit 4708 inverts the select signal 4320, thereby to generate the select signal 4321.

The operation of the embodiment of the liquid-crystal display system constructed as described above, will be explained by reference to the drawings again.

Referring to FIG. 40, the LC drive signal generator 4006 generates the LC drive signals from the horizontal sync signal 4003, vertical sync signal 4004 and dot clock 4005 which are the synchronizing signals of interface signals. Also, it generates the LC display data 4007 as to which each color has 3 bits being the information width of the X driver 4015 for each pixel, from the red signal 4000, green signal 4001 and blue signal 4002 of the display data being input with 4 bits for each color. Incidentally, there will be detailed later a method in this embodiment for generating the LC display data of 3 bits from the red signal 4000, green signal 4001 and blue signal 4002 which are the input display data of 4 bits.

The power source circuit 4017 delivers the LC drive supply voltages 4018 of eight levels on the plus side and the LC drive supply voltages 4019 of eight levels on the minus side. Then, the X driver supply voltages 4021 selected in accordance with the LC alternating clock 4012 by the voltage selector 4020 are supplied to the X driver 4015. The deterioration of the liquid crystal is prevented by impressing the plus and minus drive voltages on the LC pixels.

The horizontal clock 4010, data shift clock 4011 and LC display data 4007 are afforded to the X driver 4015 together with the X driver supply voltages 4021. As illustrated in FIG. 41, the data shift register 4100 of the X driver 4015 accepts the LC display data 4007, which have been generated by the LC drive signal generator 4006 shown in FIG. 40 and which have 3 bits for each color, for one line in one horizontal period and delivers the accepted data as the one-horizontal-line data 4101 in accordance with the data shift clock 4011. The one-horizontal-line data 4101 are latched in the one-line latch 4102 and then delivered as the display data 4103 of 3 bits for each color in accordance with the horizontal clock 4010. In the 8-level voltage selector 4104, the LC drive supply voltages conforming to the 3-bit display data 4103 are selected from among the X driver supply voltages of eight levels 4021 being input to this selector, whereupon the one-line data 4016 are output to the liquid-crystal panel 4022. Thus, each of data lines X-D1~X-Dm for the one-line data 4016 can deliver any of the LC drive voltages of eight levels on the plus side and the LC drive voltages of eight levels on the minus side. The display colors of the multiple tones (multiple colors) are attained by utilizing the differences of the amplitudes of the applied voltages.

Figure 42:
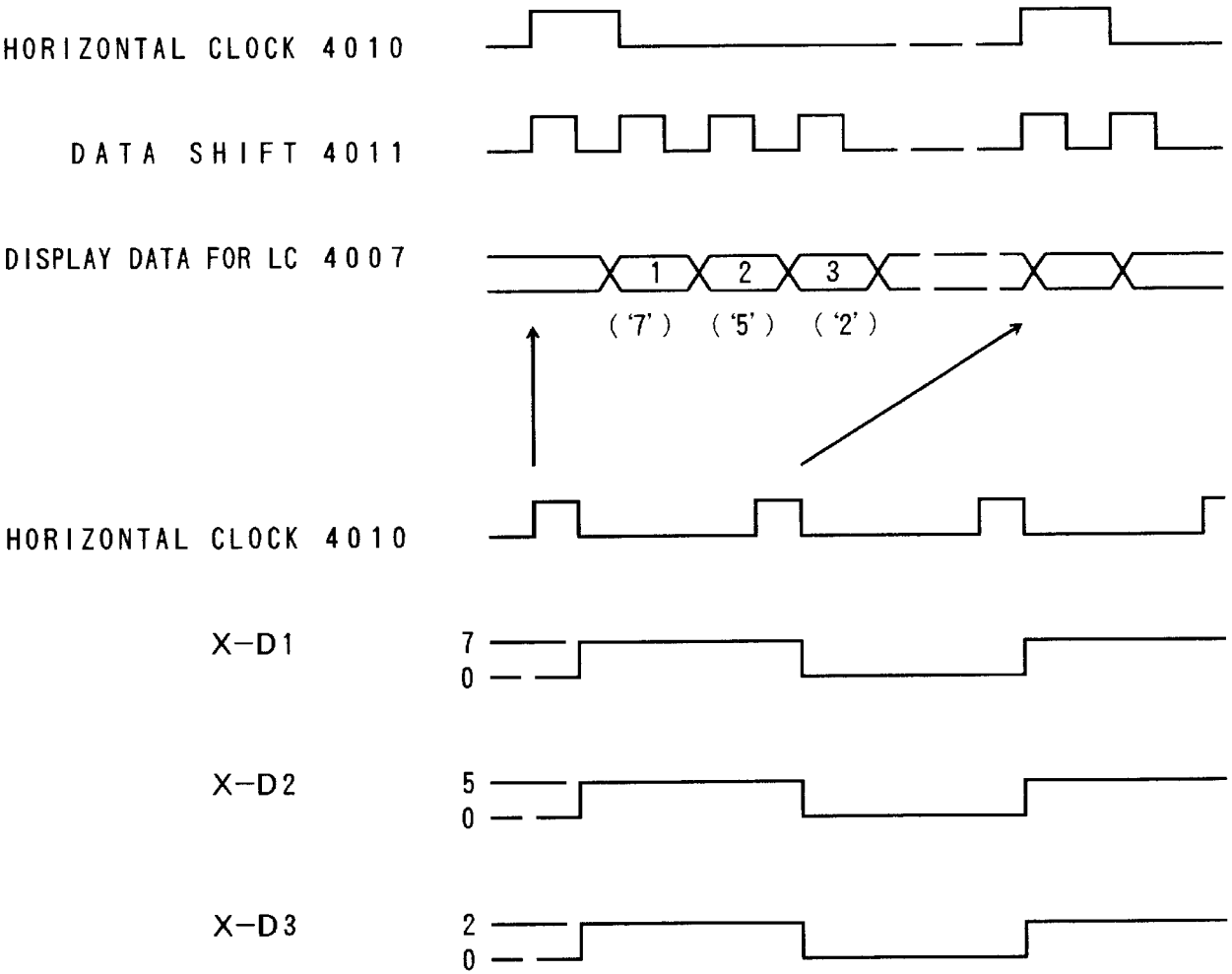
FIGS. 42(*a*) thru 42(*g*) are diagrams of the operating waveforms of the X driver illustrated in FIG. 41.

The operating waveforms of the X driver 4015 are illustrated in FIGS. 42(*a*)~42(*g*). The horizontal clock shown in FIGS. 42(*a*) and 42(*d*) is a clock whose pulses are generated at the rate of one in each horizontal scan period in a display frame. The data shift clock 4011 shown in FIG. 42(*b*) is a clock which has a pulse recurrence frequency far higher than that of the horizontal clock 4010. The LC display data 4007 shown in FIG. 42(*c*) are accepted into the data shift register 4100 in synchronism with the data shift clock 4011. The accepted LC display data 4007 are delivered as the one-line data 4016 successively within one horizontal period in synchronism with the horizontal clock 4010. The one-line data 4016 thus delivered are displayed on a line of "1" among the outputs 4014 of a Y driver 4013 (refer to FIG. 40). Herein, a line start clock 4008 and a vertical shift clock 4009 are afforded to the Y driver 4013 by the 8-level LC drive signal generator 4006, and the LC display data 4007 are displayed on the LC panel 4022. By way of example, let's consider a situation where the LC display data 4007 of a certain line are "7" at the first dot, "5" at the second dot and "2" at the third dot as shown in FIG. 42(*c*). In this situation, as seen from FIGS. 42(*d*)~42(*g*), the data line X-D1 for the one-line data 4016 is fed with the LC drive supply voltage corresponding to the case where the first data value of the LC display data 4007 is "7", the data line X-D2 is fed with the LC drive supply voltage corresponding to the case where the second data value of the LC display data 4007 is "5", and the data line X-D3 is fed with the LC drive supply voltage corresponding to the case where the third data value of the LC display data 4007 is "2".

Next, the operation of the 8-level LC drive signal generator 4006 which is the principal portion of the present invention will be explained in detail. As illustrated in FIG. 43, the 4-bit red data 4000 being the interface signal is input to the first decoder 4300 and the second decoder 4302 so as to be respectively converted into the 8-level LC display data 4301 and 4303 in accordance with the processing contents shown in FIG. 44. By way of example, when the red data 4000 is "15", the first decoder 4300 delivers "7", and the second decoder 4302 delivers "7". Besides, when the red data 4000 is "14", the first decoder 4300 delivers "6", and the second decoder 4302 delivers "7". Thenceforth, the first decoder 4300 and the second decoder 4302 similarly deliver the LC display data of 8 levels 4301 and 4303 in response to the red data of 16 levels 4000 in conformity with the corresponding relations shown in FIG. 44, respectively. Likewise, the 4-bit green data 4001 is input to the first decoder 4306 and the second decoder 4308 so as to be respectively converted into the 8-level LC display data 4307 and 4309 in accordance with the processing contents shown in FIG. 45. By way of example, when the green data 4001 is "15", the first decoder 4306 delivers "7", and the second decoder 4308 delivers "7". Besides, when the green data 4001 is "14", the first decoder 4306 delivers "6", and the second decoder 4308 delivers "7". Thenceforth, the first decoder 4306 and the second decoder 4308 similarly deliver the LC display data of 8 levels 4307 and 4309 in response to the green data of 16 levels 4001 in conformity with the corresponding relations shown in FIG. 45, respectively. Likewise, the 4-bit blue data 4002 is input to the first decoder 4312 and the second decoder 4314 so as to be respectively converted into the 8-level LC display data 4313 and 4315 in accordance with the processing contents shown in FIG. 46. By way of example, when the blue data 4002 is "15", the first decoder 4312 delivers "7", and the second decoder 4314 delivers "7". Besides, when the blue data 4002 is "14", the first decoder 4312 delivers "6", and the second decoder 4314 delivers "7". Thenceforth, the first decoder 4312 and the second decoder 4314 similarly deliver the LC display data of 8 levels 4313 and 4315 in response to the blue data of 16 levels 4002 in conformity with the corresponding relations shown in FIG. 46, respectively.

Either of the LC display data 4301 and 4303 is selected in accordance with the select signal 4320 by the selector 4304, and is delivered as the LC display data 4305. Also, either of the LC display data 4307 and 4309 is selected in accordance with the select signal 4321 by the selector 4310, and it is delivered as the LC display data 4311. Likewise, either of the LC display data 4313 and 4315 is selected in accordance with the select signal 4322 by the selector 4316, and it is delivered as the LC display data 4317.

In the select signal generator 4319, the LC alternating clock 4012 is inverted every frame. The select signals 4320, 4321 and 4322 are inverted every frame, every line and every dot in the initial four frames, and they become the inverted signals of such signals in the next four frames. Thenceforth, these changes are repeated.

The select signals 4320, 4321 and 4322 thus generated are respectively input to the selectors 4304, 4310 and 4316, whereby any of the first decoder outputs and the second decoder outputs is selected. In a case where the first decoder output and the second decoder output are equal, the LC drive supply voltage conforming to the pertinent data is afforded as the LC display data, whereby LC display brightnesses of 8 levels can be attained altogether. On the other hand, in a case where the first and second decoder outputs are unequal, the LC drive supply voltages conforming to the respective outputs are changed-over and afforded as the LC display data, whereby a brightness level intermediate between brightnesses corresponding to the supply voltages is attained, and LC display brightnesses of further 8 levels can be attained altogether. Eventually, LC display brightnesses of 16 levels in total can be attained.

Those signals of various parts which are generated by the circuit arrangement as stated above will be explained with reference to FIG. 48.

Figure 48:
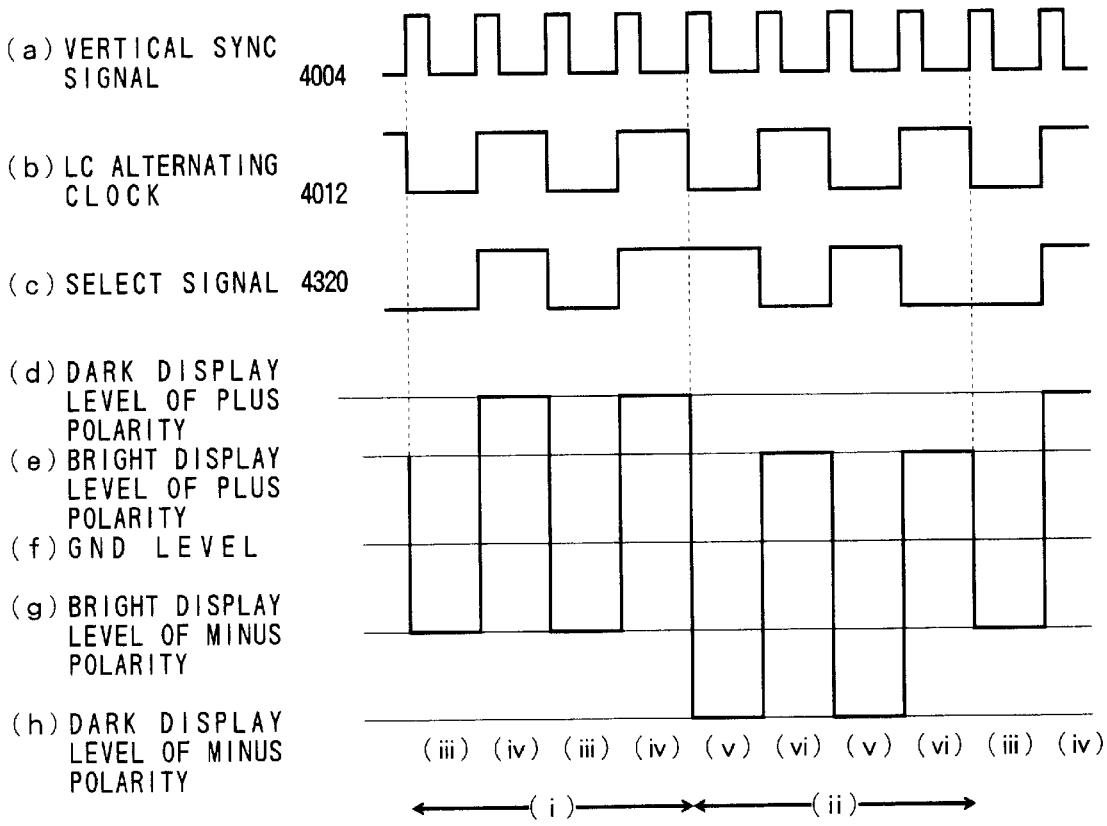
FIG. 48 is a diagram showing the waveform of an applied liquid-crystal voltage in the fifth embodiment.

FIG. 48 is a diagram showing the waveforms of voltages which are applied to the liquid crystal in accordance with this embodiment. Referring to the figure, (a) denotes the vertical sync signal 4004, (b) the LC alternating clock 4012, and (c) the select signal 4320. (d) and (h) denote the "dark" display levels of the applied LC voltages of plus and minus signs, respectively, while (e) and (g) denote the "bright" display levels of the applied LC voltages of plus and minus signs, respectively. (f) indicates the GND (ground) level of the applied LC voltages. As understood from the figure, the LC alternating clock 4012 is a signal which is inverted every frame synchronous with the vertical sync signal 4004. The select signal 4320 becomes a signal which is inverted every frame synchronous with the vertical sync signal 4004, in the initial 4 frames, namely, in a section (i), while it becomes a signal which has the inverted waveform of the waveform of the section (i), in the next 4 frames, namely, in a section (ii). By the way, the select signal 4322 is the same as the select signal 4320, and the select signal 4321 is obtained by directly inverting the select signal 4320, so that the signals 4322 and 4321 shall be omitted from the illustration of FIG. 48. The select signal 4320 is delivered to the selector 4304 shown in FIG. 43. Subject to the "low" level thereof, this select signal 4320 drives the selector 4304 so as to select the 3-bit data 4301 delivered from the first decoder 4300 shown in FIG. 43, and subject to the "high" level thereof, it drives the selector 4304 so as to select the 3-bit data 4303 delivered from the second decoder 4302. In accordance with the timings of the LC alternating clock 4012 and the select signal 4320, the LC drive voltage which is applied to the liquid-crystal panel 4022 becomes the bright display level of minus sign (g) in a section (iii), it becomes the dark display level of plus sign (d) in a section (iv), it becomes the dark display level of minus sign (h) in a section (v), and it becomes the bright display level of plus sign (e) in a section (vi). That is, the sign of the voltage which is applied to the liquid crystal is inverted every frame, and the dark display level and bright display level are inverted as being dark, bright, dark and bright in the initial 4 frames (i) and as being bright, dark, bright and dark in the next 4 frames (ii). Thus, D.C. levels are not applied to the liquid crystal, and the liquid crystal can be prevented from deteriorating. Incidentally, in the example of FIG. 48, plus D.C. voltages and minus D.C. voltages are respectively applied in the section (i) and in the section (ii) though for short time periods. When the liquid crystal is submitted to the application of such a D.C. voltage for a long time, it deteriorates. However, when the application is for a short time, there is observed the phenomenon that flickering is rather suppressed. It is accordingly possible to realize the liquid-crystal display system which is less liable to flicker.

Figure 49:
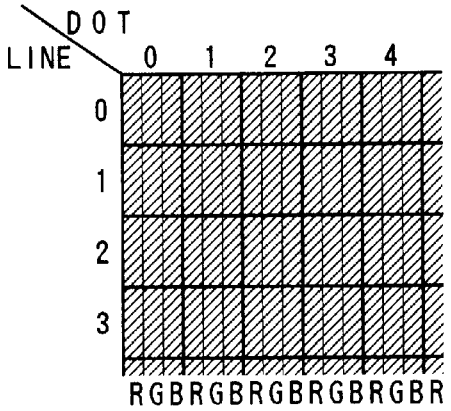
FIGS. 49(*a*) thru 49(*c*) are diagrams for explaining display patterns in individual frames in the fifth embodiment.
Figure 49:
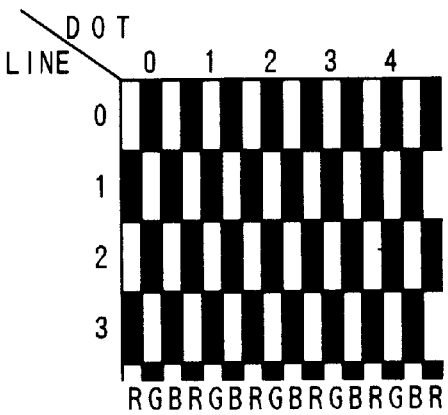
Figure 49:
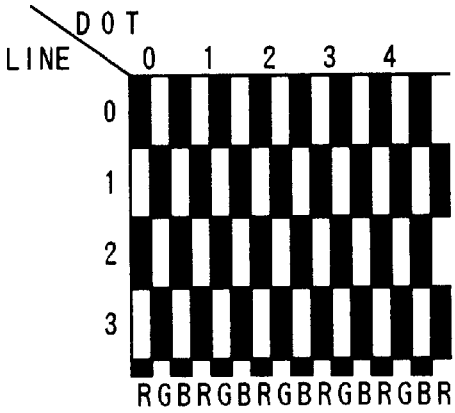

FIGS. 49(*a*)~49(*c*) illustrate a display pattern which is presented on the liquid-crystal panel 4022 so as to be actually visible by this embodiment, and display patterns in successive frames. As shown in FIG. 49(*a*), R, G and B pixels constituting individual dots are arrayed in this order. Regarding the alternation of the drive of the liquid crystal and the change-over of the voltages for the FRC tone displays, the same pattern is iterated with one cycle consisting of 8 frames as illustrated in FIG. 48. Accordingly, the display frames in the case of the allover FRC halftone display as shown in FIG. 49(*a*) becomes as depicted in FIG. 49(*b*) in the first, third, sixth and eighth frames within the 8 frames, and it becomes as depicted in FIG. 49(*c*) in the second, fourth, fifth and seventh frames.

As set forth above, according to the fifth embodiment of the present invention, D.C. voltages are applied to the liquid crystal for short time periods, so that the liquid-crystal display system less liable to flicker can be realized.

By the way, in this embodiment, the combinations of the outputs of the first and second decoders in the weighting processes have been set to be the same for all the colors as listed in FIGS. 44 thru 46. However, the exemplified measure is not restrictive, but the combinations may well be separately set for the individual colors in accordance with the tone characteristics etc. of the respective colors, and the contents of the weighting processes for the respective colors may well differ consequently.

Besides, this embodiment has mentioned the example in which the 16-tone displays are realized by employing the X driver of 3-bit (8-tone) inputs and receiving the display data of 4 bits (16 tones) for each color. However, the example is not restrictive, but 64-tone displays, e. g., can be realized by receiving display data of 6 bits (64 tones) for each color and employing the X driver of 3-bit (8-tone) inputs. In this case, the red signal 4000, green signal 4001 and blue signal 4002 each being composed of 6 bits are respectively input to the decoders 4300 and 4302, the decoders 4306 and 4308 and the decoders 4312 and 4314. Herein, the processing contents of the decoders are determined so as to attain the 64 tones for each of the colors. Thus, the 64-tone displays can be realized.

Besides, in this embodiment, the "dark"/"bright" iterative pattern has been inverted every fourth frame in such a manner that the dark display level and the bright display level are set as being dark, bright, dark and bright in the initial 4 frames and as being bright, dark, bright and dark in the next 4 frames. However, the number of frames for the inversion is not restricted to 4, but the "dark"/"bright" iterative pattern may well be inverted every eighth frame by way of example. This aspect of performance can be realized by disposing one flip-flop anew and further dividing the frequency of the signal 4710 inverted every fourth frame, to generate a signal which is inverted every eighth frame and which is input to the EXOR circuit 4703 (refer to FIG. 47).

Now, the sixth embodiment of the present invention will be described. This embodiment is a modification to the fifth embodiment.

Figure 50:
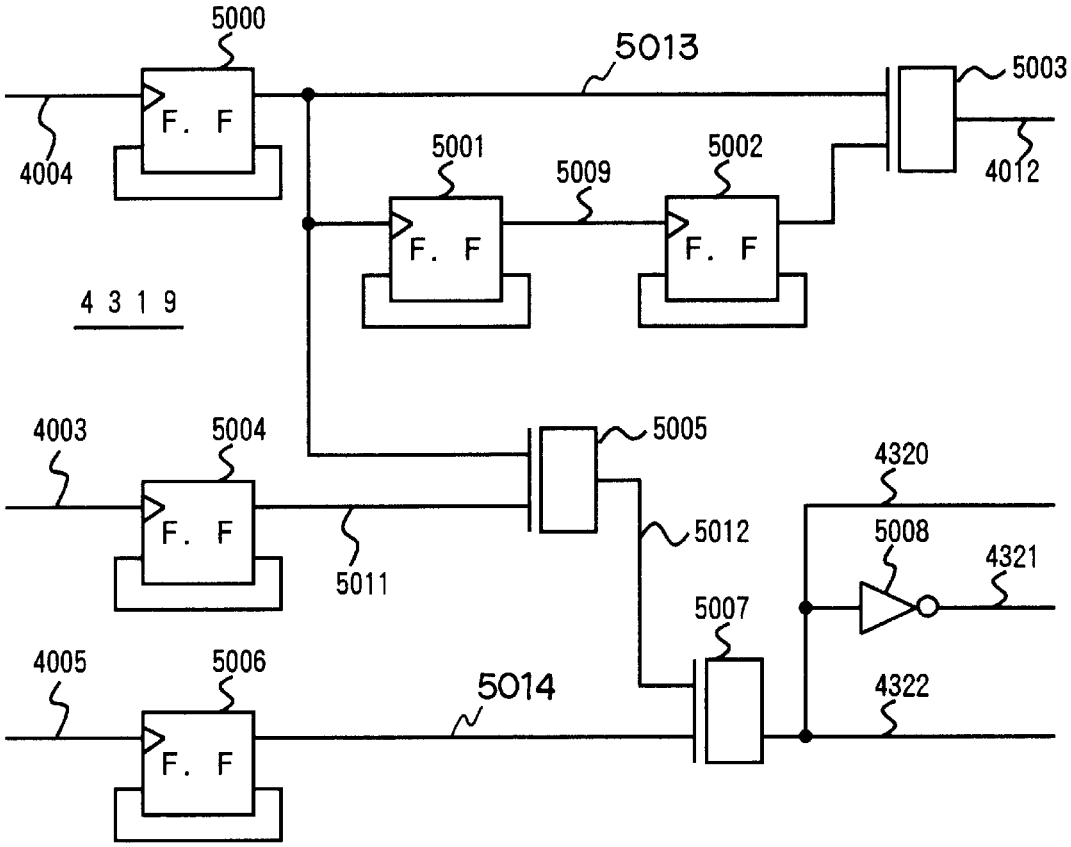
FIG. 50 is a circuit diagram of a select signal generator according to the sixth embodiment of the present invention.

First, the construction of this embodiment will be explained. FIG. 50 illustrates another example of the circuit arrangement of the select signal generator 4319 shown in FIG. 43. Referring to FIG. 50, a flip-flop 5000 divides the frequency of the vertical sync signal 4004 to generate a signal 5013 which is inverted every frame. Another flip-flop 5001 further divides the frequency of the signal 5013 inverted every frame, thereby to generate a signal 5009 which is inverted every second frame. Still another flip-flop 5002 further divides the frequency of the signal 5009 inverted every second frame, thereby to generate a signal 5010 which is inverted every fourth frame. An EXOR circuit 5003 receives the signal 5013 inverted every frame and the signal 5010 inverted every fourth frame, and generates a liquid-crystal alternating clock 4012 which is inverted every frame and every fourth frame. A flip-flop 5004 divides the frequency of the horizontal sync signal 4003 to generate a signal 5011 which is inverted every line. Another flip-flop 5006 generates a signal 5014 which is obtained by dividing the frequency of the dot clock 4005. An EXOR circuit 5005 receives the signal 5013 inverted every frame and the signal 5011 inverted every line, and generates a signal 5012 which is inverted every frame and every line. An EXOR circuit 5007 succeeding the EXOR circuit 5005 receives the signal 5012 inverted every frame and every line and the frequency division signal 5014, and generates the select signals 4320 and 4322. A NOT circuit 5008 inverts the select signal 4320, thereby to generate the select signal 4321. In this embodiment, the select signals 4320, 4321 and 4322 are inverted every frame, every line and every dot in the initial four frames of one cycle consisting of 8 frames, and they become the inverted signals of such signals in the next four frames. Thenceforth, these changes are repeated. In addition, each of the select signals 4320, 4321 and 4322 becomes a signal which is inverted every frame.

Figure 51:
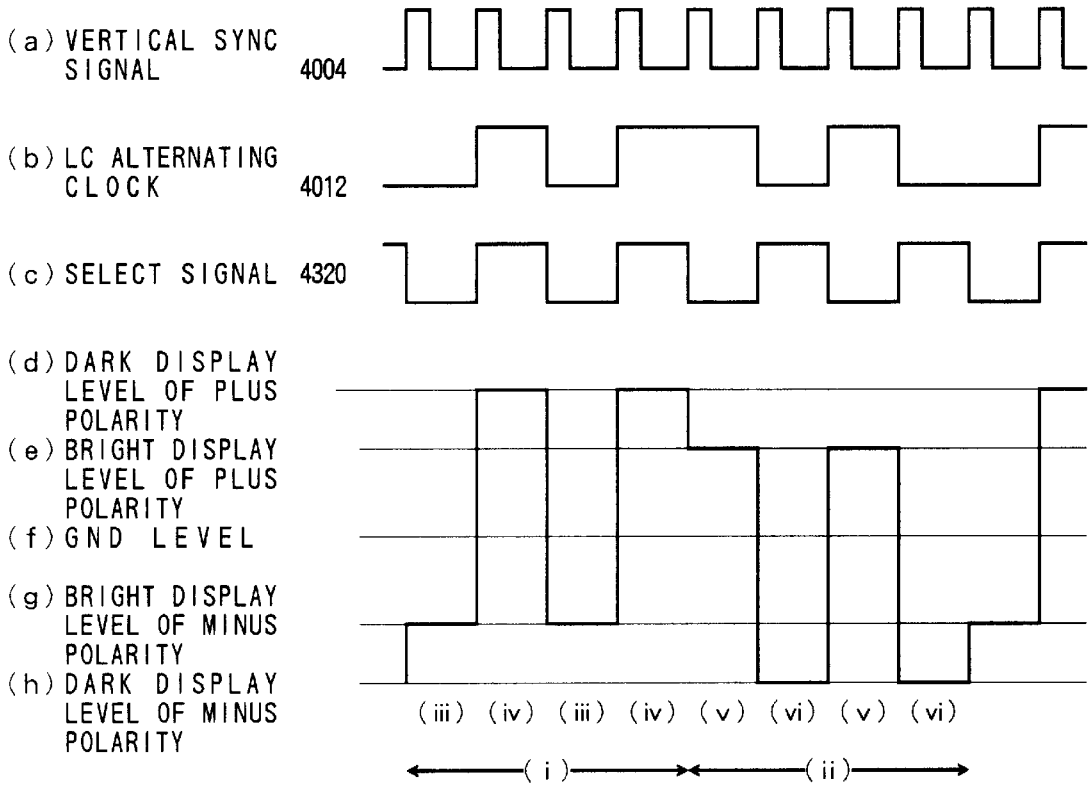
FIG. 51 is a diagram showing the waveform of an applied liquid-crystal voltage in the sixth embodiment.

FIG. 51 is a diagram showing the waveforms of voltages which are applied to the liquid crystal in accordance with the sixth embodiment. Referring to the figure, (a) denotes the vertical sync signal 4004, (b) the LC alternating clock 4012, and (c) the select signal 4320. (d) and (h) denote the "dark" display levels of the applied LC voltages of plus and minus signs, respectively, while (e) and (g) denote the "bright" display levels of the applied LC voltages of plus and minus signs, respectively. (f) indicates the GND (ground) level of the applied LC voltages. As understood by comparing the illustration of FIG. 51 with that of FIG. 48 pertaining to the fifth embodiment, the relationships between the LC alternating clock 4012 and the select signal 4320 are reverse to each other. It is also understood that the waveforms of the applied LC voltages having the levels (d)~(h) are different in the cases of both the figures. More specifically, in the case of FIG. 51, the LC alternating clock 4012 becomes a signal which is inverted every frame synchronous with the vertical sync signal 4004, in the initial 4 frames, namely, in a section (i), while it becomes a signal which has the inverted waveform of the waveform of the section (i), in the next 4 frames, namely, in a section (ii). The select signal 4320 becomes a signal which is inverted every frame synchronous with the vertical sync signal 4004. By the way, the select signal 4322 is the same as the select signal 4320, and the select signal 4321 is obtained by directly inverting the select signal 4320, so that the signals 4322 and 4321 shall be omitted from the illustration of FIG. 51. The select signal 4320 is delivered to the selector 4304 shown in FIG. 43. Subject to the "low" level thereof, this select signal 4320 drives the selector 4304 so as to select the 3-bit data 4301 delivered from the first decoder 4300 shown in FIG. 43, and subject to the "high" level thereof, it drives the selector 4304 so as to select the 3-bit data 4303 delivered from the second decoder 4302. In accordance with the timings of the LC alternating clock 4012 and the select signal 4320, the LC drive voltage which is applied to the liquid-crystal panel 4022 shown in FIG. 40 becomes the bright display level of minus sign (g) in a section (iii), it becomes the dark display level of plus sign (d) in a section (iv), it becomes the bright display level of plus sign (e) in a section (v), and it becomes the dark display level of minus sign (h) in a section (vi). That is, the sign of the voltage which is applied to the liquid crystal is inverted as being minus, plus, minus and plus in the initial 4 frames (i) and as being plus, minus, plus and minus in the next 4 frames (ii). In addition, the dark display level and bright display level are inverted every frame. Thus, D.C. levels are not applied to the liquid crystal, and the liquid crystal can be prevented from deteriorating.

Incidentally, in the example of FIG. 51, plus D.C. voltages and minus D.C. voltages are respectively applied in the section (i) and in the section (ii) though for short time periods. As stated before, however, when the liquid crystal is submitted to the application of such a D.C. voltage for a long time, it deteriorates, but when the application is for a short time, the flickering is rather suppressed. It is accordingly possible to realize the liquid-crystal display system which is less liable to flicker.

Figure 52:
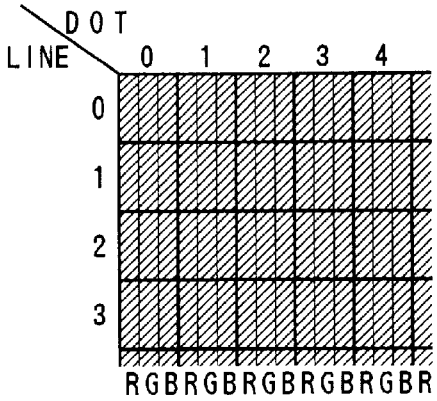
FIGS. 52(*a*) thru 52(*c*) are diagrams for explaining display patterns in individual frames in the sixth embodiment.
Figure 52:
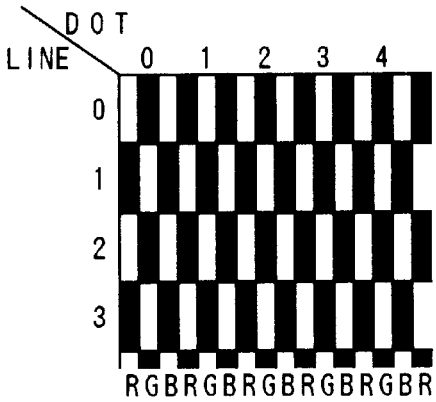
Figure 52:
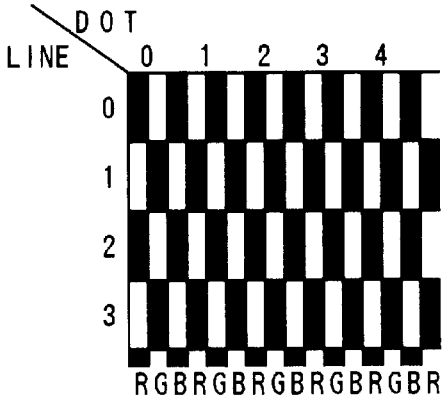

FIGS. 52(*a*)~52(*c*) illustrate a display pattern which is presented as visible information on the liquid-crystal panel 4022 by this embodiment, and display patterns in successive frames. Unlike the case of FIGS. 49(*a*)~49(*c*), in this embodiment, the display patterns in FIGS. 52(*b*) and 52(*c*) are iterated alternately in the successive frames for the same display pattern as shown in FIG. 49(*a*).

As set forth above, according to the sixth embodiment of the present invention, D.C. voltages are applied to the liquid crystal for short time periods, so that the liquid-crystal display system less liable to flicker can be realized.

Now, the seventh embodiment of the present invention will be described. This embodiment is an example of application of the fifth embodiment. More specifically, a clock which is inverted every frame is set as a liquid-crystal alternating clock, and a clock which is inverted every second frame is set as each select signal. On this occasion, four sorts of signals which are inverted every second frame and whose phases are different from one another are prepared beforehand, and one of the four sorts of signals is selected in accordance with the horizontal position and vertical position of a dot and is used as the select signal.

Figure 53:
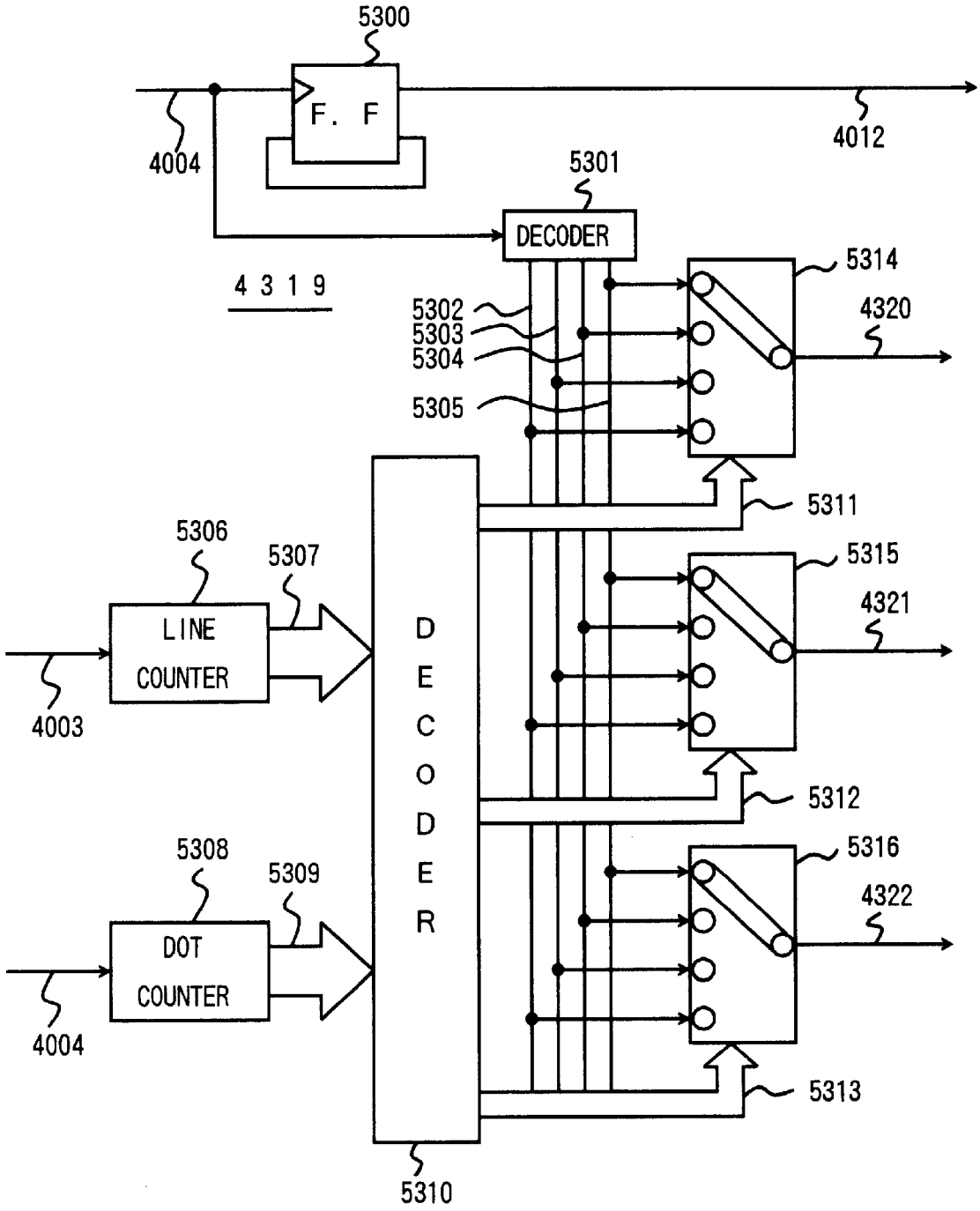
FIG. 53 is a circuit diagram of a select signal generator according to the seventh embodiment of the present invention.

First, the construction of this embodiment will be explained. FIG. 53 illustrates another example of the circuit arrangement of the select signal generator 4319 shown in FIG. 43. Referring to FIG. 53, a flip-flop 5300 divides the frequency of the vertical sync signal 4004 to generate the liquid-crystal alternating signal 4012 which is inverted every frame. A decoder 5301 generates from the vertical sync signal 4004 the four sorts of decode signals 5302, 5303, 5304 and 5305 each of which is inverted every second frame and which have phases different from one another. A line counter 5306 counts the pulses of the horizontal sync signal 4003, and delivers a line count value 5307. A dot counter 5308 counts the pulses of the dot clock 4005, and delivers a dot count value 5309. A decoder 5310 generates select signals 5311, 5312 and 5313 from the line count value 5307 and the dot count value 5309. A selector 5314 selects one sort from among the four sorts of decode signals 5302, 5303, 5304 and 5305 in accordance with the select signal 5311, thereby to deliver the select signal 4320. Another selector 5315 selects one sort from among the four sorts of decode signals 5302, 5303, 5304 and 5305 in accordance with the select signal 5312, thereby to deliver the select signal 4321. Still another selector 5316 selects one sort from among the four sorts of decode signals 5302, 5303, 5304 and 5305 in accordance with the select signal 5313, thereby to deliver the select signal 4322.

Figure 54:
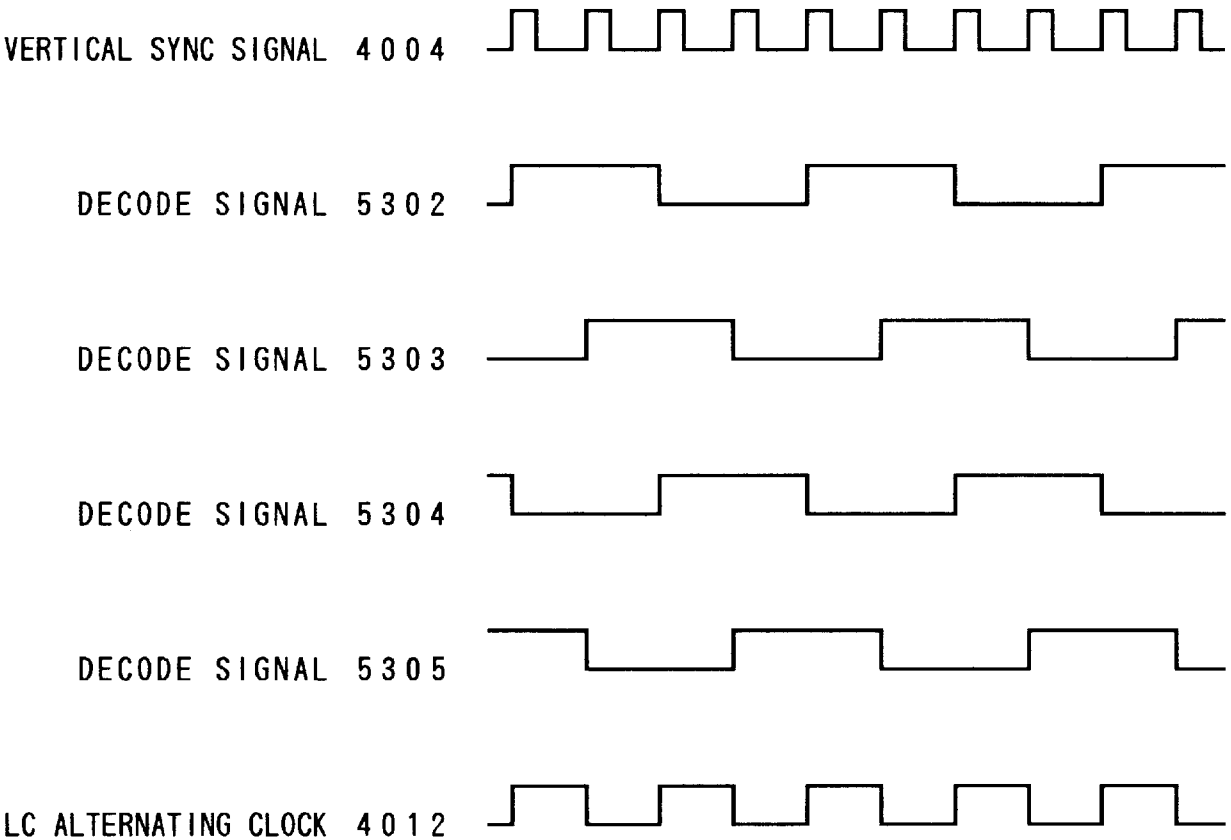
FIGS. 54(*a*) thru 54(*f*) are diagrams showing the waveforms of applied liquid-crystal voltages in the seventh embodiment.

FIGS. 54(*a*)~54(*f*) illustrate operating waveforms at the parts of the decoder 5301 in this embodiment. FIG. 54(*a*) shows the vertical sync signal 4004. FIGS. 54(*b*), 54(*c*), 54(*d*) and 54(*e*) show the decode signals 5302, 5303, 5304 and 5305 having the phases different from one another, respectively. Each of the decode signals 5302, 5303, 5304 and 5305 is the signal which has the same cycle as that of the select signal 4320 shown in FIG. 53 and which is inverted every second frame. FIG. 54(*f*) shows the LC alternating clock 4012, which is inverted every frame.

FIG. 55 is a table for explaining the operation of the decoder 5310. The table lists the values of the select signals 5311, 5312 and 5313 delivered in accordance with the inputs of the decoder 5310 from the counters 5306 and 5308. Each of the counters 5306 and 5308 is a counter of 1 bit, so that the outputs of these counters have four combinations. On the other hand, regarding the values of the select signals 5311, 5312 and 5313, "0" expresses that the respective selectors 5314, 5315 and 5316 select the decode signal 5302, "1" expresses that they select the decode signal 5303, "2" expresses that they select the decode signal 5304, and "3" expresses that they select the decode signal 5305. In accordance with the values of the counters 5306 and 5308, the decoder 5310 supplies the respective selectors 5314, 5315 and 5316 with the values of the select signals 5311, 5312 and 5313 conforming to the table of the operation shown in FIG. 55. The selectors 5314, 5315 and 5316 select any of the four sorts of decode signals 5302, 5303, 5304 and 5305 in accordance with the corresponding select signals 5311, 5312 and 5313, so as to deliver the select signals 4320, 4321 and 4322, respectively. The select signal 4320 is delivered to the selector 4304 shown in FIG. 43. Subject to the "low" level thereof, this select signal 4320 drives the selector 4304 so as to select the 3-bit data 4301 delivered from the first decoder 4300 shown in FIG. 43, and subject to the "high" level thereof, it drives the selector 4304 so as to select the 3-bit data 4303 delivered from the second decoder 4302. In accordance with the timings of the LC alternating clock 4012 and the select signal 4320, the LC drive voltage is applied to the liquid-crystal panel 4022 shown in FIG. 40. The operations of the liquid-crystal display system based on the select signals 4321 and 4322 are similar. The LC drive voltages which are applied to the liquid-crystal panel 4022, have different phases dependent upon the positions of display pixels in conformity with the table of the operation in FIG. 55. At the individual pixels, however, the LC drive voltages are applied so as to successively repeat a "dark" display level of plus sign, a "dark" display level of minus sign, a "bright" display level of plus sign and a "bright" display level of minus sign. That is, the sign of the voltage which is applied to the liquid crystal is inverted every pixel and every frame, and the dark display level and bright display level are inverted every second frame. Thus, D.C. levels are not applied to the liquid crystal, and the liquid crystal can be prevented from deteriorating.

Figure 56:
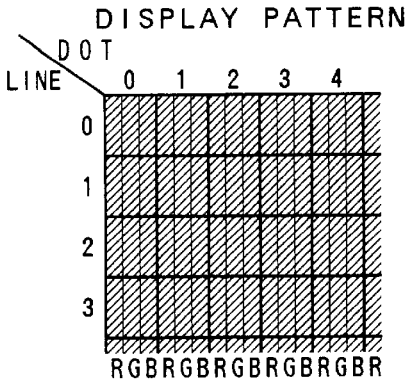
FIGS. 56(*a*) thru 56(*e*) are diagrams for explaining display patterns in individual frames in the seventh embodiment.
Figure 56:
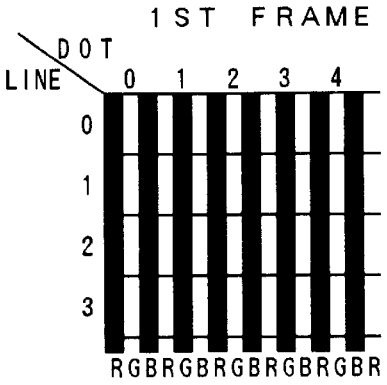
Figure 56:
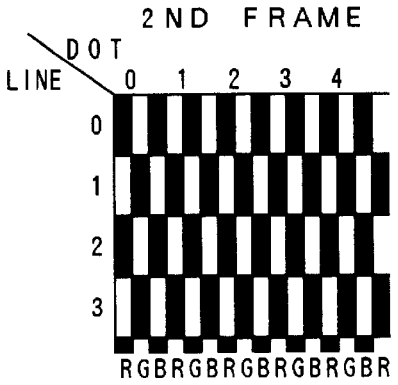
Figure 56:
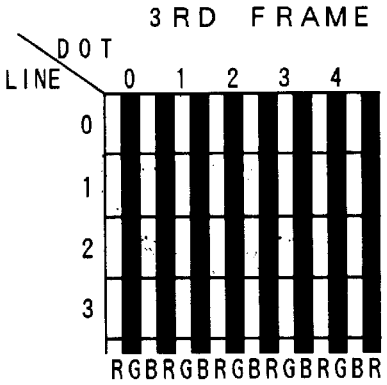
Figure 56:
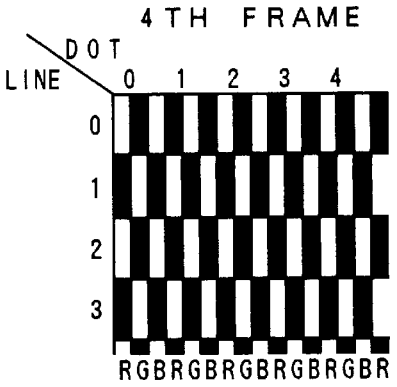

FIGS. 56(*a*)~56(*e*) concern an allover halftone display which is presented when the dark display level and the bright display level are afforded alternately every second frame in conformity with the table of the operation in FIG. 55. FIG. 56(*a*) illustrates a display pattern which is actually visible in this case, and FIGS. 56(*b*)~56(*e*) illustrate display patterns in the individual frames which constitute the visible display pattern. In the display pattern of the first frame shown in FIG. 56(*b*), black pixels denote the dark display level, and white pixels denote the bright display level. In this pattern shown in FIG. 56(*b*), in the horizontal direction of the liquid-crystal display panel 4022, the three pixels of dot #0 at line #0 have a pattern configured of the dark display level, bright display level and dark display level, while the three pixels of dot #1 have a pattern configured of the bright display level, dark display level and bright display level reverse to the levels at the dot #0. Thus, both the patterns are alternately displayed. Besides, in the vertical direction, the same patterns as at the line #0 are iteratively displayed. In the display pattern of the second frame shown in FIG. 56(*c*), in the horizontal direction, the three pixels of the dot #0 at the line #0 have a pattern configured of the dark display level, bright display level and dark display level, while the three pixels of the dot #1 have a pattern configured of the bright display level, dark display level and bright display level reverse to the levels at the dot #0. Thus, both the patterns are alternately displayed. Further, unlike the display pattern in FIG. 56(*b*), the display pattern in FIG. 56(*c*) is such that the dark display level and the bright display level are iterated also in the vertical direction. The display pattern of the third frame shown in FIG. 56(*d*) is obtained by inverting the display pattern shown in FIG. 56(*b*). The display pattern of the fourth frame shown in FIG. 56(*e*) is obtained by inverting the display pattern shown in FIG. 56(*c*).

When compared with the display patterns of the successive frames under the liquid-crystal driving conditions for the FRC display mode as shown in FIG. 30, the display patterns shown in FIGS. 56(*b*)~56(*e*) have the following feature: In FIG. 30, the same display patterns are exhibited in the first and second frames, and the display patterns different from those in the first and second frames are exhibited in the third and fourth frames. In contrast, in FIGS. 56(*b*)~56(*e*), all the display patterns are different. From a different point of view, it can be considered that the display pattern of the third frame for buffering is inserted while the display pattern of the second frame shifts to the display pattern of the fourth frame, and that the display pattern of the first frame for buffering is inserted while the display pattern of the fourth frame shifts to the display pattern of the second frame. When the frame frequency of the liquid-crystal display system is set at 70 Hz, the effective frame frequency thereof becomes a half (35 Hz) in the case of the display patterns shown in FIG. 30. Consequently, the display patterns are changed-over at 35 Hz, and the display-ON and display-OFF of all the pixels are changed-over. In contrast, according to this embodiment illustrated in FIGS. 56(*a*)~56(*e*), the display patterns are changed-over at 70 Hz, and the display-ON and display-OFF of only half of the pixels are changed-over. Accordingly, this embodiment can realize a liquid-crystal display system of multiple-tone displays (polytonal displays) which is still less liable to flicker, for the reason that a higher frame frequency expands the flickerless range more as stated in connection with the third embodiment.

FIG. 57 is a table for explaining that operation of the decoder 5310 which differs from the operation shown in FIG. 55. The table lists the values of the select signals 5311, 5312 and 5313 delivered in accordance with the inputs of the decoder 5310 from the counters 5306 and 5308. In this case, each of the counters 5306 and 5308 is a counter of 2 bits, so that the outputs of these counters have sixteen combinations. On the other hand, regarding the values of the select signals 5311, 5312 and 5313, "0" expresses that the respective selectors 5314, 5315 and 5316 select the decode signal 5302, "1" expresses that they select the decode signal 5303, "2" expresses that they select the decode signal 5304, and "3" expresses that they select the decode signal 5305. Herein, the signals selected by the selectors 5314, 5315 and 5316 are respectively used as the select signals 4320, 4321 and 4322. The select signal 4320 is delivered to the selector 4304 shown in FIG. 43. Subject to the "low" level thereof, this select signal 4320 drives the selector 4304 so as to select the 3-bit data 4301 delivered from the first decoder 4300 shown in FIG. 43, and subject to the "high" level thereof, it drives the selector 4304 so as to select the 3-bit data 4303 delivered from the second decoder 4302. In accordance with the timings of the LC alternating clock 4012 and the select signal 4320, the LC drive voltage is applied to the liquid-crystal panel 4022 shown in FIG. 40. The operations of the liquid-crystal display system based on the select signals 4321 and 4322 are similar. The LC drive voltages which are applied to the liquid-crystal panel 4022, have different phases dependent upon the positions of display pixels in conformity with the table of the operation in FIG. 57. At the individual pixels, however, the LC drive voltages are applied so as to successively repeat a "dark" display level of plus sign, a "dark" display level of minus sign, a "bright" display level of plus sign and a "bright" display level of minus sign. That is, the sign of the voltage which is applied to the liquid crystal is inverted every pixel and every frame, and the dark display level and bright display level are inverted every second frame. Thus, D.C. levels are not applied to the liquid crystal, and the liquid crystal can be prevented from deteriorating.

Figure 58:
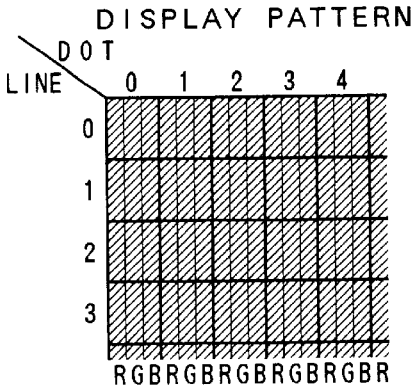
FIGS. 58(*a*) thru 58(*e*) are diagrams for explaining different display patterns in individual frames in the seventh embodiment.
Figure 58:
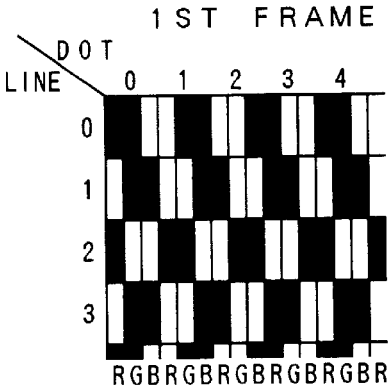
Figure 58:
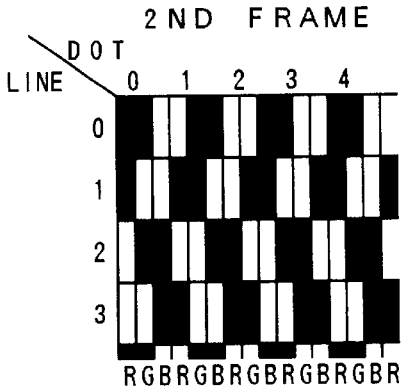
Figure 58:
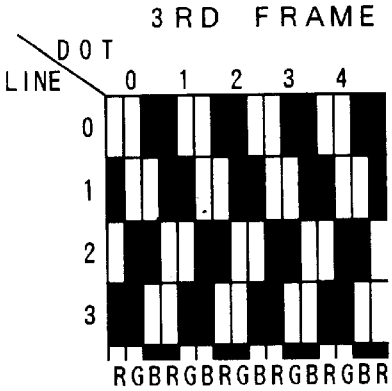
Figure 58:
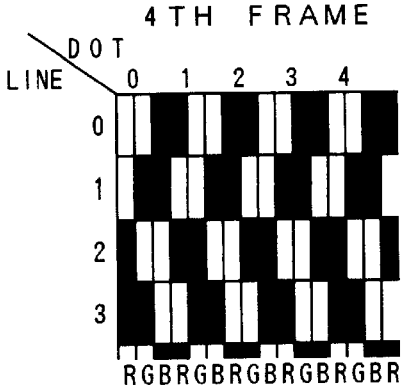

FIGS. 58(*a*)~58(*e*) concern an allover halftone display which is presented when the dark display level and the bright display level are afforded alternately every second frame in conformity with the table of the operation in FIG. 57. FIG. 58(*a*) illustrates a display pattern which is actually visible in this case, and FIGS. 58(*b*)~58(*e*) illustrate display patterns in the individual frames. In the display pattern of the first frame shown in FIG. 58(*b*), in the horizontal direction of the liquid-crystal display panel 4022, line #0 has a pattern configured of the dark display level and the succeeding dark display level, and a pattern configured of the bright display level and the succeeding bright display level. Both these patterns are alternately displayed. Besides, in the vertical direction, patterns obtained by shifting the patterns of the line #0 one pixel successively in the horizontal direction are iteratively displayed. The display pattern of the second frame shown in FIG. 58(*c*) is such that the dark display level and the bright display level of lines #1 and #2 in the display pattern shown in FIG. 58(*b*) are inverted. The display pattern of the third frame shown in FIG. 58(*d*) is such that the display pattern shown in FIG. 58(*b*) is entirely inverted. The display pattern of the fourth frame shown in FIG. 58(*e*) is such that the display pattern shown in FIG. 58(*c*) is entirely inverted.

In this example stated above, a halftone display level indicated in FIG. 58(*a*) can be attained by changing-over the dark display level and the bright display level at a cycle of the 4 frames of the first~fourth frames.

By the way, in this embodiment, the tables of the operations of the decoder 5310 illustrated in FIG. 55 and FIG. 57 are not restrictive, but the combinations of the output values of the respective select signals may well be set otherwise.

As set forth above, according to the seventh embodiment, the liquid-crystal display system of multiple-tone displays less liable to flicker can be realized.

Now, the eighth embodiment of the present invention will be described. This embodiment is also an example of application of the fifth embodiment. In this embodiment, 2M sorts of signals 5902~5909 whose phases are different from one another are prepared beforehand, and one of the 2M sorts of signals is selected in accordance with the horizontal position and vertical position of a dot and is used as the select signal.

Figure 59:
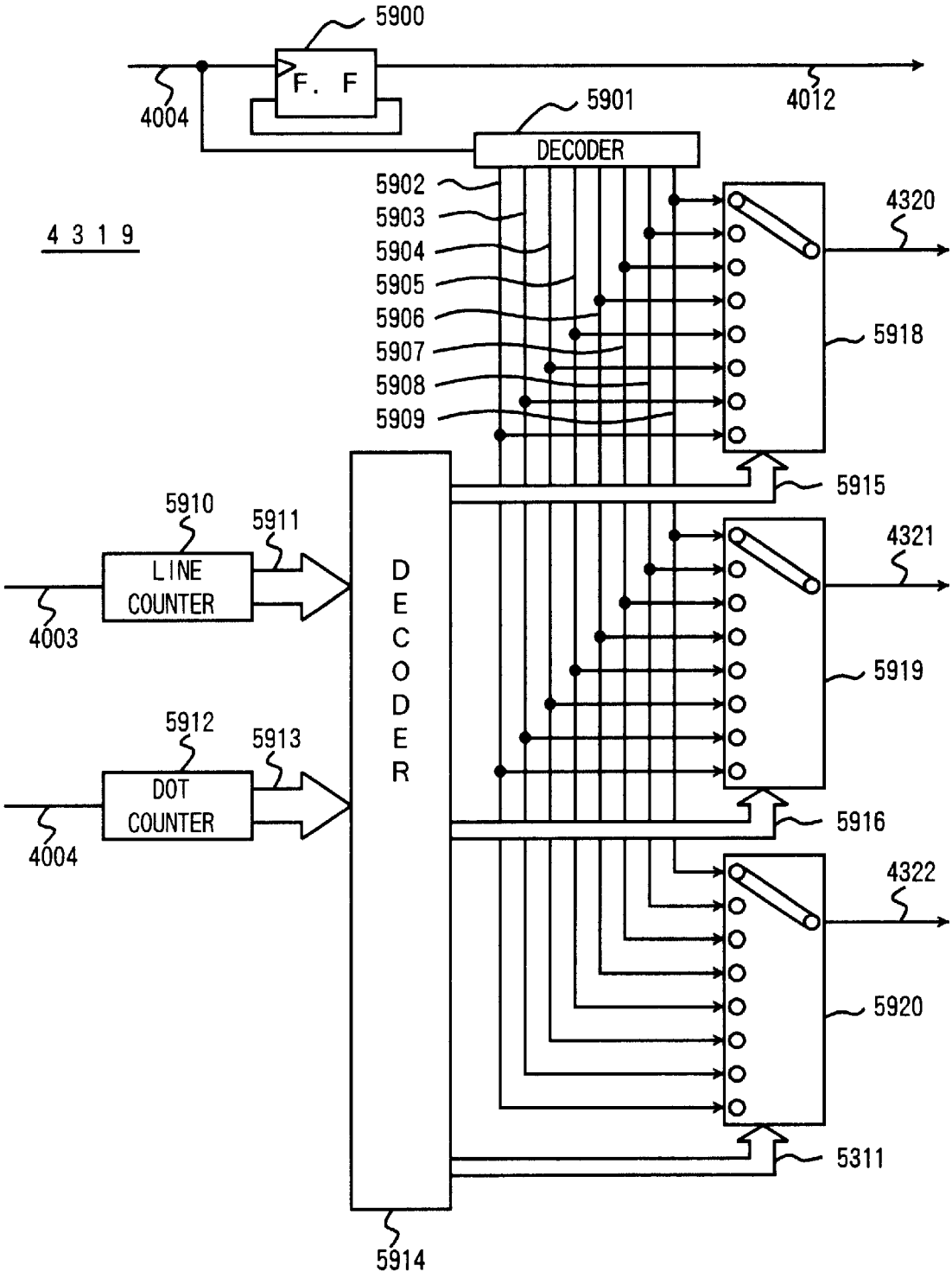
FIG. 59 is a circuit diagram of a select signal generator according to the eighth embodiment of the present invention.

First, the construction of this embodiment will be explained. FIG. 59 illustrates another example of the circuit arrangement of the select signal generator 4319 shown in FIG. 43. Referring to FIG. 59, a flip-flop 5900 divides the frequency of the vertical sync signal 4004 to generate the liquid-crystal alternating signal 4012 which is inverted every frame. A decoder 5901 generates from the vertical sync signal 4004 the eight sorts of decode signals 5902, 5903, 5904, 5905, 5906, 5907, 5908 and 5909 each of which is inverted every fourth frame and every frame and which have phases different from one another. A line counter 5910 counts the pulses of the horizontal sync signal 4003, and delivers a line count value 5911. A dot counter 5912 counts the pulses of the dot clock 4005, and delivers a dot count value 5913. A decoder 5914 generates select signals 5915, 5916 and 5917 from the line count value 5911 and the dot count value 5913. A selector 5918 selects one sort from among the eight sorts of decode signals 5902~5909 in accordance with the select signal 5915, thereby to deliver the select signal 4320. Another selector 5919 selects one sort from among the eight sorts of decode signals 5902~5909 in accordance with the select signal 5916, thereby to deliver the select signal 4321. Still another selector 5920 selects one sort from among the eight sorts of decode signals 5902~5909 in accordance with the select signal 5917, thereby to deliver the select signal 4322.

Figure 60:
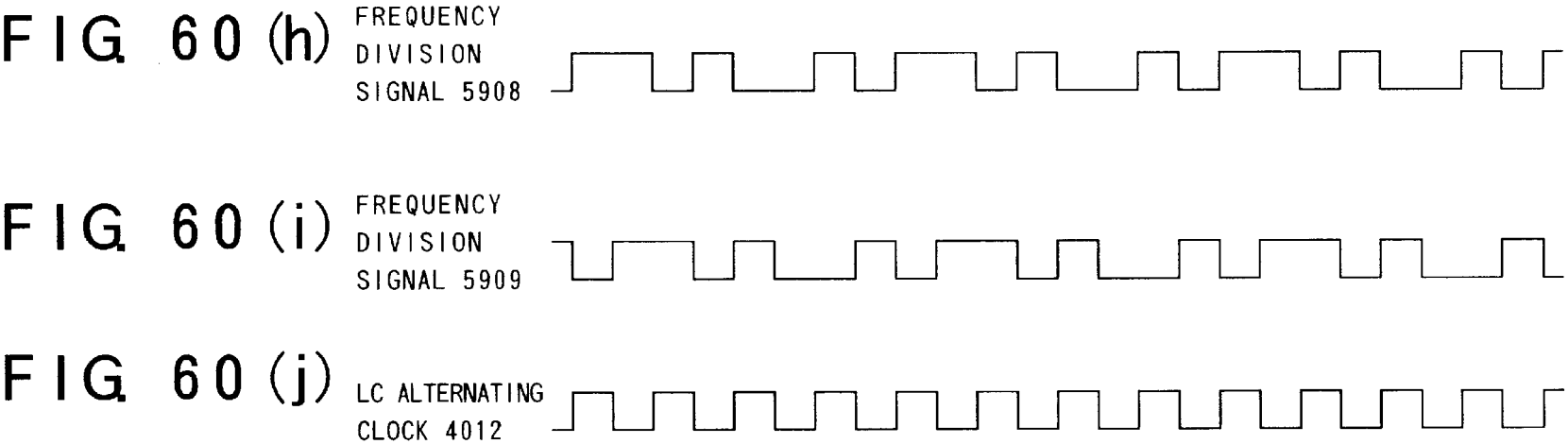
FIGS. 60(*a*) thru 60(*j*) are diagrams showing the operating waveforms of a decoder.

FIGS. 60(*a*)~60(*j*) illustrate operating waveforms in the decoder 5901 in this embodiment. FIG. 60(*a*) shows the vertical sync signal 4004. FIGS. 60(*b*), 60(*c*), 60(*d*), 60(*e*), 60(*f*), 60(*g*), 60(*h*) and 60(*i*) show the decode signals 5902~5909 having the phases different from one another, respectively. Each of the decode signals 5902~5909 is the signal which has the same cycle as that of the select signal 4320 shown in FIG. 48 and which is inverted every fourth frame and every frame. FIG. 60(*j*) shows the LC alternating clock 4012 which has the same cycle as that of the LC alternating clock 4012 shown in FIG. 48 and which is inverted every frame.

FIGS. 61(*a*)~61(*c*) are tables for explaining the operation of the decoder 5914. The tables list the values of the respective select signals 5915, 5916 and 5917 delivered in accordance with the inputs of the decoder 5914 from the counters 5910 and 5912. In the case of the illustrated operation, each of the counters 5910 and 5912 is a counter of 2 bits, so that the outputs of these counters have sixteen combinations. On the other hand, regarding the values of the select signals 5915, 5916 and 5917, "0" expresses that the respective selectors 5918, 5919 and 5920 select the decode signal 5902, "1" expresses that they select the decode signal 5903, "2" expresses that they select the decode signal 5904, "3" expresses that they select the decode signal 5905, "4" expresses that they select the decode signal 5906, "5" expresses that they select the decode signal 5907, "6" expresses that they select the decode signal 5908, and "7" expresses that they select the decode signal 5909. In accordance with the values of the counters 5910 and 5912, the decoder 5914 supplies the respective selectors 5918, 5919 and 5920 with the values of the select signals 5915, 5916 and 5917 conforming to the tables of the operation shown in FIGS. 61(*a*)~61(*c*). The selectors 5918, 5919 and 5920 select any of the eight sorts of decode signals 5902~5909 in accordance with the corresponding select signals 5915, 5916 and 5917, so as to deliver the select signals 4320, 4321 and 4322, respectively. The select signal 4320 is delivered to the selector 4304 shown in FIG. 43. Subject to the "low" level thereof, this select signal 4320 drives the selector 4304 so as to select the 3-bit data 4301 delivered from the first decoder 4300 shown in FIG. 43, and subject to the "high" level thereof, it drives the selector 4304 so as to select the 3-bit data 4303 delivered from the second decoder 4302. In accordance with the timings of the LC alternating clock 4012 and the select signal 4320, the LC drive voltage is applied to the liquid-crystal panel 4022 shown in FIG. 40. The operations of the liquid-crystal display system based on the select signals 4321 and 4322 are similar. The LC drive voltages which are applied to the liquid-crystal panel 4022, have different phases dependent upon the positions of display pixels in conformity with the tables of the operation in FIGS. 61(*a*)~61(*c*). At the individual pixels, however, the LC drive voltages are applied so as to successively repeat a "bright" display level of minus sign, a "dark" display level of plus sign, the "bright" display level of minus sign, the "dark" display level of plus sign, a "dark" display level of minus sign, a "bright" display level of plus sign, the "dark" display level of minus sign and the "bright" display level of plus sign. That is, the sign of the voltage which is applied to the liquid crystal is inverted every pixel and every frame, and the dark display level and bright display level are inverted every fourth frame and every frame. Thus, D.C. levels are not applied to the liquid crystal, and the liquid crystal can be prevented from deteriorating.

Figure 62:
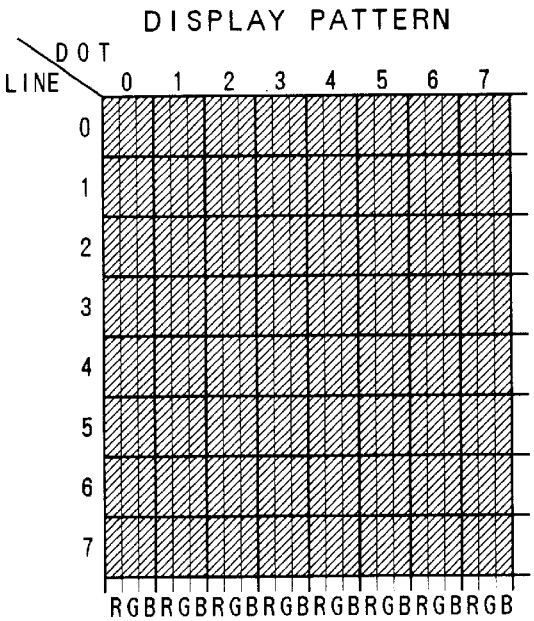
FIGS. 62(*a*) thru 62(*i*) are diagrams for explaining display patterns in individual frames in the eighth embodiment.
Figure 62:
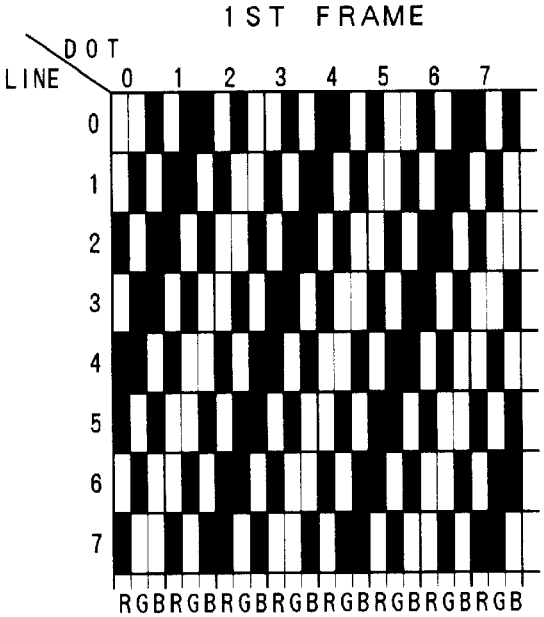
Figure 62:
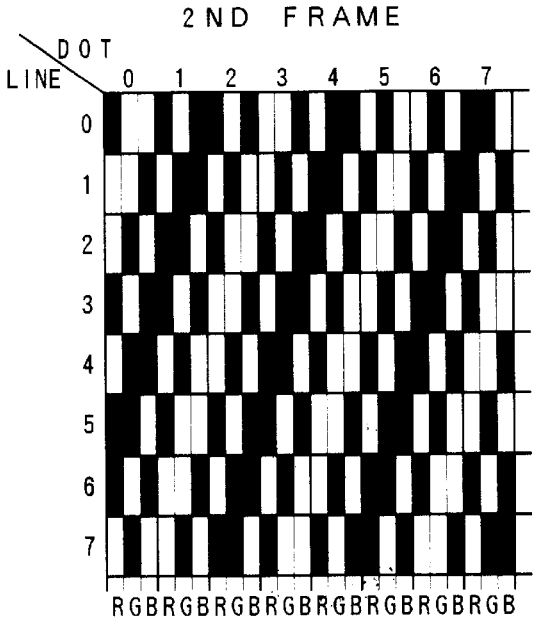
Figure 62:
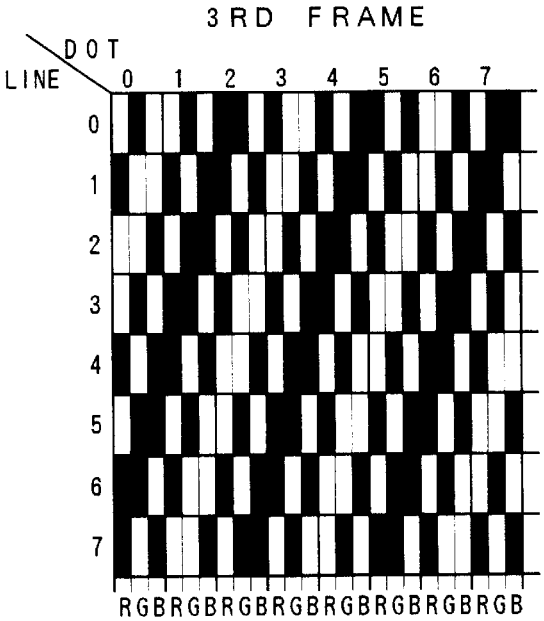
Figure 62:
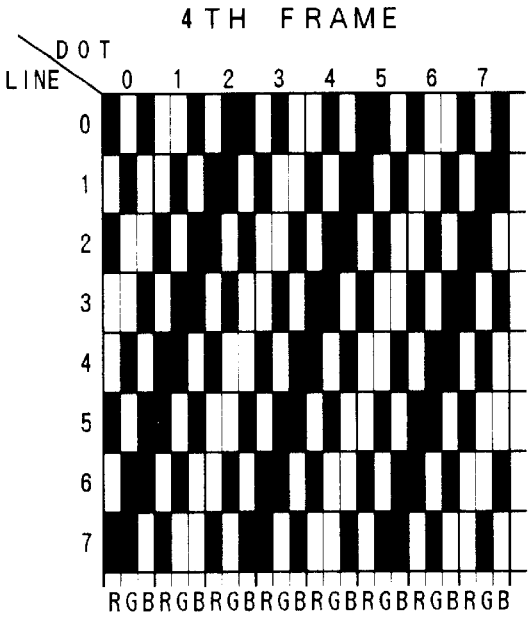
Figure 62:
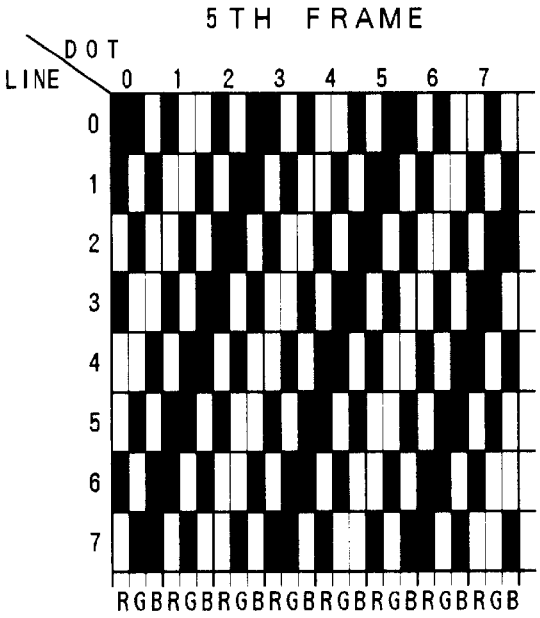
Figure 62:
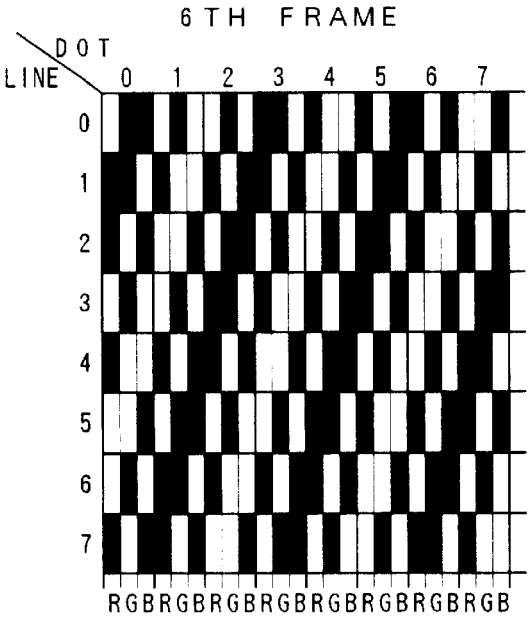
Figure 62:
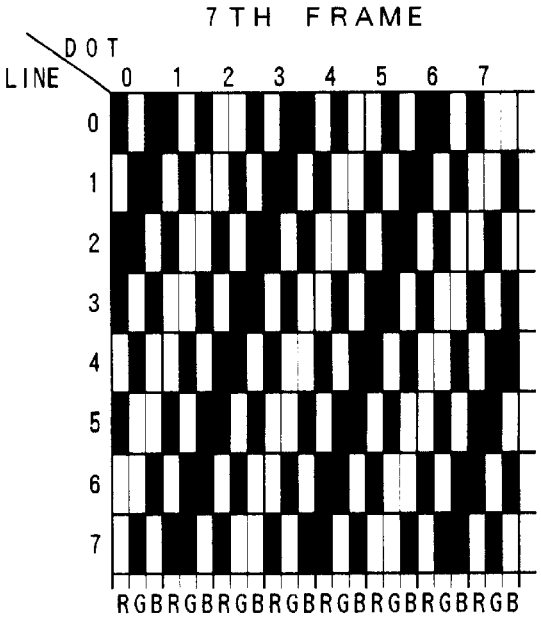
Figure 62:
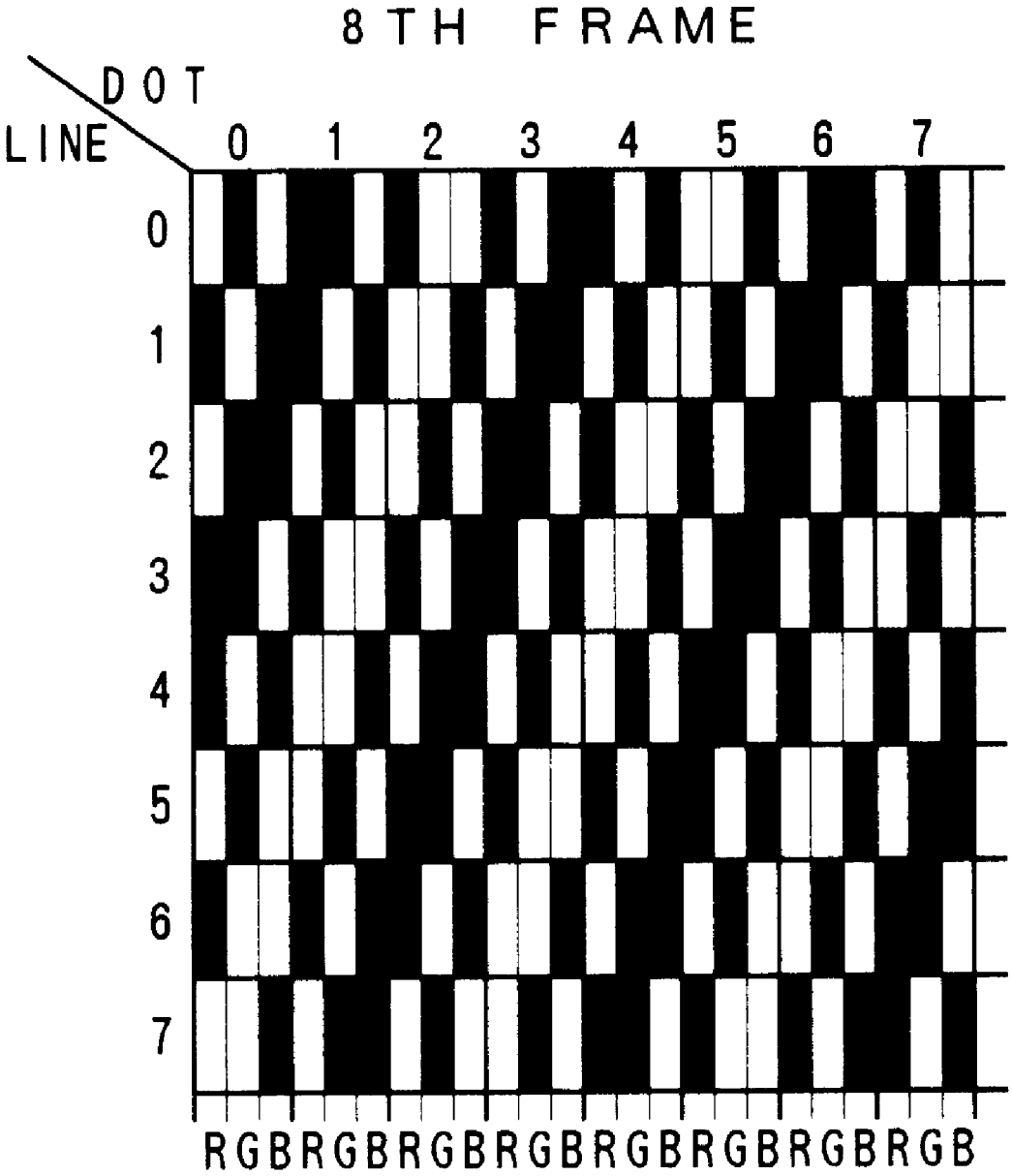
Figure 63:
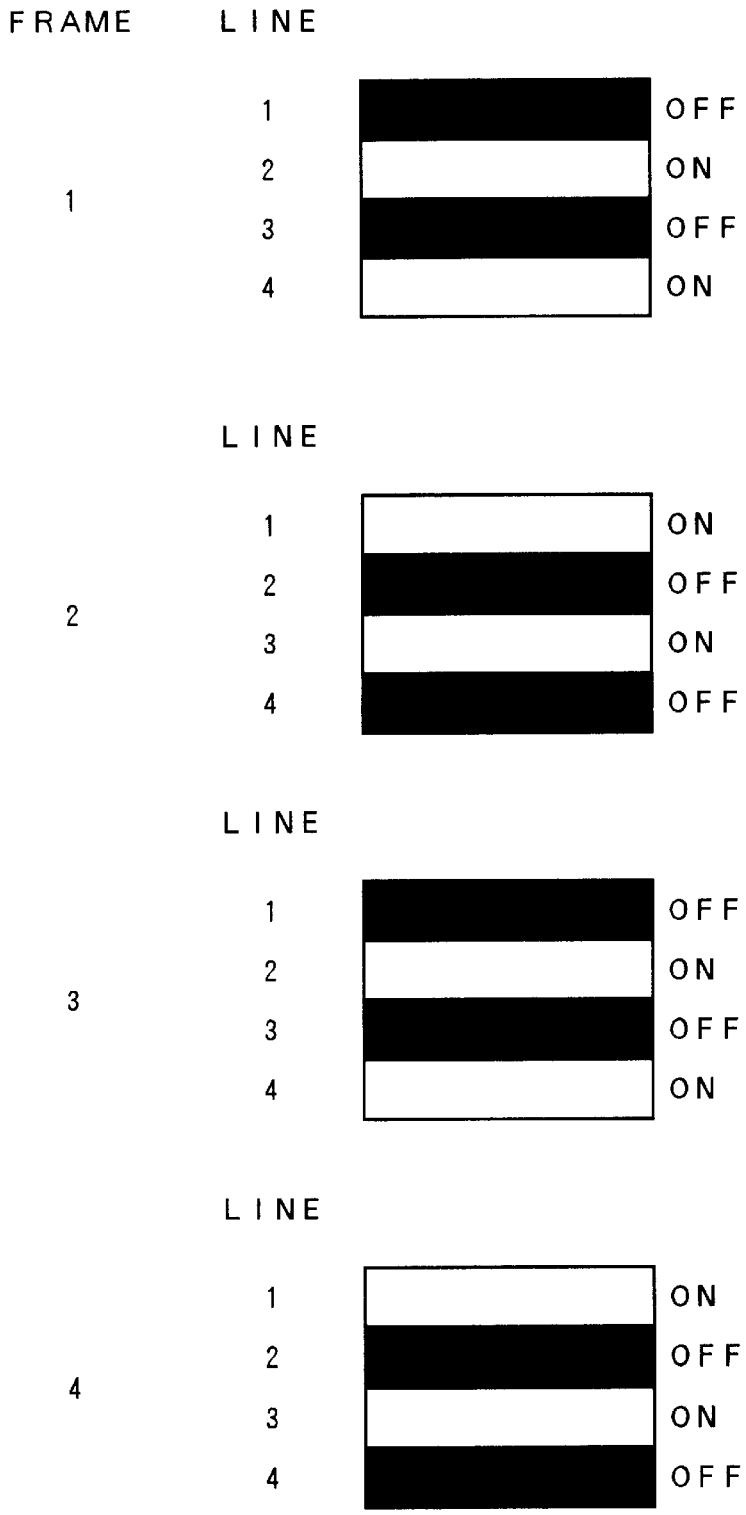
FIG. 63 PRIOR ART
FIG. 63 is a diagram for explaining halftone patterns in the prior art.

FIGS. 62(*a*)~62(*i*) concern an allover halftone display which is presented when the dark display level and the bright display level are afforded alternately in the successive frames in conformity with the tables of the operation in FIGS. 61(*a*)~61(*c*). FIG. 62(*a*) illustrates a display pattern which is actually visible in this case, and FIGS. 62(*b*)~62(*i*) illustrate display patterns in the individual frames. In the display pattern of the first frame shown in FIG. 62(*b*), in the horizontal direction of the liquid-crystal display panel 4022, line #0 has patterns each of which is configured of the bright display level, bright display level, dark display level, bright display level, dark display level, dark display level, bright display level and dark display level as one set for 8 pixels, and which are iterated. Besides, in the vertical direction, patterns obtained by shifting the patterns of the line #0 one pixel leftwards in succession are iteratively displayed. The display pattern of the second frame shown in FIG. 62(*c*) is such that the whole display pattern shown in FIG. 62(*b*) is shifted one pixel rightwards in succession. Thenceforth, the whole display patterns are similarly shifted one pixel rightwards in succession with the proceeding of the frames as illustrated in FIGS. 62(*d*)~62(*i*).

In this example stated above, a halftone display level indicated in FIG. 62(*a*) can be attained by changing-over the dark display level and the bright display level at a cycle of the 8 frames of the first~eighth frames.

By the way, in this embodiment, the tables of the operation of the decoder 5914 illustrated in FIGS. 61(*a*)~61(*c*) are not restrictive, but the combinations of the output values of the respective select signals may well be set otherwise.

As set forth above, according to the eighth embodiment, the liquid-crystal display system of multiple-tone displays less liable to flicker can be realized.

According to the present invention, in a case where a halftone display is presented in pixel unit by changing-over the voltage of display-ON (or first data) and the voltage of display-OFF (or second data) in successive frames, a control is performed on the basis of the contents of input display data so that both the voltages may uniformly disperse in the individual frames. Therefore, the invention brings forth the effect that a flickerless halftone display becomes possible irrespective of display patterns.

We claim:

1. A liquid-crystal halftone display system comprising:

a data driver which receives liquid-crystal display data corresponding to input display data representing any of display-ON, display-OFF and a halftone display for each of a plurality of pixels for one line, and which outputs said liquid-crystal display data for one line as horizontal display data;

a scan driver which designates a line of a liquid-crystal panel for displaying said horizontal display data;

a liquid-crystal panel which displays said horizontal display data as visible information on the line designated by said scan driver;

a line memory in which the input display data is stored for at least one line; and halftone pattern generating means for generating said liquid-crystal display data to be received by said data driver by the use of contents of said line memory and the input display data;

wherein said halftone pattern generating means includes:

ON data generating means for generating ON data in response to the input display data which represents said display-ON for a pixel;

OFF data generating means for generating OFF data in response to the input display data which represents said display-OFF for a pixel;

halftone data generating means for generating ON data and OFF data alternately in successive frames as halftone data in response to the input display data which represents the halftone display for a pixel;

comparing means for comparing the input display data for a pertinent line with the input display data for a preceding line stored in said line memory for every line, the preceding line being in a same frame as the pertinent line; and inverting means for inverting a phase of changing-over said ON data and said OFF data of said halftone data in accordance with an output of said comparing means.

2. A liquid-crystal halftone display system as defined in claim 1, wherein inverted data of said halftone data for said preceding line which is obtained in accordance with the output of said comparing means is used as said halftone data for said pertinent line in an odd one of said successive frames, and inverted data of said halftone data of said pertinent line in a preceding one of said successive frames is used as said halftone data for said pertinent line in an even one of said successive frames.

3. A liquid-crystal halftone display system as defined in claim 1, wherein said comparing means determines a number of pixels of said pertinent line which have said halftone display represented, thus being halftone pixels, and which have pixel positions which do not coincide with pixel positions of halftone pixels of said preceding line, and when said number is greater than a predetermined number, said inverting means does not invert said phase of changing-over said ON data and said OFF data of said halftone data.

4. A liquid-crystal halftone display system as defined in claim 3, wherein said inverting means includes means for detecting two successive occurrences of non-inversion of said phase with respect to two lines, and means for inverting said phase for a second one of said two lines.

5. A liquid-crystal halftone display system as defined in claim 1, wherein said halftone data generating means generates said ON data and said OFF data alternately in said successive frames when said pertinent line is a head line of a frame, and wherein said comparing means does not compare said input display data for said pertinent line with said input display data for said preceding line when said pertinent line is said head line of a frame.

6. A liquid-crystal halftone display system as defined in claim 1, wherein a first group of pixels for which said phase of changing-over said ON data and said OFF data of said halftone data is inverted by said inverting means and a second group of pixels for which said phase of changing-over said ON data and said OFF data of said halftone data is not inverted by said inverting means are previously determined based on positions of pixels in said first group of pixels and said second group of pixels on one line, and said phase of changing-over said ON data and said OFF data of said halftone data is fixed for the second group of pixels at all times.

7. A liquid-crystal halftone display system as defined in claim 1, wherein said comparing means compares said input display data for said pertinent line with the input display data for a line preceding said pertinent line by N lines (where N denotes an integer of at least 2).

8. A liquid-crystal halftone display system comprising:

a data driver which receives liquid-crystal display data corresponding to input display data for one line, and which outputs said liquid-crystal display data for one line as horizontal display data;

a scan driver which designates a line of a liquid-crystal panel for displaying said horizontal display data;

a liquid-crystal panel which displays said horizontal display data as visible information on the line designated by said scan driver; and halftone data generating means, provided for each of at least two of a plurality of tones expressed by the input display data, for outputting first data and second data as the liquid-crystal display data for one pixel alternately in successive frames;

wherein a phase of changing-over said first data and said second data is made different for every pixel or every plurality of pixels and for every line or every plurality of lines;

wherein for a first halftone pixel having a pertinent tone on a pertinent line, whether the first data or the second data is outputted from the halftone data generating means is previously determined based on (1) a position of the pertinent line in a frame and (2) whether the first halftone pixel is assigned to an even frame or an odd frame; and wherein the phase of changing-over the first data and the second data is successively inverted at each halftone pixel having the pertinent tone on the pertinent line beginning with the first halftone pixel having the pertinent tone.

9. A liquid-crystal halftone display system as defined in claim 8, wherein a phase of a first halftone pixel on one line having a second tone which differs from a first tone of a halftone pixel appearing at the beginning of the one line and immediately preceded by a halftone pixel having the first tone is inverted relative to a phase of the immediately preceding halftone pixel having the first tone.

10. A liquid-crystal halftone display system as defined in claim 8, further comprising liquid-crystal alternation means for alternating drive of said liquid-crystal panel every frame, wherein said first and second data are changed-over every two frames.

11. A liquid-crystal halftone display system as defined in claim 10, further comprising select signal generating means for generating four sorts of select signals of different phases which serve to change-over said liquid-crystal display data every two frames, wherein one of said four sorts of select signals is picked on the basis of a line position and a dot position of each pixel, and the change-over of said first and second data is effected every pixel in accordance with the picked select signal.

12. A liquid-crystal halftone display system as defined in claim 8, further comprising liquid-crystal alternation means for alternating drive of said liquid-crystal panel every two frames.

13. A liquid-crystal halftone display system as defined in claim 8, wherein on each line, the phases which are inverted successively from a left side of the line are allocated to respective leftmost halftone pixels of different tones, and the phases which are inverted successively from said phases of said leftmost halftone pixels are allocated to halftone pixel of the respective tones.

14. A liquid-crystal halftone display system as defined in claim 8, further comprising alternation means for inverting every frame a sign of a voltage which is applied by said data driver to said liquid-crystal panel;

wherein said halftone data generating means inverts an order in which it outputs said first data and said second data every frame and every M frames (where M denotes an even number of at least 4).

15. A liquid-crystal halftone display system as defined in claim 14, wherein said halftone data generating means includes select signal generating means for generating 2M sorts of select signals of different phases which serve to invert the order in which said halftone data generating means outputs said first data and said second data every frame and every M frames, and wherein one of said 2M sorts of select signals is picked on the basis of a line position and a dot position of each pixel, and the change-over of said first and second data is effected every pixel in accordance with the picked select signal.

16. A liquid-crystal halftone display system as defined in claim 8, further comprising alternation means for inverting a sign of a voltage which is applied by said data driver to said liquid-crystal panel every frame and every M frames (where M denotes an even number of at least 4).

17. A liquid-crystal halftone display system comprising:

a data driver which receives liquid-crystal display data corresponding to input display data for one line, and which outputs said liquid-crystal display data for one line as horizontal display data;

a scan driver which designates a line of a liquid-crystal panel for displaying said horizontal display data;

a liquid-crystal panel which displays said horizontal display data as visible information on the line designated by said scan driver; and halftone data generating means, provided for each of at least two of a plurality of tones expressed by the input display data, for outputting first data and second data as the liquid-crystal display data for one pixel alternately in successive frames;

wherein a phase of changing-over said first data and said second data is made different for every pixel or every plurality of pixels and for every line or every plurality of lines; and wherein in case of attaining a halftone brightness B by the use of voltages Va and Vb which are applied liquid-crystal voltages corresponding to said first data and said second data, respectively, said voltages Va and Vb are set so as to satisfy $y \leqq 0.16$, y being a proportion of people who see a flicker when observing the liquid-crystal display panel with y=1.0 representing a proportion of 100%, under conditions of:

$y=1.068\ x_1+0.001\ x_2+0.056$ for a frame frequency of 56 Hz, $y=1.399\ x_1+0.003\ x_2-0.699$ for a frame frequency of 70 Hz, and $y=0.430\ x_1+0.003\ x_2-0.235$ for a frame frequency of 90 Hz;

subject to $x_1=\log Ba-\log Bb$ and $x_2=B$ where Ba denotes a brightness attained by selecting said voltage Va every frame, while Bb denotes a brightness attained by selecting said voltage Vb every frame.

* * * * *

UNITED STATES PATENT AND TRADEMARK OFFICE

CERTIFICATE OF CORRECTION

PATENT NO : 6,072,451

DATED : June 6, 2000

INVENTOR(S): Mano et al.

It is certified that error appears in the above-identified patent and that said Letters Patent is hereby corrected as shown below:

Column 4, line 51, delete "8,;" insert --8;--.

Column 7, line 26, delete the comma after "in";

line 28, delete the comma after '"line")'.

Column 9, line 14, delete "u modified" insert --unmodified--;

line 15, delete the comma after "103".

Column 10, line 13, delete "temporality" insert --temporarily--;

line 31, delete "to";

line 32, delete "present" insert --presenting--, delete the comma after "displays".

Column 12, line 14, delete the comma after "intact";

line 17, delete "inverts" insert --generates--;

UNITED STATES PATENT AND TRADEMARK OFFICE

CERTIFICATE OF CORRECTION

PATENT NO : 6,072,451

DATED : June 6, 2000

INVENTOR(S) : Mano et al.

It is certified that error appears in the above-identified patent and that said Letters Patent is hereby corrected as shown below:

line 48, delete "read data 209," insert --latch data 403,--.

Column 14, line 22, delete the comma after "Although", delete "above," insert --above description,--.

Signed and Sealed this

Eighth Day of May, 2001

*Attest:*

Nicholas P. Godici

NICHOLAS P. GODICI

*Attesting Officer*

*Acting Director of the United States Patent and Trademark Office*